US012043980B2

(12) United States Patent
Kodaira et al.

(10) Patent No.: US 12,043,980 B2
(45) Date of Patent: Jul. 23, 2024

(54) SEABED RESOURCE LIFTING APPARATUS

(71) Applicant: Lakshmi Co., Ltd., Tokyo (JP)

(72) Inventors: Takatoshi Kodaira, Tokyo (JP); Ichiro Nakatani, Tokyo (JP)

( * ) Notice: Subject to any disclaimer, the term of this patent is extended or adjusted under 35 U.S.C. 154(b) by 742 days.

(21) Appl. No.: 17/159,776

(22) Filed: Jan. 27, 2021

(65) Prior Publication Data

US 2021/0214916 A1 Jul. 15, 2021

Related U.S. Application Data

(63) Continuation-in-part of application No. PCT/JP2019/029712, filed on Jul. 29, 2019.

(51) Int. Cl.
*E02F 7/00* (2006.01)
*E02F 3/88* (2006.01)

(52) U.S. Cl.
CPC ..... *E02F 7/005* (2013.01); *E02F 3/8858* (2013.01)

(58) Field of Classification Search
CPC .. E21C 50/00; E02F 7/00; E02F 7/005; E02F 7/02; E02F 7/023; E02F 7/065; E02F 5/006; E02F 3/8833; E02F 3/885; E02F 3/8858; E02F 3/8866; E02F 3/902; E02F 3/907; E02F 9/06; E02F 9/067; E02F 9/0883; E02F 9/18; E02F 9/2025
See application file for complete search history.

(56) References Cited

U.S. PATENT DOCUMENTS

2015/0132099 A1* 5/2015 Fuhr ..... B63C 7/06 114/54
2018/0298754 A1* 10/2018 Kodaira ..... B63B 22/24

FOREIGN PATENT DOCUMENTS

| | | | |
|---|---|---|---|
| JP | 2011-196047 A | | 10/2011 |
| JP | 2012-30637 A | | 2/2012 |
| JP | 2013-166406 A | | 8/2013 |
| JP | 2013166406 A | * | 8/2013 |
| JP | 2014-156176 A | | 8/2014 |
| WO | WO 2013/118876 A1 | | 8/2013 |

OTHER PUBLICATIONS

Nobuo Shimizu, Salvage Techno Marine, The Society of Naval Architects of Japan, May 2002.
Kei Takano, Evaluation of Slurry Transportation of large particles in the Rising Ore pipe for Seafloor Mineral Resource Development, Workshop, Maritime Res. Inst. Dec. 2013.
(Continued)

*Primary Examiner* — Jamie L McGowan
(74) *Attorney, Agent, or Firm* — Patshegen IP; Moshe Pinchas

(57) ABSTRACT

The present invention relates to a system and its equipments to collect mineral ores on the seabed and to float them up to the sea surface by utilizing the buoyancy of a liquid having a specific gravity less than that of water at room temperature. It is an underwater navigator capable of autonomous navigation that descends at a specific gravity of around 1.0 with a ballast that cancels buoyancy when descending from the sea surface, and ascends at a specific gravity of around 1.0 by exchanging mineral ores with the ballast on the seabed. On the seafloor, it is accompanied by a device that collects seabed mineral ores for the underwater vehicle.

7 Claims, 52 Drawing Sheets

(56) References Cited

OTHER PUBLICATIONS

Ministry of Economy, Trade and Industry Japan, The Development Plan of Ocean Energy and Ocean Mineral Resources Dec. 2013.
Yoichi Oda, The Recent Trend of Seafloor Mineral Resource Development Mitsui & Co., Ltd. Strategy Research Institute, Apr. 2013.
Shinji Ishiguro, Development of Mining Element Engineering Test Machine for Operating in Seafloor Hydrothermal Deposits Mitsubishii Heavy Industry Technical Bulletin No. 2, 20.
Raymond Kristiansen, Satellite Attitude Control by Quaternion-Based Backstepping 2005 American Control Conference, Jun. 8-10, 2005. Portland, OR, USA.
"Submarine hydrothermal deposit mining / lifting pilot test" JOGMEC News Mar. 2018.
Sound Metrics http://www.soundmetrics.com/.
ISR; Japan Patent Office; Tokyo; Oct. 1, 2019.

* cited by examiner

| radius m | diameter m | volume m3 | buoyancy (Ton) | | cost |
|---|---|---|---|---|---|
| | | | gasoline | n-pentane | Gasoline M¥ |
| 1.20 | 2.40 | 7.24 | 2.17 | 2.73 | 0.72 |
| 1.30 | 2.60 | 9.20 | 2.76 | 3.47 | 0.92 |
| 1.40 | 2.80 | 11.49 | 3.45 | 4.33 | 1.15 |
| 1.50 | 3.00 | 14.14 | 4.24 | 5.33 | 1.41 |
| 1.60 | 3.20 | 17.16 | 5.15 | 6.47 | 1.72 |
| 1.70 | 3.40 | 20.58 | 6.17 | 7.76 | 2.06 |
| 1.80 | 3.60 | 24.43 | 7.33 | 9.21 | 2.44 |
| 1.90 | 3.80 | 28.73 | 8.62 | 10.83 | 2.87 |
| 2.00 | 4.00 | 33.51 | 10.05 | 12.63 | 3.35 |
| 2.10 | 4.20 | 38.79 | 11.64 | 14.62 | 3.88 |
| 2.20 | 4.40 | 44.60 | 13.38 | 16.82 | 4.46 |
| 2.30 | 4.60 | 50.97 | 15.29 | 19.21 | 5.10 |
| 2.40 | 4.80 | 57.91 | 17.37 | 21.83 | 5.79 |
| 2.50 | 5.00 | 65.45 | 19.63 | 24.67 | 6.54 |
| 2.60 | 5.20 | 73.62 | 22.09 | 27.76 | 7.36 |
| 2.70 | 5.40 | 82.45 | 24.73 | 31.08 | 8.24 |
| 2.80 | 5.60 | 91.95 | 27.59 | 34.67 | 9.20 |
| 2.90 | 5.80 | 102.16 | 30.65 | 38.51 | 10.22 |
| 3.00 | 6.00 | 113.10 | 33.93 | 42.64 | 11.31 |
| 3.10 | 6.20 | 124.79 | 37.44 | 47.05 | 12.48 |
| 3.20 | 6.40 | 137.26 | 41.18 | 51.75 | 13.73 |
| 3.30 | 6.60 | 150.53 | 45.16 | 56.75 | 15.05 |
| 3.40 | 6.80 | 164.64 | 49.39 | 62.07 | 16.46 |
| 3.50 | 7.00 | 179.59 | 53.88 | 67.71 | 17.96 |
| 3.60 | 7.20 | 195.43 | 58.63 | 73.68 | 19.54 |
| 3.70 | 7.40 | 212.17 | 63.65 | 79.99 | 21.22 |
| 3.80 | 7.60 | 229.85 | 68.95 | 86.65 | 22.98 |
| 3.90 | 7.80 | 248.47 | 74.54 | 93.68 | 24.85 |
| 4.00 | 8.00 | 268.08 | 80.42 | 101.07 | 26.81 |
| 4.10 | 8.20 | 288.70 | 86.61 | 108.84 | 28.87 |
| 4.20 | 8.40 | 310.34 | 93.10 | 117.00 | 31.03 |
| 4.30 | 8.60 | 333.04 | 99.91 | 125.56 | 33.30 |
| 4.40 | 8.80 | 356.82 | 107.05 | 134.52 | 35.68 |
| 4.50 | 9.00 | 381.70 | 114.51 | 143.90 | 38.17 |

gasoline price ¥100/litter

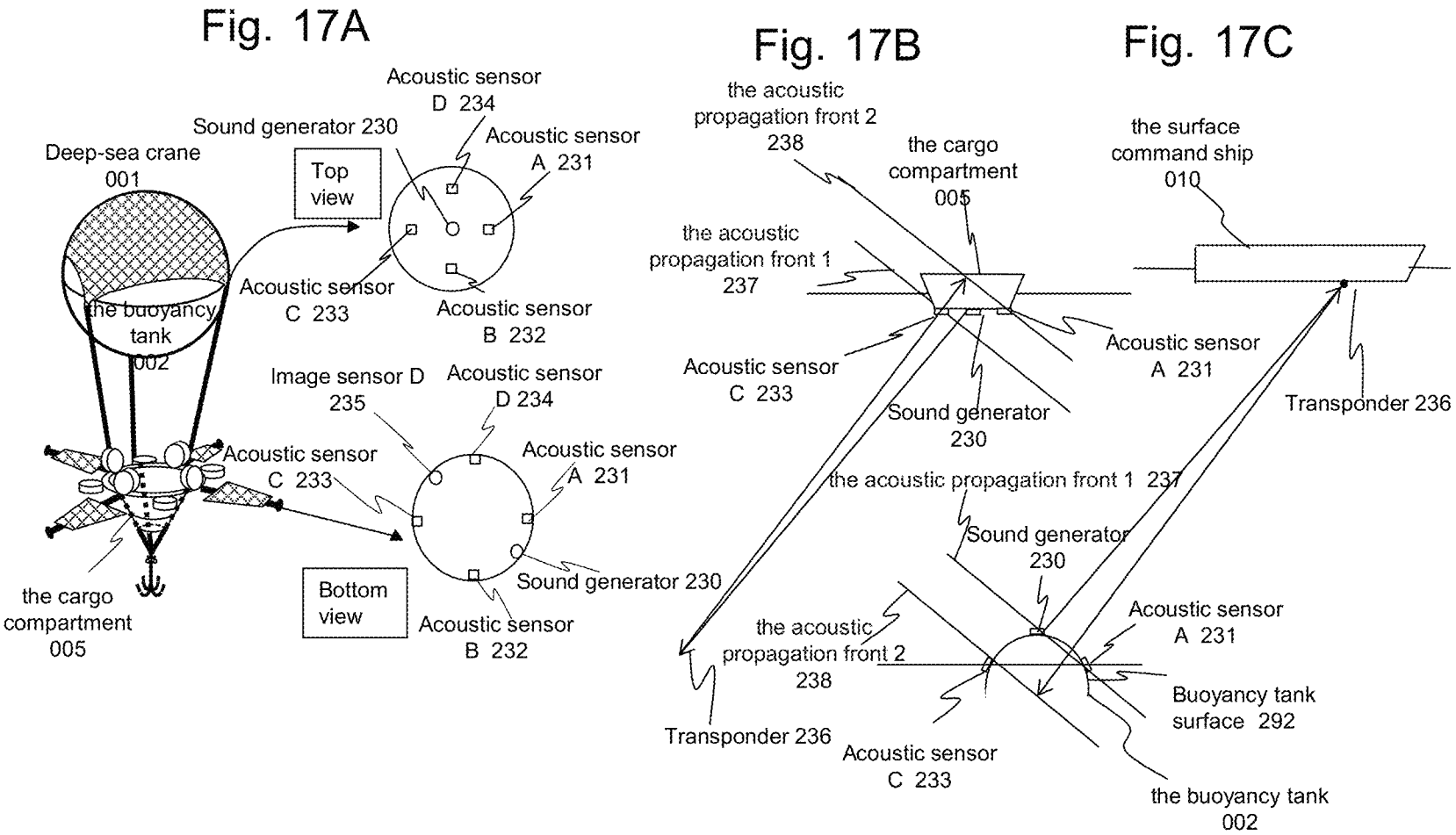
Fig. 17A
Deep-sea crane 001
the buoyancy tank 002
Sound generator 230
Top view
Acoustic sensor D 234
Acoustic sensor A 231
Acoustic sensor B 232
Acoustic sensor C 233
Image sensor D 235
Acoustic sensor D 234
Acoustic sensor A 231
Sound generator 230
Acoustic sensor B 232
Acoustic sensor C 233
Bottom view
the cargo compartment 005
Fig. 17B
the acoustic propagation front 2 238
the cargo compartment 005
the acoustic propagation front 1 237
Acoustic sensor C 233
Sound generator 230
Acoustic sensor A 231
the acoustic propagation front 1 237
Sound generator 230
the acoustic propagation front 2 238
Transponder 236
Acoustic sensor C 233
Fig. 17C
the surface command ship 010
Transponder 236
Acoustic sensor A 231
Acoustic sensor A 231
Buoyancy tank surface 292
the buoyancy tank 002

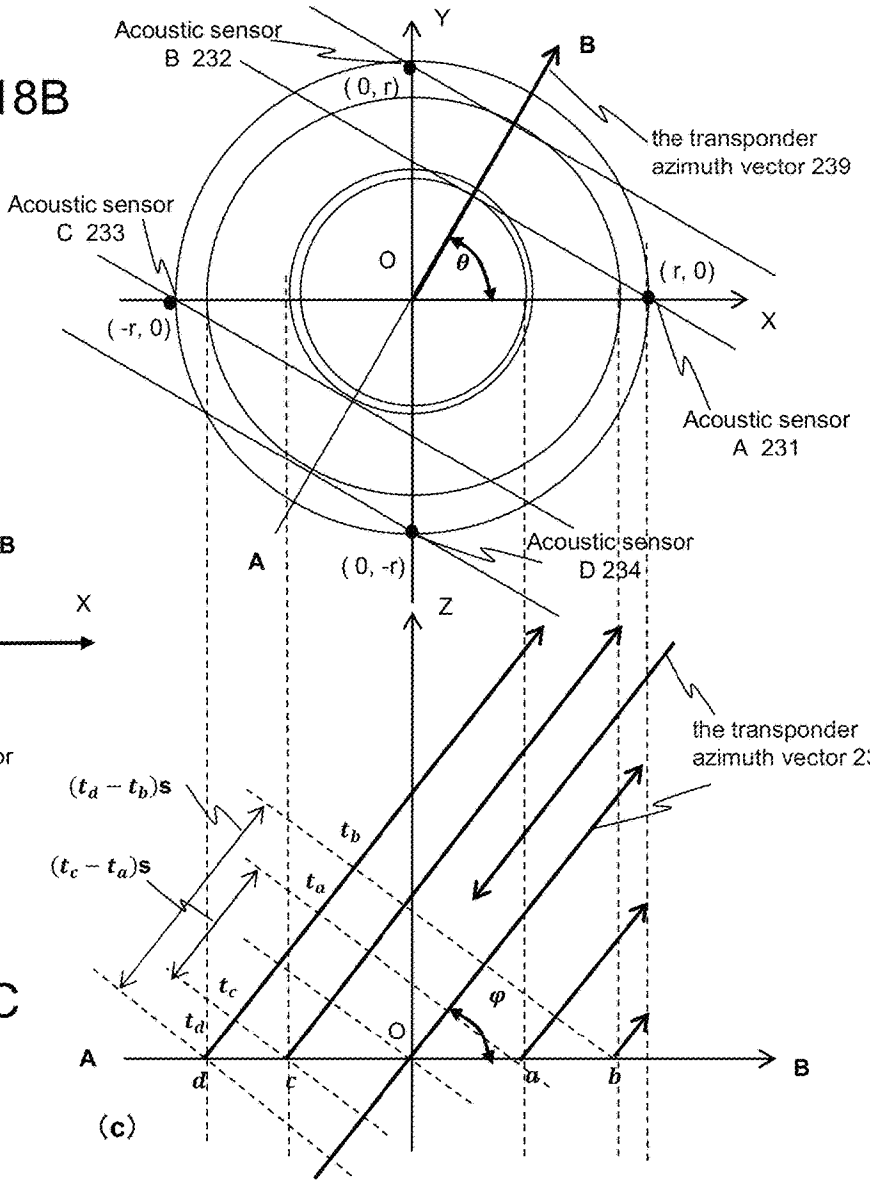
Fig. 18B
Fig. 18C
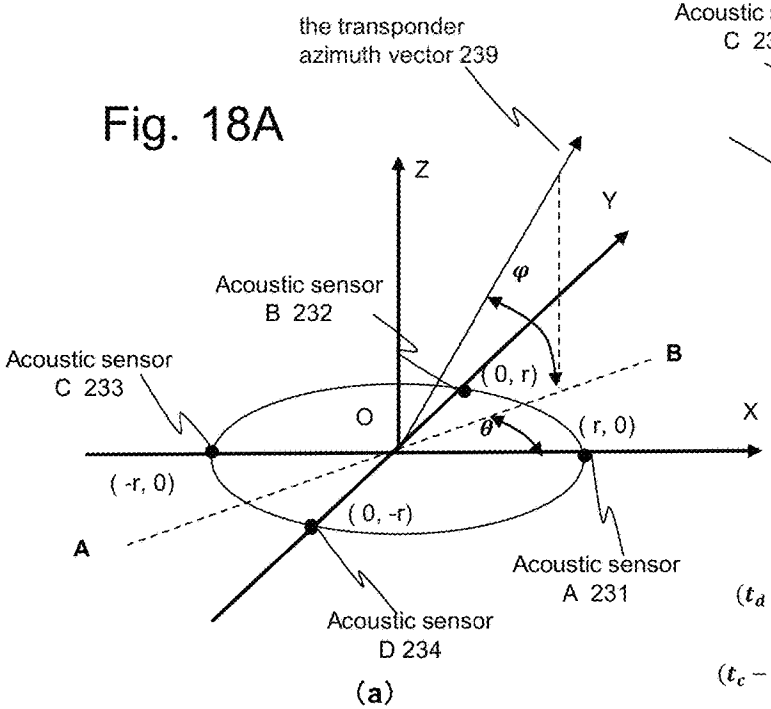
Fig. 18A

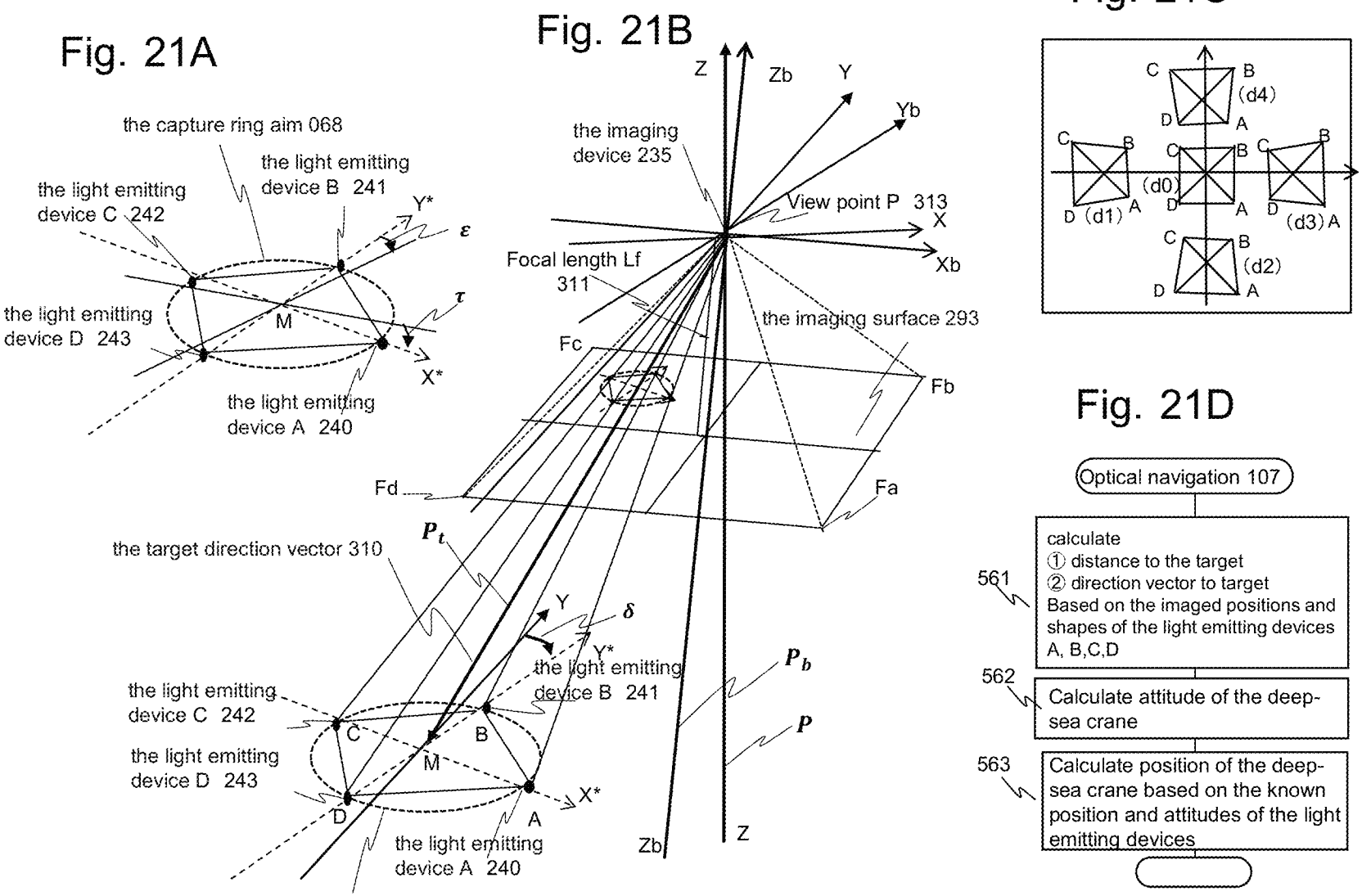
Fig. 21A
the capture ring aim 068
the light emitting device B 241
the light emitting device C 242
the light emitting device D 243
the light emitting device A 240
Fig. 21B
the imaging device 235
Focal length Lf
311
View point P 313
the imaging surface 293
the target direction vector 310
the light emitting device B 241
the light emitting device A 240
the light emitting device C 242
the light emitting device D 243
the capture ring aim 068
Fig. 21C
Fig. 21D
Optical navigation 107
calculate
① distance to the target
② direction vector to target
Based on the imaged positions and shapes of the light emitting devices A, B,C,D
561
Calculate attitude of the deep-sea crane
562
Calculate position of the deep-sea crane based on the known position and attitudes of the light emitting devices
563

(0,0)
(Hmax,0)
(0,Vmax)
(Hmax,Vmax)
C(Hc,Vc)
B(Hb,Vb)
M(Hm,Vm)
D(Hd,Vd)
A(Ha,Va)
ρ
V
H View point P 313
the imaging surface 293
Target distance R 312
Focal length Lf 311
γ
δ
the light emitting device B 241
the light emitting device D 243
the light emitting device A 240
the light emitting device C 242
φ
ω

View point P 313
the imaging surface 293
α
β
A
B
C
D
M
S
T
U
V
r (a) Top view of attachment for precision control

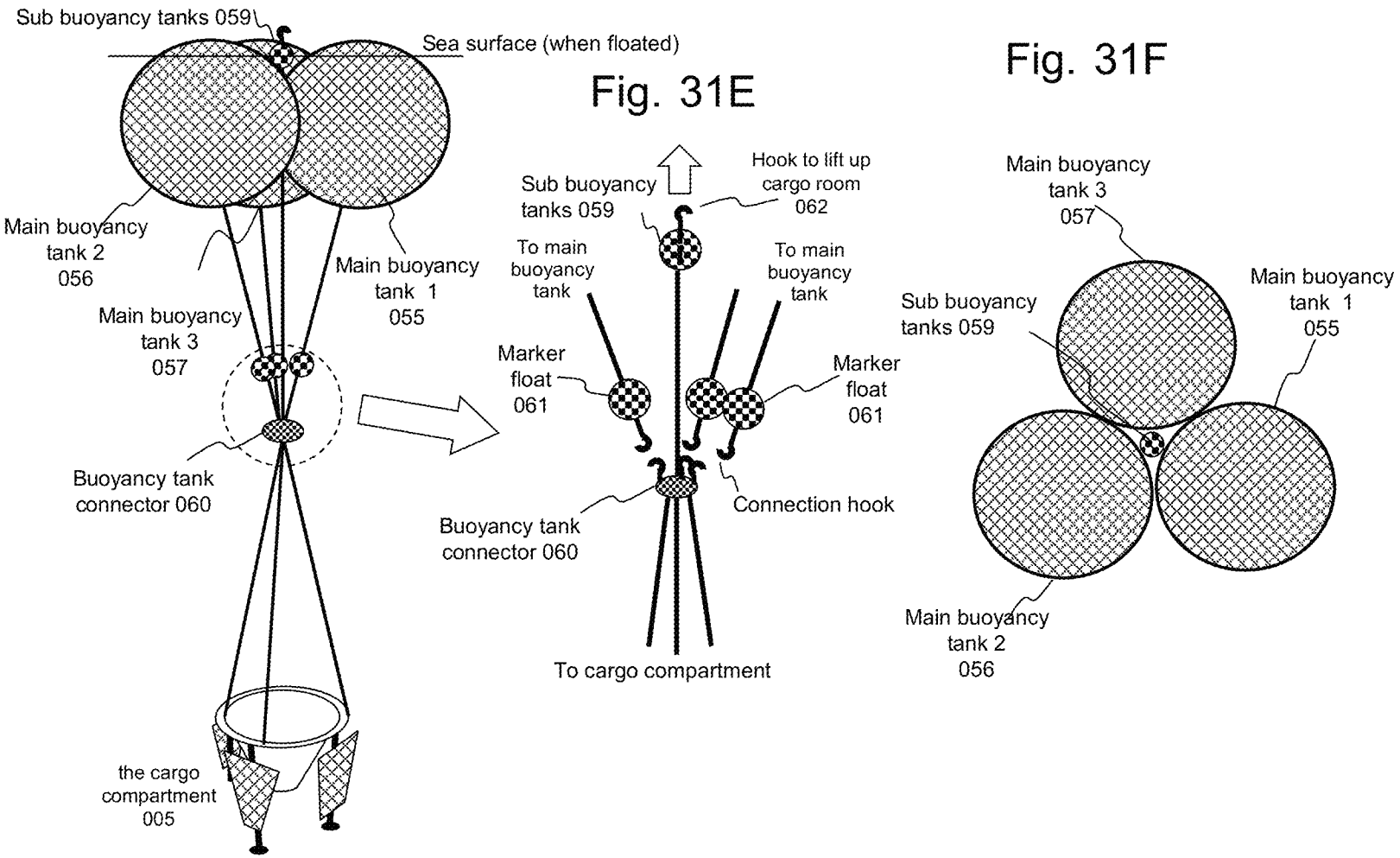
Fig. 31D
Sub buoyancy tanks 059
Sea surface (when floated)
Main buoyancy tank 2 056
Main buoyancy tank 1 055
Main buoyancy tank 3 057
Buoyancy tank connector 060
the cargo compartment 005
Fig. 31E
Sub buoyancy tanks 059
Hook to lift up cargo room 062
To main buoyancy tank
Marker float 061
Connection hook
Buoyancy tank connector 060
To cargo compartment
Fig. 31F
Main buoyancy tank 3 057
Sub buoyancy tanks 059
Main buoyancy tank 1 055
Main buoyancy tank 2 056

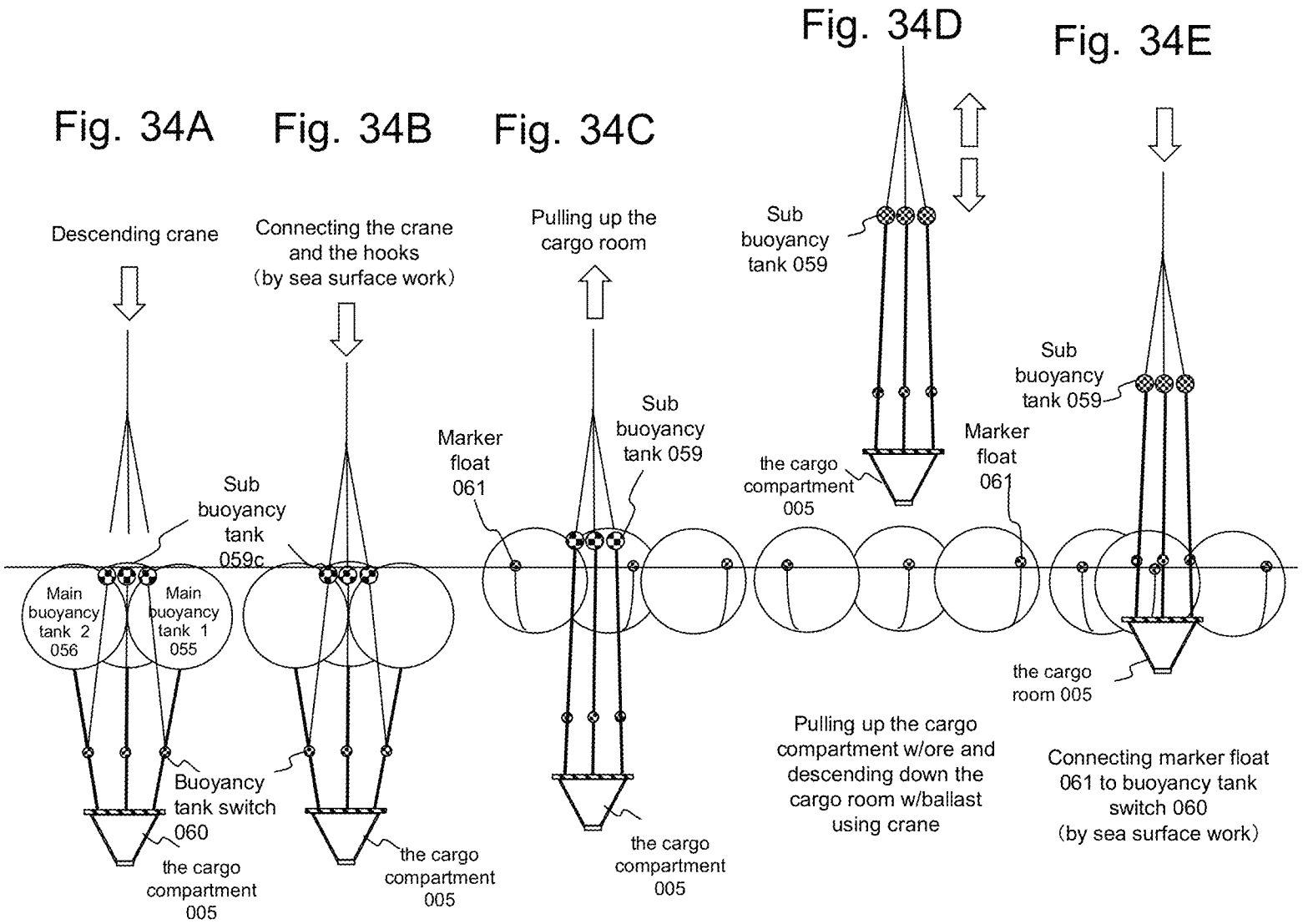
Fig. 34A
Descending crane
Main buoyancy tank 2 056
Main buoyancy tank 1 055
Sub buoyancy tank 059c
Fig. 34B
Connecting the crane and the hooks (by sea surface work)
Buoyancy tank switch 060
the cargo compartment 005
Fig. 34C
Pulling up the cargo room
Sub buoyancy tank 059
Marker float 061
the cargo compartment 005
Fig. 34D
Sub buoyancy tank 059
the cargo compartment 005
Pulling up the cargo compartment w/ore and descending down the cargo room w/ballast using crane
Fig. 34E
Sub buoyancy tank 059
Marker float 061
the cargo room 005
Connecting marker float 061 to buoyancy tank switch 060 (by sea surface work)

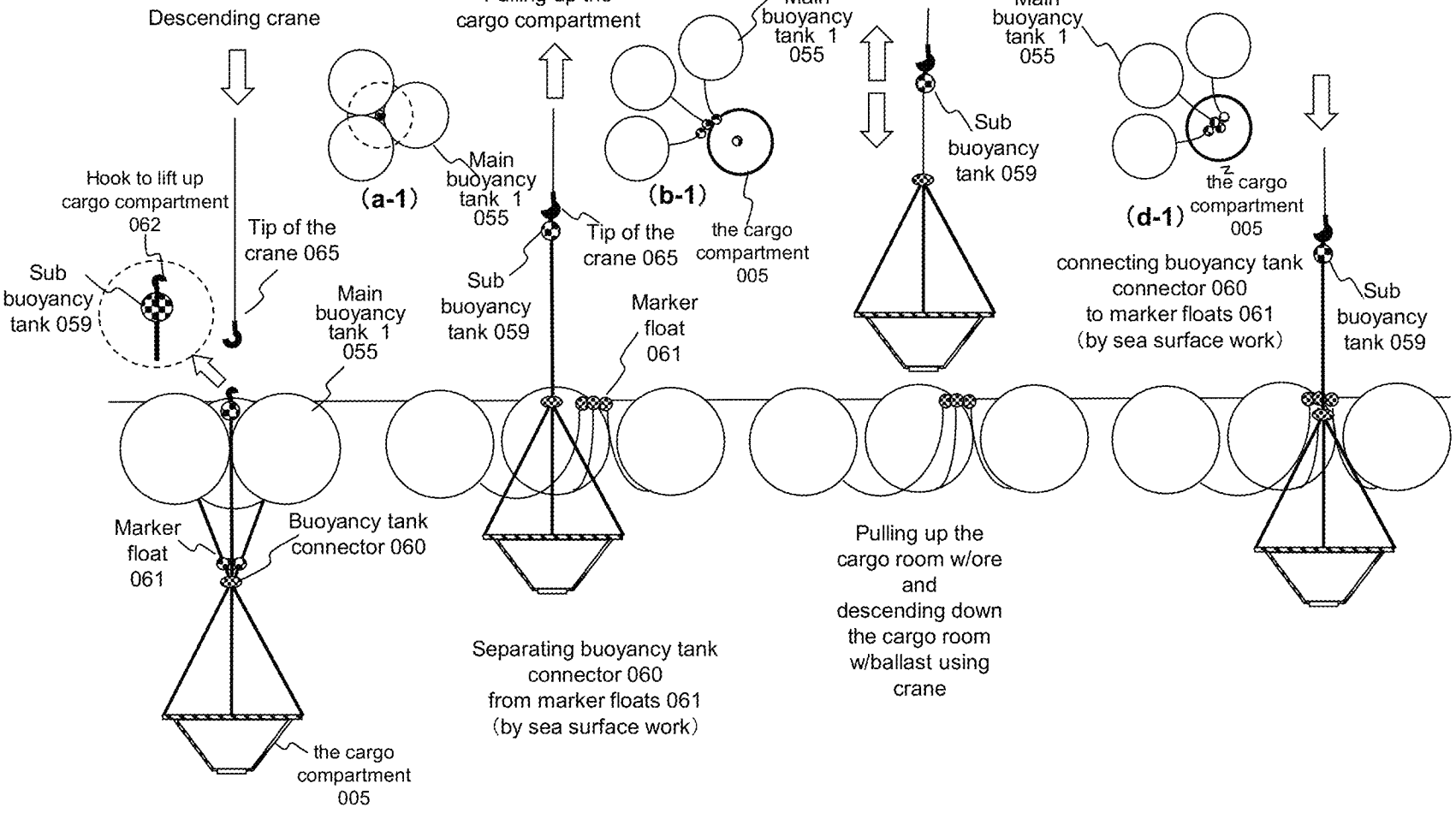
Fig. 34F
Descending crane
Hook to lift up cargo compartment 062
Tip of the crane 065
Sub buoyancy tank 059
Fig. 34G
Pulling up the cargo compartment
(a-1)
Main buoyancy tank 1 055
Tip of the crane 065
Sub buoyancy tank 059
Main buoyancy tank 1 055
Marker float 061
(b-1)
the cargo compartment 005
Fig. 34H
Main buoyancy tank 1 055
Sub buoyancy tank 059
Main buoyancy tank 1 055
Buoyancy tank connector 060
Marker float 061
Separating buoyancy tank connector 060 from marker floats 061 (by sea surface work)
Pulling up the cargo room w/ore and descending down the cargo room w/ballast using crane
the cargo compartment 005
Fig. 34I
(d-1)
the cargo compartment 005
connecting buoyancy tank connector 060 to marker floats 061 (by sea surface work)
Sub buoyancy tank 059

(b) Sound wave form

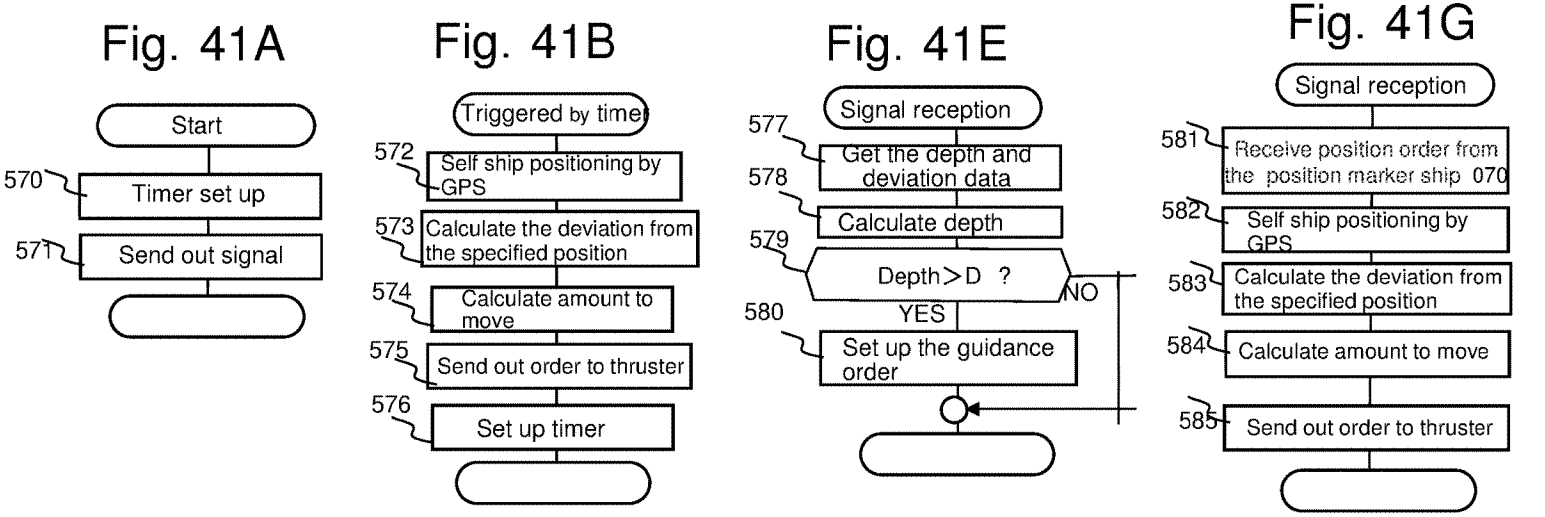
Fig. 41A
Start
Timer set up
Send out signal
570
571
Fig. 41B
Triggered by time
Self ship positioning by GPS
Calculate the deviation from the specified position
Calculate amount to move
Send out order to thruster
Set up timer
572
573
574
575
576
Fig. 41E
Signal reception
Get the depth and deviation data
Calculate depth
Depth>D ?
NO
YES
Set up the guidance order
577
578
579
580
Fig. 41G
Signal reception
Receive position order from the position marker ship 070
Self ship positioning by GPS
Calculate the deviation from the specified position
Calculate amount to move
Send out order to thruster
581
582
583
584
585

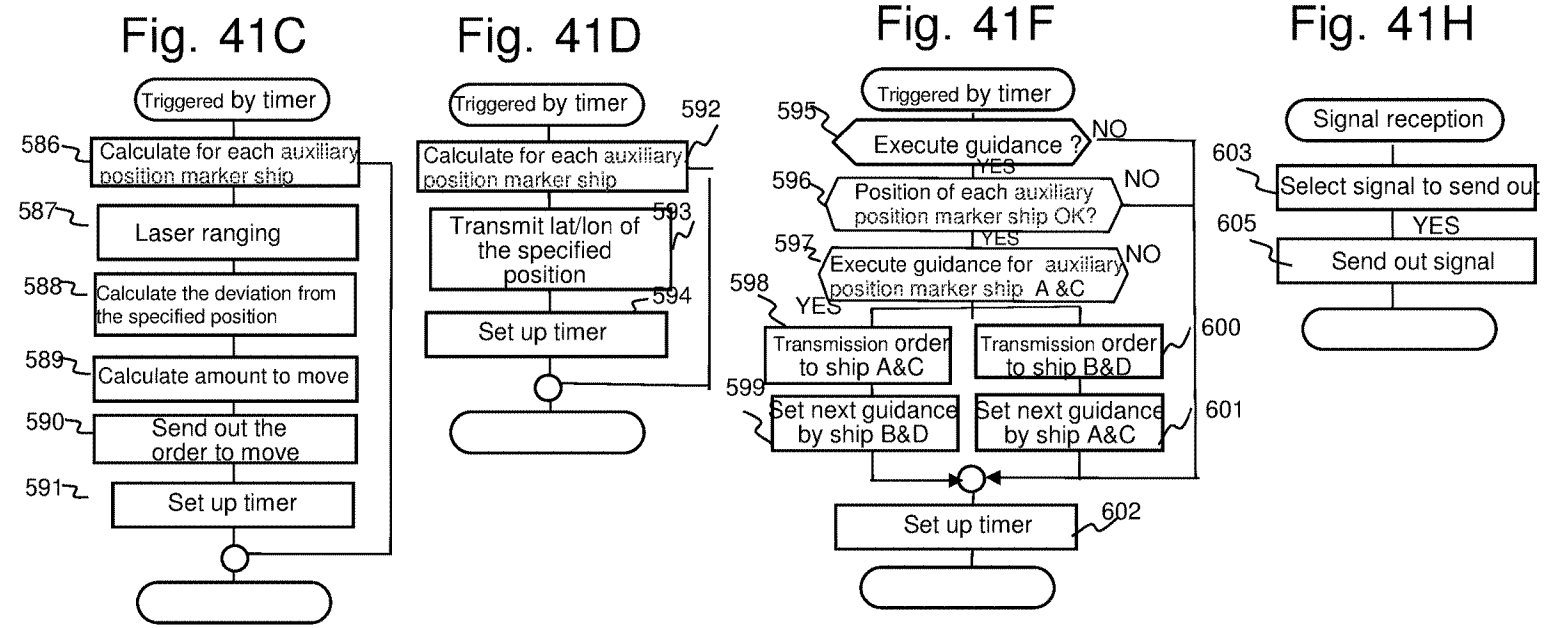
Fig. 41C
Triggered by timer
Calculate for each auxiliary position marker ship
Laser ranging
Calculate the deviation from the specified position
Calculate amount to move
Send out the order to move
Set up timer
586
587
588
589
590
591
Fig. 41D
Triggered by timer
Calculate for each auxiliary position marker ship
Transmit lat/lon of the specified position
Set up timer
592
593
594
Fig. 41F
Triggered by timer
Execute guidance ?
NO
YES
Position of each auxiliary position marker ship OK?
NO
YES
Execute guidance for auxiliary position marker ship A &C
NO
YES
Transmission order to ship A&C
Set next guidance by ship B&D
Transmission order to ship B&D
Set next guidance by ship A&C
Set up timer
595
596
597
598
599
600
601
602
603
Fig. 41H
Signal reception
Select signal to send out
YES
Send out signal
603
605

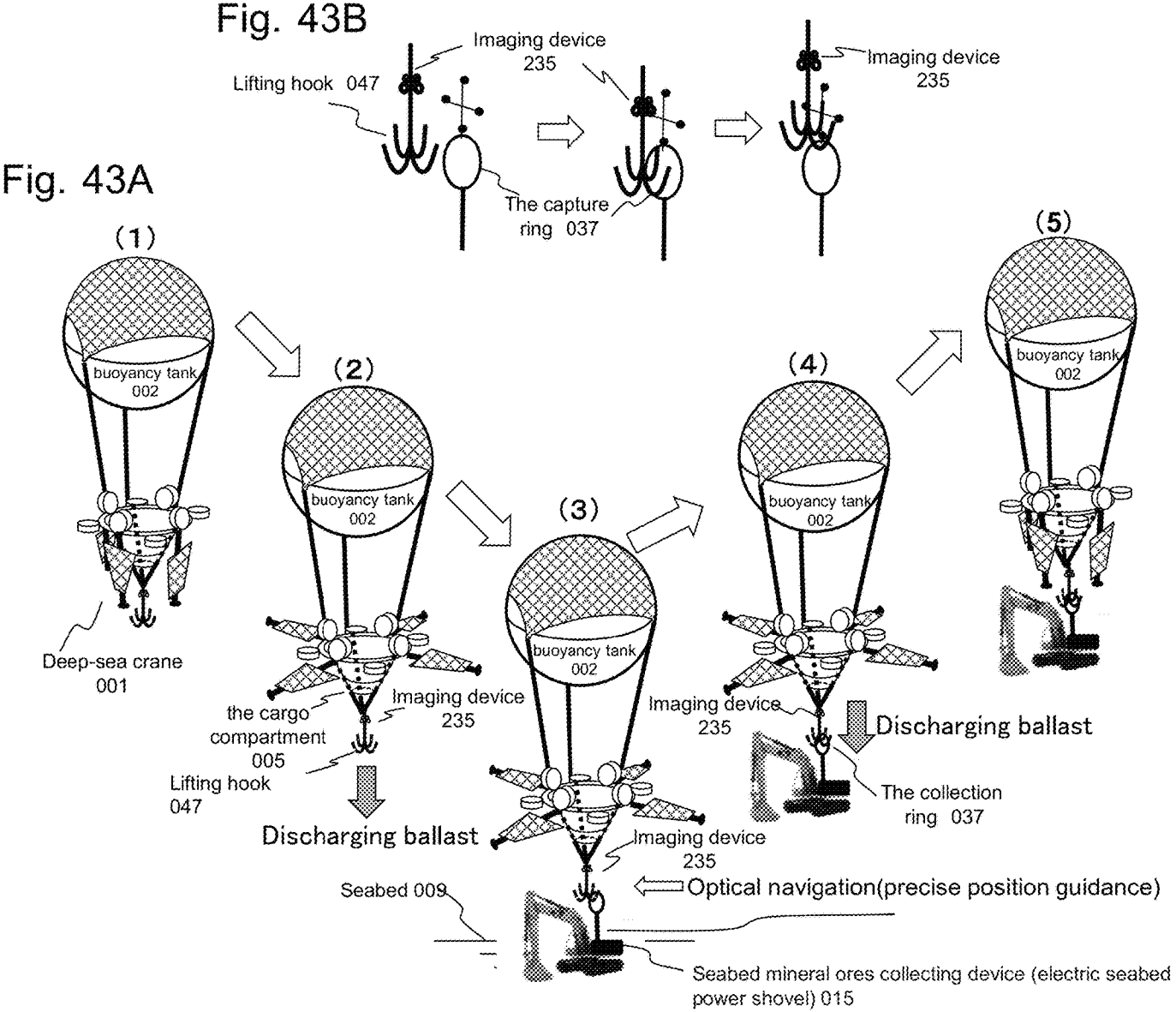
Fig. 43B
Lifting hook 047
Imaging device 235
The capture ring 037
Imaging device 235
Fig. 43A
(1)
buoyancy tank 002
Deep-sea crane 001
(2)
buoyancy tank 002
the cargo compartment 005
Lifting hook 047
Imaging device 235
Discharging ballast
(3)
buoyancy tank 002
Imaging device 235
Seabed 009
Optical navigation(precise position guidance)
Seabed mineral ores collecting device (electric seabed power shovel) 015
(4)
buoyancy tank 002
Imaging device 235
Discharging ballast
The collection ring 037
(5)
buoyancy tank 002

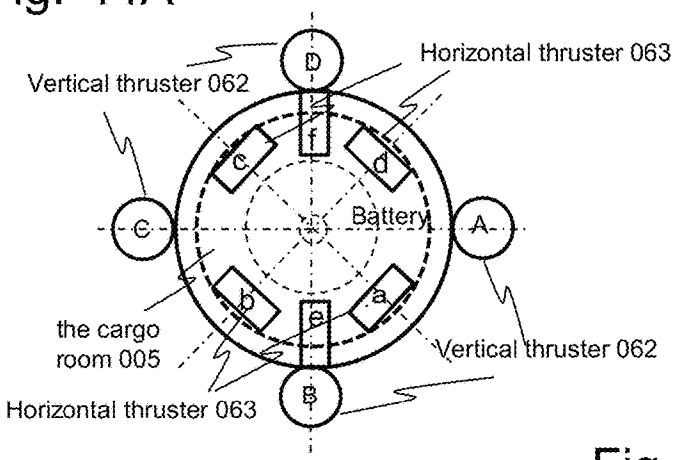
Fig. 44A
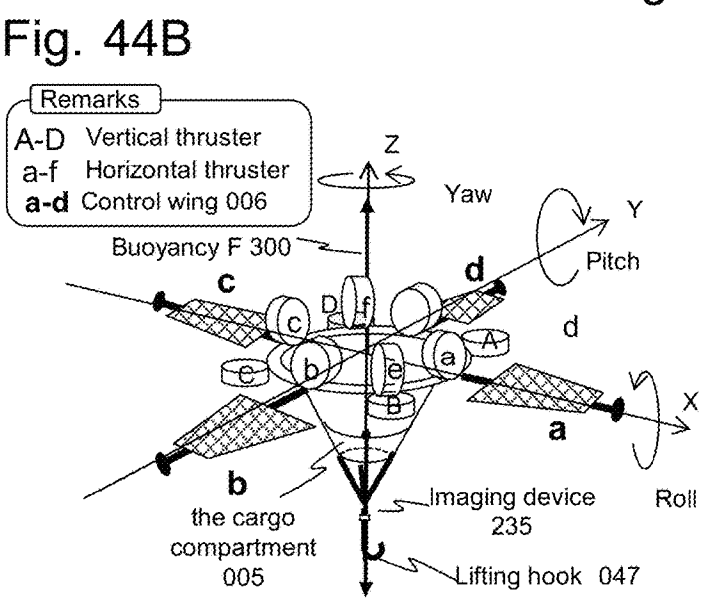
Fig. 44B
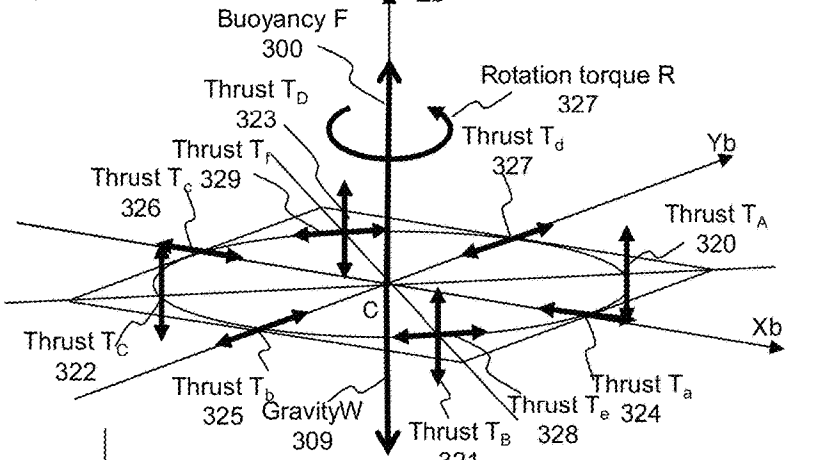
Fig. 44C
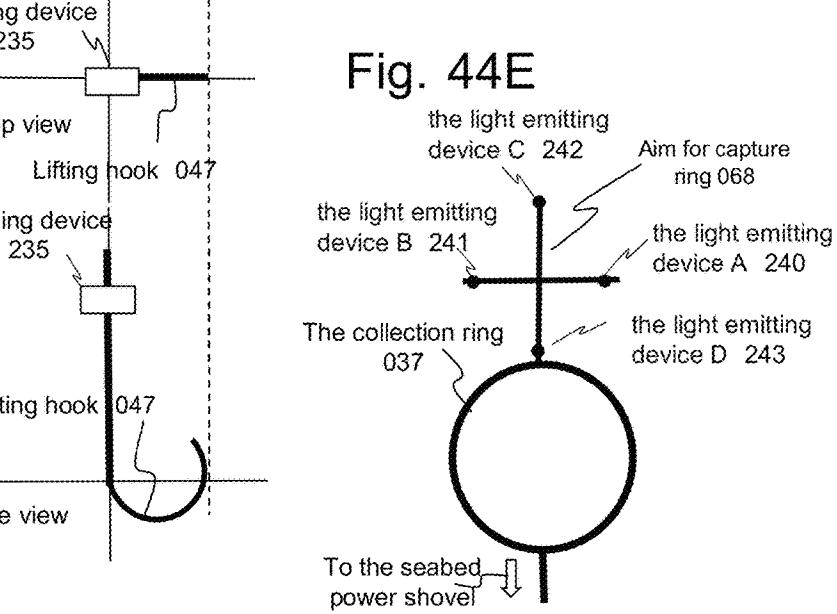
Fig. 44D
Fig. 44E

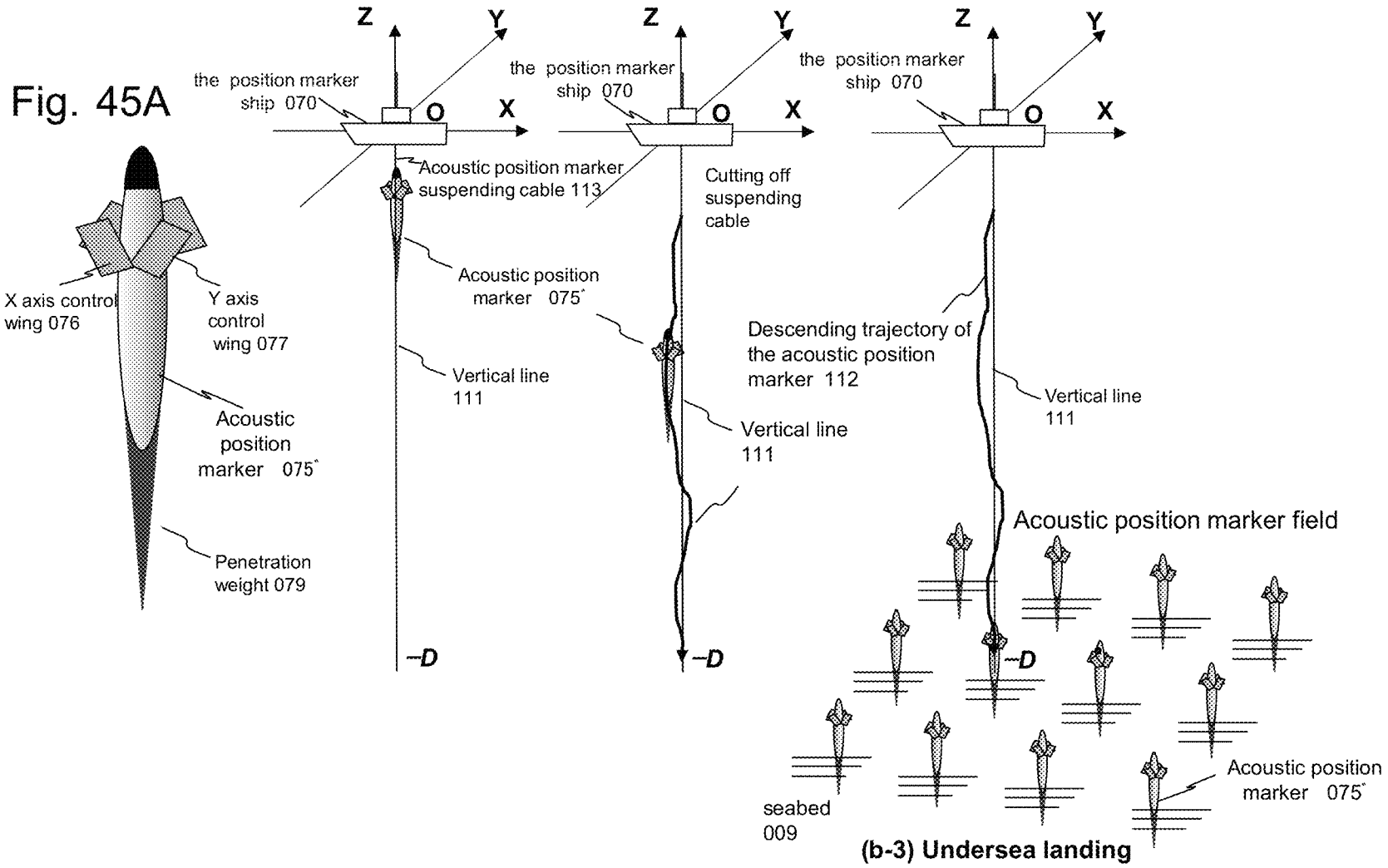
Fig. 45A
X axis control wing 076
Y axis control wing 077
Acoustic position marker 075"
Penetration weight 079
Fig. 45B
the position marker ship 070'
Z
Y
X
O
Acoustic position marker suspending cable 113
Acoustic position marker 075'
Vertical line 111
-D
Fig. 45C
the position marker ship 070
Cutting off suspending cable
Descending trajectory of the acoustic position marker 112
Vertical line 111
Fig. 45D
the position marker ship 070
Vertical line 111
Acoustic position marker field
Acoustic position marker 075"
seabed 009
(b-3) Undersea landing

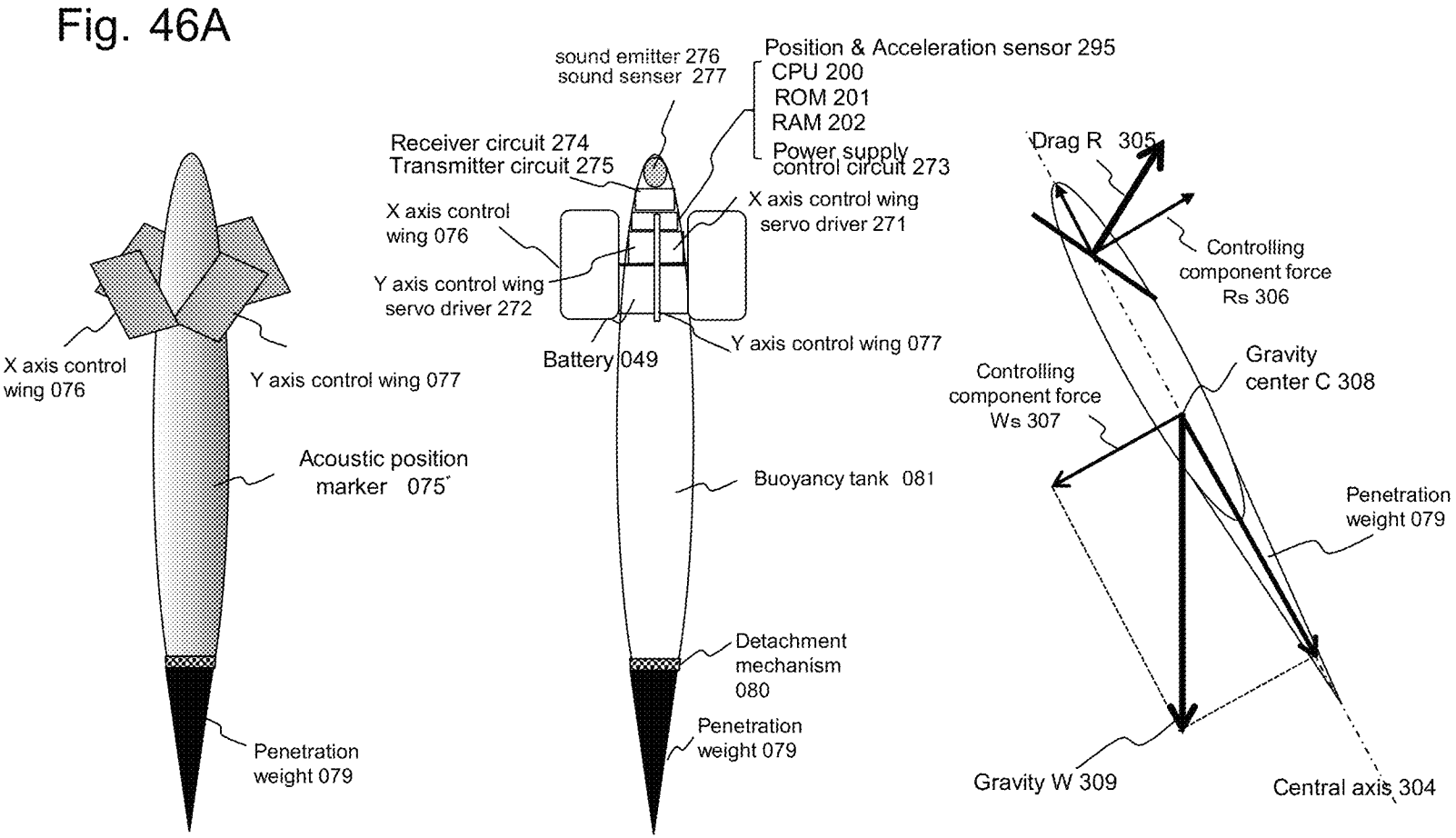
Fig. 46A
X axis control wing 076
Y axis control wing 077
Acoustic position marker 075'
Penetration weight 079
Fig. 46B
sound emitter 276
sound senser 277
Receiver circuit 274
Transmitter circuit 275
Position & Acceleration sensor 295
CPU 200
ROM 201
RAM 202
Power supply control circuit 273
X axis control wing servo driver 271
X axis control wing 076
Y axis control wing servo driver 272
Y axis control wing 077
Battery 049
Buoyancy tank 081
Detachment mechanism 080
Penetration weight 079
Fig. 46C
Drag R 305
Controlling component force Rs 306
Gravity center C 308
Penetration weight 079
Central axis 304
Controlling component force Ws 307
Gravity W 309

SEABED RESOURCE LIFTING APPARATUS

CROSS REFERENCE TO RELATED APPLICATION

This application is a U.S. continuation application filed under 35 USC 112(a) claiming benefit under 35USC 120 and 365(c) of PCT application JP2019/029712, filed on 29 Jul. 2019, which claims priority to Japanese Patent Application No. 2018-143015, filed on Jun. 30, 2018, the entire contents of which are incorporated herein reference.

FOREIGN PATENT DOCUMENTS

WO2013118876A1 "Collection method and collection system of seabed hydrothermal mineral resources"

Japanese Unexamined Patent Application Publication No. 2011-196047 "Delivery system and method"

Japanese Patent Application Laid-Open No. 2017-066850 International Application PCT/JP2016/0836 "Pile resource harvesting device"

OTHER PUBLICATIONS

SALVAGE, Nobuo Shimizu, Journal of the Shipbuilding Society of Japan, May 2002

"Evaluation of slurry transfer of large-sized particles in lift pipes related to the development of seabed mineral resources" Takano et al. 14th Maritime Research Institute of Technology Research Presentation, June 2014

"Ocean energy and mineral resource development plan" Ministry of Economy, Trade and Industry December 2013

"Latest trends in the development of the latest seabed mineral resources" Yoichi Oda, Mitsui & Co., Ltd. Strategic Research Institute, April 2013

"Development of a seabed hydrothermal deposit drilling element technology testing machine" Mitsubishi Heavy Industries Technical Report 2013 No. 2

Satellite Attitude Tracking By Quaterion-Based Backstepping, Raymond Kristiansen, Norweigian University of Science and Technology. Norway, 2005

"Submarine hydrothermal deposit mining/lifting pilot test" JOGMEC NEWS 2018, March Sound Metrics http://www.soundmetrics.com/

BACKGROUND OF THE INVENTION

1. Field of Invention

The present invention relates to a device for picking up objects from the seabed. In particular, the present invention relates to a system for collecting and collecting mineral ores on the sea floor, and relates to a device for collecting to the sea surface by using the buoyancy of a liquid having a lower specific gravity than water without inputting energy for collection. Exhausting gas from the components of the device balances the pressure inside and outside to avoid the need for pressure resistance in the underwater environment. Furthermore, this device is characterized by the fact that it does not require a structure between the sea surface and the sea floor by autonomously sailing underwater.

2. Description of the Related Art

Attempts to recover objects from the seabed have been made in the field of salvage, dredging, and drilling offshore oilfields. With regard to the collection of seafloor minerals, trials have been started for collecting 1000 m-level seafloor minerals, and recovery of seafloor resources at the 2000 m-5000 m level has not been established because there is no established methodological method or economic prospects. The present invention relates to an apparatus for economically recovering seabed resources up to a level of 6500 m, and provides state-of-the-art technologies for control engineering, space engineering, information engineering, and acousto-optics, which are other fields not conventionally used in ocean development. By combining them, it was newly devised to realize with existing hardware technology without mechanical challenge under high pressure environment.

The conventional technique will be described below. The collection of seabed minerals has been conventionally discussed as an extension of salvage technology, dredging technology and offshore oil drilling technology. As for the salvage technique, as outlined in "SALVAGE, Nobuo Shimizu", there are a "major rotation system" in which a wire is pulled up, a "balloon system" utilizing buoyancy, and a "grab system" in which the wire is directly grasped.

"Large turning method" is not performed in the deep sea because it involves diving work with wires. In the "balloon system", metal or rubber balloons containing compressed air are used to pull up in the sea, but horizontal movement is the main cause because of gas expansion accompanying changes in depth, and the depth is 100 m or less. The "grab method" is a method of directly grasping the arm by extending it to the seabed. In the 1970s, the US CIA raised the Soviet sunken submarine from the bottom of the sea for the purpose of gathering nuclear strategic information. It is the only record that has been pulled up from the deep sea, and there are no examples. According to publicly available information, raising the sinking submarine in the Soviet Union is likely to be an extension of offshore oil drilling technology. The both methods are not suitable for collecting seafloor mineral resources from the deep sea because the quietness of the sea surface is indispensable because the work ships on the water are directly involved dynamically.

At present, mineral ores extraction from the seabed is not economically feasible, and it is best to take samples by deep sea exploration boats, unmanned robot arms, or boring. Exceptionally, in oil fields and gas fields, if you make a hole, it will be ejected by being pushed out by the internal pressure, so by installing a recovery facility such as a pipe at the opening, you can mine at a relatively low cost. A method of pumping up hot water in which mineral resources are melted from a seabed hot water pool has been proposed (Patent Document 1). This method can also be carried out by pouring a special solvent into the ore deposit as in the case of shale gas mining, vacuuming the dissolved minerals onto the water, and then separating and collecting the minerals.

As a method of recovering mineral resources from the seabed surface strata, as an extension of dredging technology, a test development of elemental technology for excavating a 1000 m deep seabed hydrothermal deposit (such as chimney), making it into slurry and sending it to the sea by an underwater pump, which is disclosed by JP 2011-196047 "Delivery system and method", and "Development of a seabed hydrothermal deposit drilling element technology testing machine" Mitsubishi Heavy Industries. A pilot project for mining and recovering hydrothermal deposits with a seabed of 1600 m was implemented in 2017, and 16 tons were recovered in 1.5 months, but no commercial prospects have been established. ("Submarine hydrothermal deposit mining/lifting pilot test")

Mining and collecting of seabed mineral ores is the stage when the trial development of elemental technology for the submarine hydrothermal deposit at a depth of 1600 m has finally begun. Cobalt-rich crusts, manganese nodules, and rare earth deposits are distributed on the surface of the deep sea deeper than 1000 m, but they are still in the stage of resource survey, and resource recovery, including methodologies, has not been started. ("Ocean energy and mineral resource development plan")

Similar to the present invention, there is PCT/JP2016/0836 of the same applicant as the present invention as a technique for collecting an object from the seabed without challenging the mechanical limit in a high-pressure environment. In PCT/JP2016/0836, by using the buoyancy of hydrogen gas generated on the seabed, the internal pressure of the lifting equipment and the surrounding seawater pressure are made the same to solve mechanical and structural problems such as pressure resistance technology under high pressure environment, and buoyancy is used. Furthermore, since hydrogen gas generated on the seabed becomes an excess during the collection process, it was absorbed by toluene and recovered as MCH (methylcyclohexane), and it was used as a hydrogen energy source to solve the problem of recovery energy efficiency.

Cobalt-rich crust, manganese nodules, and rare earth deposits are deposited on the sea floor, and if they are above ground, they can be collected by power shovels or bulldozers. Mining trials of hydrothermal deposits are preceded mainly by the fact that hydrothermal deposits are relatively shallow inside and outside the depth of 1000 m, and the depth is an obstacle to the development of seabed mineral resources deeper than 1000 m, and the conventional salvage technology and dredging technology. Extension of offshore oil drilling technology has not solved it.

In the world of living things, sperm whales do not use any special pressure resistance technology in living organisms, use almost no energy, dive up to 3000 m and prey on squid and return to the sea surface. The reason why sperm whales can easily go back and forth between the deep sea floor and the sea surface without obstructing the depth is that the internal and external pressures of liquid and solid are equalized in vivo to avoid structural problems in high pressure environment. Second, since it can move independently of objects on the sea floor or on the sea and is autonomous both structurally and as a moving body, there are few restrictions as a structure. Thirdly, whales move up and down using buoyancy to move up and down in a liquid such as underwater by adjusting the buoyancy using the change in the specific gravity of "brain oil" depending on the temperature and using almost no energy. It shows that it is the most energy efficient means.

However, in view of the above problems, there is no other way than the following two ways to collect mineral ores by obtaining buoyancy that counteracts the underwater weight of the mineral ores on the seabed.

The first is a method of generating buoyancy from nothing in water, and the method of PCT/JP2016/0836 by the same inventor as this patent has been addressed from this viewpoint. The most efficient method in the seabed under the high pressure environment is the generation of hydrogen with the minimum molecular weight by electrolysis of water. This method can efficiently bring in pure water from the source to the seabed, transmit power to the seabed, and recover surplus hydrogen in the floating process. Hydrogen gas is generated on the seabed and used as a buoyancy source for the collection of seabed resources. Toluene absorbs surplus hydrogen gas as it floats, becomes MCH, and is recovered and reused as a hydrogen energy source.

However, in this method, the following (a) to (d) are indispensable. (a) Electric power for generating hydrogen gas by electrolysis on the seabed, (b) Electrolysis device on the seabed, (c) Organic hydride reactor for hydrogen absorption during the floating process, (d) Recovery process Hydrogen reaction controller.

The second is the method of the present invention. That is, buoyancy is canceled from the surface of the sea in the form of "buoyancy"+"ballast" to bring a buoyancy source to the seabed, and "ballast" is separated to generate buoyancy that does not exist until then.

Since ballast is a solid or liquid with a high specific gravity, it is not affected by water pressure during the process of bringing it from the sea surface to the sea floor, and its specific gravity is also constant. If the buoyancy source is liquid, it will not be affected by water pressure on the seabed. The most suitable substances as buoyancy sources are n-pentane (boiling point 36.1° C. specific gravity 0.626), which is liquid at room temperature and has the lowest specific gravity, or gasoline (specific gravity 0.70), which is inexpensive in cost.

In the method of the present invention, the hydrogen-related equipment of items (a) to (d) required in the first method can be omitted. This has the advantage of reducing costs and is easy to handle as the buoyancy source of the liquid may be kept sealed from beginning to end. On the other hand, it is necessary to solve the following two points, which is the subject of the present invention.

(1) At the seabed, it is necessary to separate the ballast from the buoyancy source brought in with the ballast, and to switch the ballast and the mineral ores to be collected by remote control to the buoyancy source generating large buoyancy.

(2) In order to commercially collect offshore resources, the process must be continuously repeated. If gas is brought from the sea surface to the bottom of the sea as a buoyancy source, it is necessary to use a pressure-resistant shell, and it is clear that efficiency and cost do not match this method, if it is calculated. Blowing high-pressure air from the sea surface with a pipe can be said to be this modification.

BRIEF SUMMARY OF THE INVENTION

First, in order to fundamentally avoid the obstacles of the high pressure environment, the gas is excluded from the components, the inner and outer pressures are made equal, and the pressure resistant equipment is eliminated, thereby avoiding the pressure resistance requirement. For this reason, a liquid having a lighter specific gravity than water at room temperature (for example, n-pentane or gasoline) is used as a buoyancy source for collection. To reach the source of buoyancy to the bottom of the sea, sink it with ballast to counteract the buoyancy and replace the ballast with the recovered mineral ores at the seabed. The method of the present invention facilitates scale-up of the apparatus because there is no mechanically high stress point.

Second, the buoyancy-based collection method does not require a high-lift pump, as compared with a method in which seabed mineral ores are slurried in the sea and pumped to the surface of the sea. The movable mechanism, the high-pressure pipe, the friction mechanism, and the pressure-resistant mechanism with a large pressure difference are eliminated, and the problems of abrasion and sealing of the transportation pipe due to slurry transportation do not occur. Further, according to the method of the present invention, since the object to be recovered is lifted from the seabed as it is, there is no restriction on the size and shape and physical properties of the recovered object. Since there is little information on seabed resources, visibility is poor on the seabed, and the means for collecting information is limited. It is possible to avoid energy input and seawater pollution due to ore crushing and slurry formation. There is a great advantage to remove the ore processing on the sea floor, such as making it into a slurry, and to collect the raw ore as it is. In addition, high pressure pumping of minerals from the seabed was avoided to avoid energy waste.

Thirdly, the underwater weight of the component equipment is reduced so that all equipment could float on the sea surface by buoyancy as part of regular operation. As the result, maintenance and inspection of all equipment becomes easy. Furthermore, since it is possible to ascend and descend by autonomous navigation, there is no mechanical connection between undersea and seabed structures such as lifting pipes and surface vessels, and it is possible to ease the marine conditions and the position control conditions of surface command ships The cost of surface command ships will be reduced. At the same time, this facilitates the movement of equipment installed on the seabed, which makes it possible to realize maneuverability suitable for collecting thin and wide-spread ore/minerals on the seabed.

Fourth, while increasing the moving speed by means of changing the difference in buoyancy to improve the facility utilization rate, the resistance blades are deployed to reduce the terminal speed by using the resistance of water, thereby it is possible to land on the seabed and return to a surface command ship safely.

However, the first to fourth means described above can be means for solving the problem only when they can be concretely realized in the real world. The method of ensuring realization is described below. The deep-sea crane 001 is with one or more ball-shaped buoyancy tanks 002 with a liquid whose specific gravity is lighter than water, loads ballast in the cargo compartment, and descends from the surface command ship 010 to the sea floor. On the seabed, the ballast and the collected seabed mineral ores are exchanged, and the deep sea crane 001 floats above to the sea surface.

(1) Guaranteeing Feasibility by Weight Reduction

In order to utilize the buoyancy, it is necessary to make the specific gravity of the total device around 1.0, and it is essential to reduce the weight of the entire device. Therefore, a lightweight and tough material including a tough carbon fiber resin having a specific gravity of about 1.8 is used as the structural material. In particular, when realizing a deep-sea crane that collects seabed mineral ores, it is important in terms of economy to increase the ratio of ballast, which is equivalent to the collected seabed mineral ore, to the total weight of the deep sea crane while maintaining the total weight of the deep sea crane when traveling back and forth between the sea floor and the sea surface at around 1.0. Here, the specific gravity of around 1.0 means that it is possible to softly land on the sea floor by free fall by means of its own weight.

The weight reduction of the deep-sea crane 001 is an important requirement that determines the success or failure of the realization, so it will be examined below.

(A) When Ascending

As a trial calculation example, the specifications of a typical deep-sea crane (unit: mm) that recovers about 10 tons of seabed mineral ores in one time from 1,000 to 6.500 in in depth, is shown in FIG. 1A.

The liquid to be filled is gasoline (specific gravity 0.70) as a buoyancy source, the capacity of the buoyancy tank 002 of radius 2 m is 33.51 m3, and when carbon fiber resin of 5 mm thick is is used, the volume of the float tank shell is 0.251 m3, and when the typical specific gravity of 1.8 used, then its underwater weight becomes 0.20 tons.

$$\text{Volume } V=2.0\times2.0\times2.0\times\pi\times4/3=33.51 \text{ m3}$$

$$\text{Buoyancy}=33.51\times0.30=10.05 \text{ tons}$$

$$\text{Surface area } S=4\times2.0\times2.0\times\pi=50.26 \text{ m2}$$

$$\text{Underwater weight } W=50.26\times0.005\times0.8=0.20 \text{ tons}$$

The maximum shear stress applied to the outer shell is 10.05/2 tons of buoyancy, which is applied to the outer shell of the center of the sphere in the vertical direction while climbing and descending. The cross-sectional area of the outer wall columnar portion is 314.2 cm2 when the wall thickness is 5 mm, and the typical shear stress of carbon fiber resin is 150 kgf/mm2 and the compressive fracture stress is 100 kgf/mm2. It is 30 times stronger than the load. As described above, it can be said that the present invention is sufficiently feasible with the current technology.

(B) When Descending

Since the buoyancy tank is filled with 33.51 m3 of gasoline when descending, if the equipment weight of the deep sea crane is 33.51 tons together with the ballast in the cargo compartment 005, its overall specific gravity will be 1.0. By adding a small amount of weight and setting the specific gravity to 1.0+α, it is possible to gently descend toward the sea floor, and it is possible to softly land on the sea floor. (FIG. 2) Since the buoyancy tank is estimated to be 0.2 tons, if the cargo compartment and additional equipment are up to 0.5 tons, the ballast is 9.35 tons and 9.3 tons of ore can be loaded on the seabed. Since the deep sea crane 002 has no physical restrictions, it can take seabed mineral ores freely. As shown in FIG. 3B, if a buoyancy tank with a diameter of 9.0 n is used, 100 tons of seabed mineral ores can be collected.

(2) Realization of Commercial Operation

The system according to the present invention is a system that continuously collects seabed mineral ores, therefore such an operation must be specifically realized.

An operation form in accordance with this purpose is shown in FIG. 4.

The deep-sea crane 001 plays the role of a crane that uses the buoyancy of gasoline to collect seabed mineral ores from the seabed 009. In addition to the deep-sea crane 001, a function to collect seabed mineral ores and load them into the deep-sea crane 001 is necessary. For this purpose, the seabed mineral ores collecting device (electric seabed power shovel) 015 is installed on the seabed.

Submarine resources are widely present on the seabed at a depth of 1000 m to 6500 m. The seafloor hydrothermal deposits are rock masses, and the manganese nodules are scattered like gravel on the seabed. Cobalt-rich crust is deposited as thin pillow lava on the sea floor, and rare earth mud is deposited for several to 10 m at a depth of several meters on the sea floor.

On the ground, these seabed mineral ores can be collected with a power shovel. On the seabed, since there is no means for loading seabed mineral ores into the deep sea crane 001, a seabed mineral ores collecting device (electric seabed power shovel) 015 is used for loading them.

As visibility is generally not guaranteed on the seabed, an ultrasonic high-definition video camera is used as a countermeasure, which is mounted on the seabed power shovel 015 and operated by remote control from the surface command ship 010. At the time of filing of the present invention, what has been put to practical use commercially is a visibility of 35 to 80 in, a field of view of 29°, a beam number of 96 (resolution), and 20 frames/sec. (Sound Metrics http://www.soundmetrics.com/)

FIG. 29A is an example of an electric seabed power shovel. The power shovel is driven by a hydraulic mechanism, but since the drive mechanism operates by a differential pressure, which does not depend on the surrounding pressure environment in principle. It can be operated even in a high-pressure environment on the seabed if the electro-hydraulic mechanism and the moving mechanism are motor-driven. Power supply and remote control are performed from the surface command 010.

The ultrasonic high-definition video camera 050 is installed on the remote control platform 265 which is operated by remote control from the surface command ship 010, and a view in any direction can be obtained from the surface command ship 010. A capture ring 037 is provided above the center of gravity of the electric seabed power shovel 015 and is used for its recovery operation from the seabed.

In FIG. 2, the deep-sea crane 001 that has left the seabed rises toward the surface command ship 010 on the levitation path 046 and arrives at the sea surface 032. The surface command ship 010 recovers the collected seabed mineral ores 018 from the deep sea crane 001. After the collection, the ballast is loaded in the cargo compartment 005 and the ballast is dropped to the seabed through the sinking route 044.

The surface command ship 010 carries the ballast from the departure port, collects the seabed mineral ores 018 at the mine point sea, returns to the port of departure, and repeats this round trip.

The surface command ship 010 is a base ship that serves as a core for collecting mineral ores on the sea floor. It occupies the upper part of the seabed where seabed mineral ores are collected, and directs their collection, maintenance of equipment, and supply of power. The surface command ship 010 carries a plurality of deep-sea cranes 001 and a seabed power shovel 015, advances to a mineral ore collection point, and expands in the sea and on the surface of the sea. The surface command ship 010 controls the operation of all relevant equipment and is equipped with a system for that purpose.

The surface command ship 010 can change its position depending on the resource status of the seabed. Since the deep sea crane 001 can have a specific gravity of around 1.0, it can be deployed at a new location after being first levitated to the sea surface and collected.

According to the present invention, since the mineral ores are collected from the seabed by buoyancy, the energy consumption is small, and the equipment that reciprocates on the seabed does not contain gas, so that the mechanical effect due to the seabed depth is small, and the range from less than 1000 m to more than 5000 m is wide. Applicable to further, since there is no structurally restricted portion for strength, scale-up is easy. Furthermore, since the collected seabed mineral ores are not pulverized, it does not cause pollution in the sea.

BRIEF EXPLANATION OF DRAWINGS

FIG. 17A is an overview of allocating sensors on a deep-sea crane.

FIG. 17B is a diagram showing an acoustic propagation from a seabed transponder to a deep-sea crane.

FIG. 17C is a diagram showing an acoustic propagation from a surface transponder to a deep-sea crane.

FIG. 18A is an 3D view of a principle of acoustic navigation.

FIG. 18B is an horizontal view of a principle of acoustic navigation.

FIG. 18C is a vertical view of a principle of acoustic navigation.

FIG. 21D is a diagram showing processing flow of an optical distance measurement

FIG. 31D is an overview of a deep sea crane w/ three buoyancy tanks bundled together.

FIG. 31E is an overview of a deep sea crane bundling mechanism w/ three buoyancy tanks bundled together.

FIG. 31F is a top view of a deep-sea crane w/three divided tanks bundled together.

FIG. 34A is a diagram showing a cargo handling procedure (a) of a deep-sea crane w/ three tanks.

FIG. 34B is a diagram showing a cargo handling procedure (b) of a deep-sea crane w/ three tanks.

FIG. 34C is a diagram showing a cargo handling procedure (c) of a deep-sea crane w/ three tanks.

FIG. 34D is a diagram showing a cargo handling procedure (d) of a deep-sea crane w/ three tanks.

FIG. 34E is a diagram showing a cargo handling procedure (e) of a deep-sea crane w/ three tanks.

FIG. 34F is a diagram showing a cargo handling procedure (f) of a deep-sea crane w/ bundled three tanks.

FIG. 34G is a diagram showing a cargo handling procedure (g) of a deep-sea crane w/ bundled three tanks.

FIG. 34H is a diagram showing a cargo handling procedure (h) of a deep-sea crane w/ bundled three tanks.

FIG. 34I is a diagram showing a cargo handling procedure (i) of a deep-sea crane w/ bundled three tanks.

FIG. 41A is a diagram showing a processing flow of an acoustically guided acoustic position marker installation system.

FIG. 41B is a diagram showing a processing flow of an acoustically guided acoustic position marker installation system.

FIG. 41C is a diagram showing a processing flow of an acoustically guided acoustic position marker installation system.

FIG. 41D is a diagram showing a processing flow of an acoustically guided acoustic position marker installation system.

FIG. 41E is a diagram showing a processing flow of an acoustically guided acoustic position marker installation system.

FIG. 41F is a diagram showing a processing flow of an acoustically guided acoustic position marker installation system.

FIG. 41G is a diagram showing a processing flow of an acoustically guided acoustic position marker installation system.

FIG. 41H is a diagram showing a processing flow of an acoustically guided acoustic position marker installation system.

FIG. 43A is a diagram showing a capture operation diagram of a seabed mineral ores collecting device (electric power shovel).

FIG. 43B is an overview showing an optical precise control operation to capture seabed mineral ores collecting device.

FIG. 44A is a top view drawing of attachment for precision control.

FIG. 44B is an overview of of an attachment for precision control.

FIG. 44C is a diagram showing force vectors for precision control.

FIG. 44D is a diagram showing a rendezvous mechanism.

FIG. 44E is a diagram showing an rendezvous target.

FIG. 45A is an overview of an inertially guided acoustic position marker.

FIG. 45B is a diagram showing installation of inertially guided acoustic position markers/settled suspension.

FIG. 45C is a diagram showing installation of inertially guided acoustic position markers/inertial guidance.

FIG. 45D is a diagram showing installation of inertially guided acoustic position markers/undersea landing.

FIG. 46A is an overview of an inertially guided acoustic position marker.

FIG. 46B is a diagram showing structure of an inertially guided acoustic position marker.

FIG. 46C is a diagram showing operating forces of an inertially guided acoustic position marker.

FIG. 47A is a diagram showing the configuration of an inertially guided acoustic position marker control device.

FIG. 47B is a diagram showing the configuration of a position marker ship control system.

FIG. 47C is a diagram showing control wings of inertially guided acoustic position marker control device FIG. 48A is a processing flow diagram of the inertially guided acoustic position marker control device/Initialization.

FIG. 48B is a processing flow diagram of the inertially guided acoustic position marker control device/guidance.

Figure 49A:
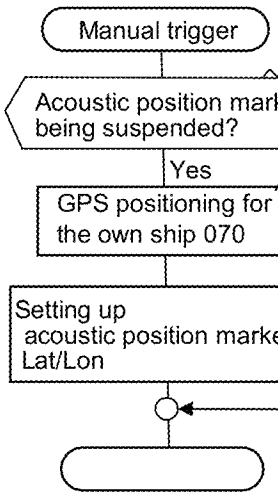

FIG. 49A is a processing flow diagram (a1) of a position marker ship control device for inertially guided acoustic position markers.

Figure 49B:
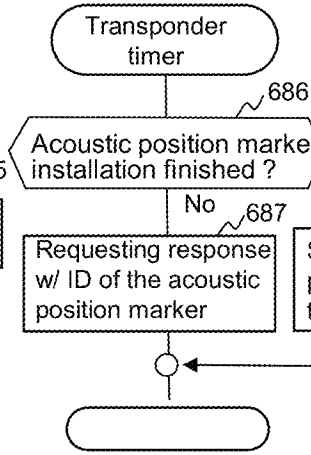

FIG. 49B is a processing flow diagram (a2) of a position marker ship control device for inertially guided acoustic position markers.

Figure 49C:
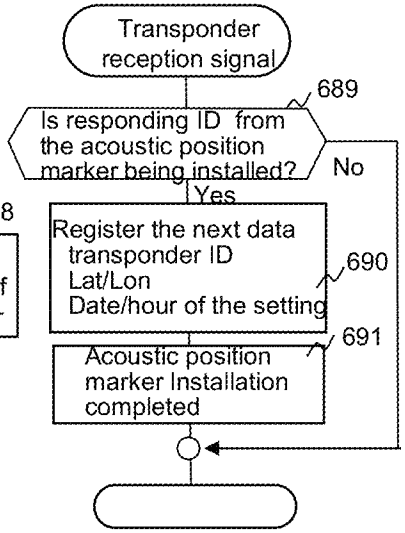

FIG. 49C is a processing flow diagram (a3) of a position marker ship control device for inertially guided acoustic position markers.

DETAILED DESCRIPTION OF THE INVENTION

Hereinafter, modes for carrying out the present invention will be described in detail with reference to the drawings. The present invention is not limited to the following description, and various modifications can be made without departing from the scope of the invention. In this document, a device that repeatedly collects seabed mineral ores by going back and forth between the deep sea floor and the surface of the sea is referred to as a "deep sea crane", and the entire system including peripheral support devices is called a "seabed resource collection system" ((FIG. 2 Overall view of the seabed mineral ores collection system). The deep-sea crane adopts all of the following three points that should be learned from sperm whales.

(1) Balancing internal and external pressure (2) Utilising buoyancy (3) Moving autonomously (autonomous navigation)

The collection of the present invention is carried out by operating the buoyancy of a liquid having a low specific gravity which is liquid at mom temperature in combination with the gravity of a ballast. It is a system that exchanges ballast transported from land over the sea surface with almost equal weight of seabed mineral ores on the seabed, and is characterized by not inputting energy itself. Also, since the buoyancy source is sealed, it is not possible to newly generate a buoyancy source due to the method.

(1) Specific Gravity Control a. It is possible to reduce the specific gravity by discarding the mounted ballast and reducing the underwater weight.

b. Specific gravity cannot be increased while ascending or descending.

(2) Terminal Speed Control

When moving in a viscous fluid such as water under the influence of gravity or buoyancy, there is a terminal velocity that becomes constant in balance with the drag force. The specific gravity is set near the seawater specific gravity, but if a is set to be smaller than the seawater specific gravity, it floats at a constant final velocity specified by a and the shape of the deep-sea crane. When the specific gravity of the deep sea crane 001 is larger than the specific gravity of seawater, and the larger part is $\alpha$, the crane descends at a constant final speed defined by a and the shape of the deep sea crane. If $\alpha$ is adjusted and there is a speed reducer, the terminal speed is adjusted by increasing or decreasing the resistance by deploying the speed reducer.

(3) Descent from the Sea Surface and Landing a. When descending, set the specific gravity to seawater specific gravity+$\alpha$. The larger $\alpha$ is, the shorter the descent time is, but the amount of consumed ballast increases, and there is a drawback that the control described in the following item b. becomes difficult, and the optimum value is obtained by adjustment.

b. When the landing approaches, the ballast is discarded and the terminal speed is approached to 0 to softly land.

(4) Ascending from the Sea Floor to the Sea Surface

At the time of ascending, the specific gravity is set to seawater specific gravity minus a to ascend, and the speed is adjusted by the control wing and landing leg 006 to reach the vicinity of the surface command ship 010. In the case of excessive buoyancy such as floating from the sea bottom with an empty load, the deceleration parachute 064 (FIG. 27B) is used.

I Seabed Mineral Ores Collection Equipment Components

1. Deep Sea Crane

Figure 1B:
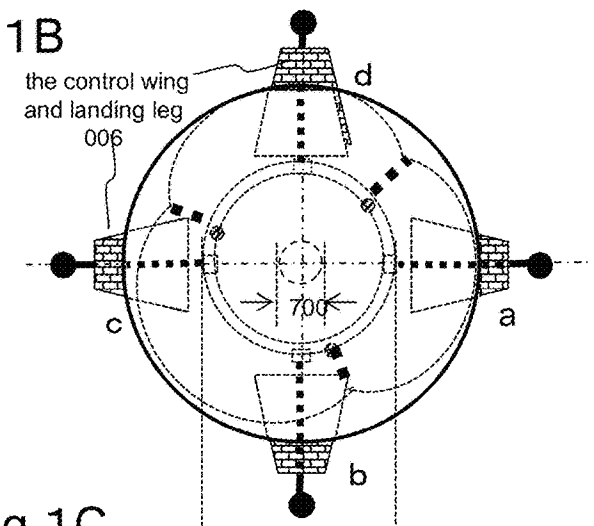
FIG. 1B is a top view of a deep-sea crane.
Figure 1C:
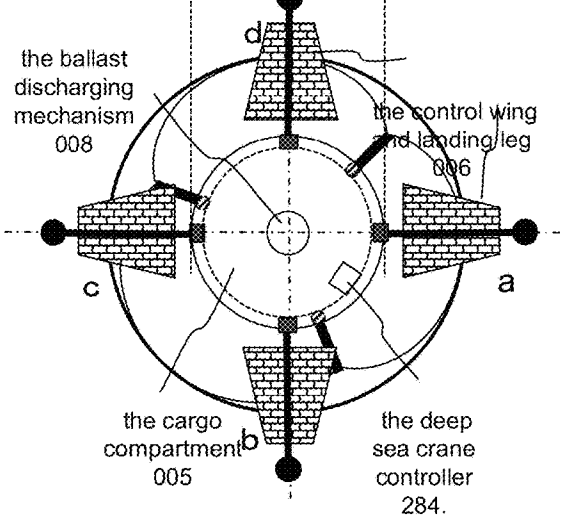
FIG. 1C is a top view of a deep-sea crane.
Figure 1A:
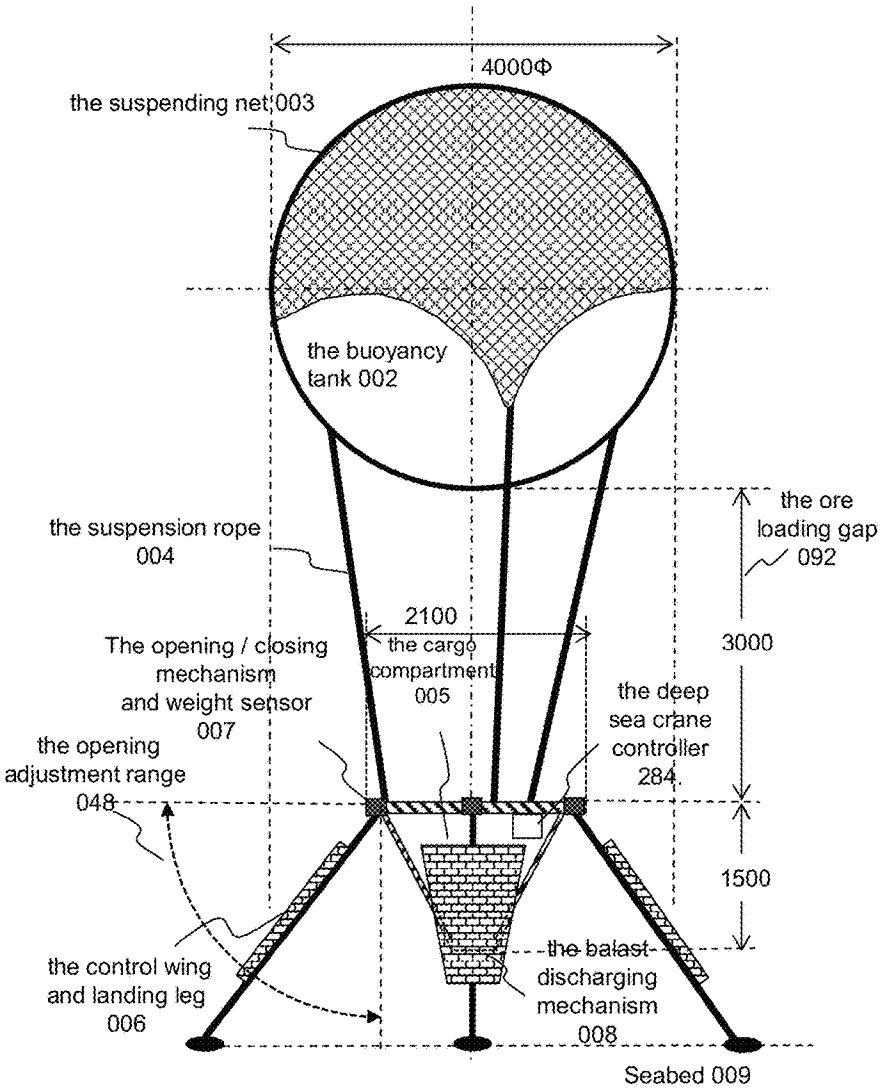
FIG. 1A is a side view of a deep-sea crane.

The deep-sea crane 001 has a structure similar to that of a balloon as shown in FIG. 1A, and an unmanned submersible in which a cargo compartment 005 is suspended by a suspending net 003 and a suspending rope 004 from a spherical buoyancy tank 002 that reciprocates between the sea surface and the seabed to collect the seabed mineral ores. Adopting a spherical buoyancy tank 002 is easy to manufacture, has a large volume with respect to the surface area, is easy to obtain strength compared to other shapes, has simple characteristics as an underwater vehicle, and has simple structural calculations needed.

The deep-sea crane 001 does not need to have pressure resistance because the internal and external pressures are almost the same regardless of the depth in the sea. The buoyancy tank 002 can be made of a lightweight metal such as duralumin or a carbon fiber resin that is lightweight and has high strength. It is sealed filling with a liquid such as n cyclopentane (specific gravity 0.63 at room temperature) or gasoline (specific gravity 0.70 at room temperature). Gasoline has less buoyancy, but has the advantage of lower price.

Figure 23A:
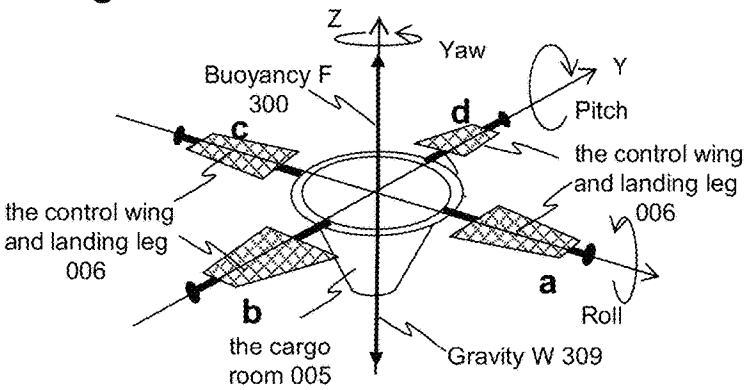
FIG. 23A Is an overview of position/speed control system of a deep-sea crane.

The deep-sea crane 001 travels back and forth between the sea floor and the sea surface by autonomous navigation. When descending from the sea level, ballast is loaded and sinks, and when rising, the seabed mineral ores are loaded instead of ballast. Buoyancy corresponding to the loaded ore at the time of ascent is obtained by dumping ballast on the seabed. Further, controllable wings and landing legs 006 are installed in the cargo compartment 005 to control and decelerate the deep sea crane. In FIG. 1A and FIG. 23A, control wings and landing legs 006*a, b, c, d* are provided, and two each in the positive and negative directions of the X axis and Y symmetrical to the Z axis of the cargo compartment 005 of the deep-sea crane 001. Since the control wing and landing leg 006 is used in an operation in which the weight of the load in the buoyancy tank 002 and the cargo compartment 005 is balanced, the load burdened at the time of landing is small.

The main feature of Deep Sea Crane 001 is to replace the ballast and the collected seabed mineral ores with a lightweight and simple mechanism using gravity. On the seabed, the cargo compartment 005 is landed using the control wing and landing leg 006, and the buoyancy tank floats upward. There is a ore loading gap 092 between the buoyancy tank 002 and the cargo compartment 006. The collected seabed mineral ores are fed from above the cargo compartment to push out the ballast from below and replace the ballast with the collected ore. The amount of ballast dumped is adjusted to keep landing on the seabed and to float up.

Since the deep-sea crane 001 is an autonomous underwater vehicle, guidance control is essential for this purpose, therefore underwater acoustics, image processing, inertial navigation, and control theory are applied. An optical fiber cable is used for control and image signal communication with the surface command ship 010.

Figure 2:
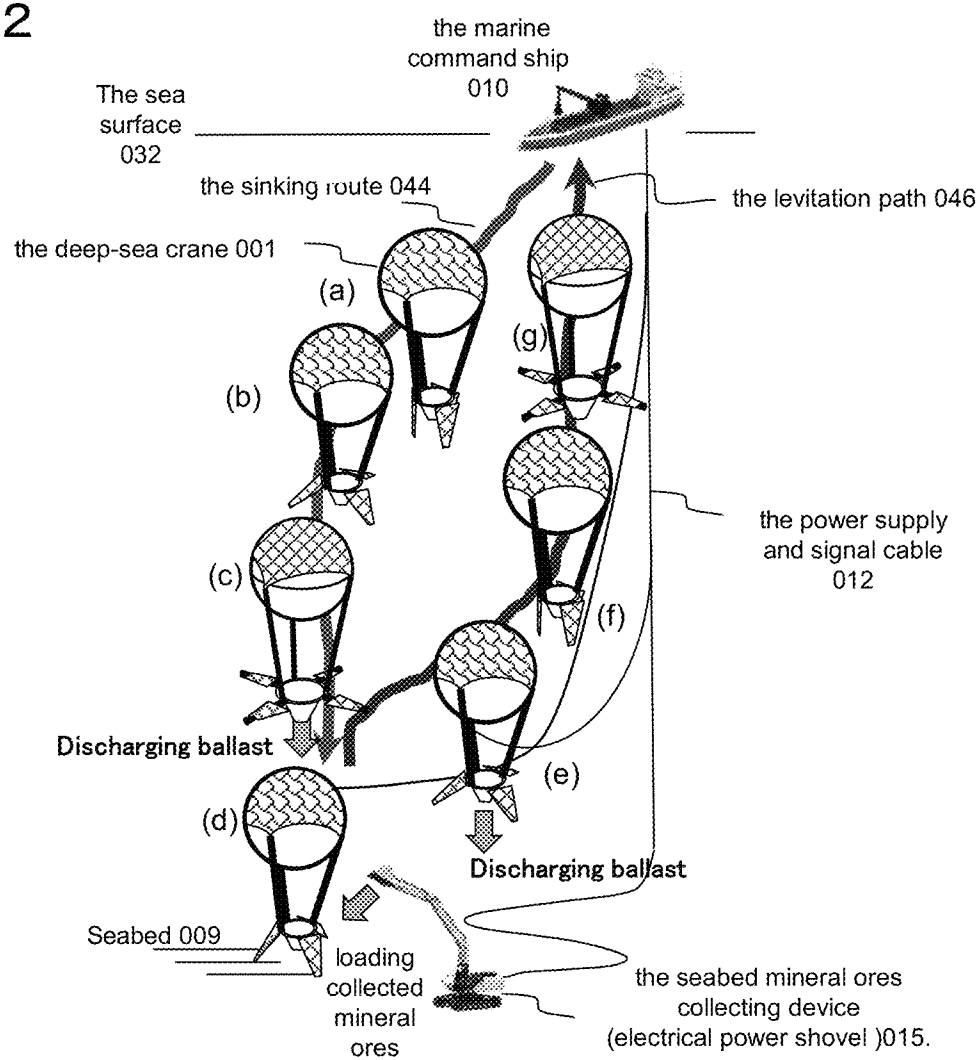
FIG. 2 is an overview of a seabed mineral ores collection system.
Figures 3A, 3B:
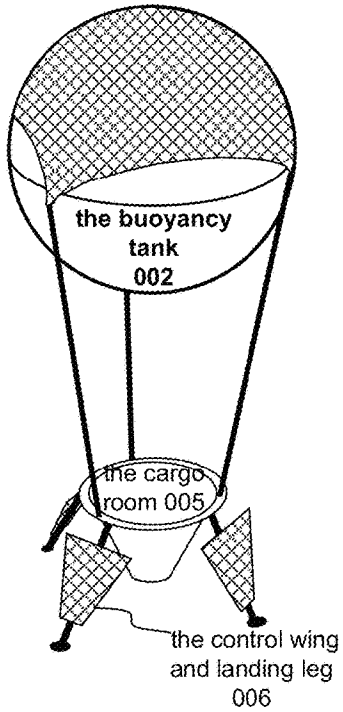
FIG. 3A is an overview of a deep-sea crane.
FIG. 3B is a table showing buoyancy tank volume and buoyancy specifications.

FIG. 17A is a top view of the deep-sea crane 001, in which the sound generator 230 and the acoustic sensors A to D 231-234 are installed for guiding the deep-sea crane 001 to the surface command ship 010 at the time of ascent. FIG. 17A is a bottom view of the cargo compartment 005 of the deep-sea crane 001. A sound generator 230, acoustic sensors A to D 231-234, and an image sensor 235 are installed for the purpose of guiding the deep-sea crane 001 to the landing point 011 when descending. These operation methods and examples will be described in detail in the section "II Navigation system". In FIG. 2, a power supply and signal cable 012 is connected to the deep sea crane 001, and control signals and power are supplied from the surface command ship 010. The signal cable can be made lighter by using optical fiber. It is necessary that the electric device is completely oil-immersed or water-immersed, and the electronic circuit also has pressure resistance by a method including resin encapsulation. The power source may be a rechargeable battery equipped with a deep sea crane 001.

1. 1 Collecting the Seabed Mineral Ores in the Cargo Compartment

The deep sea crane 001 approaches the sea floor with the buoyancy of the buoyancy tank 002 and the weight of the ballast mounted in the cargo compartment 005 slightly larger than the specific gravity of water. The landing speed can be controlled by finely adjusting the amount of ballast dropped from the lower part of the cargo compartment. Setting a fixed value determined by the mechanical strength of the deep-sea crane, about 0.7 m/s. The opening of the control wing and landing leg 006 can be automatically adjusted according to the ups and downs of the seabed.

The descending path and the floating path of the deep-sea crane 001 are controlled by controlling the degree of opening and the rotation angle of the control wing and landing leg 006 of FIG. 23A. The control wing and landing leg 006 has a wing installed to control and brake the water flow. The control to input energy is not performed, and the potential energy at the time of descent or ascent is converted by the control blade to be a control force.

Figure 23B:
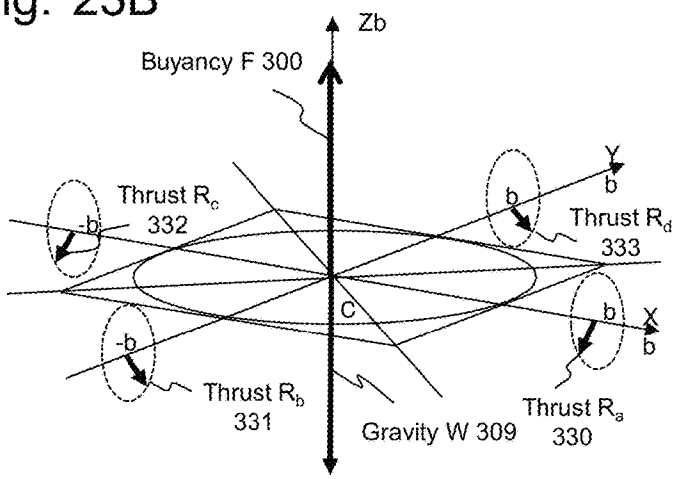
FIG. 23B is a diagram showing control force vectors.
Figure 23C:
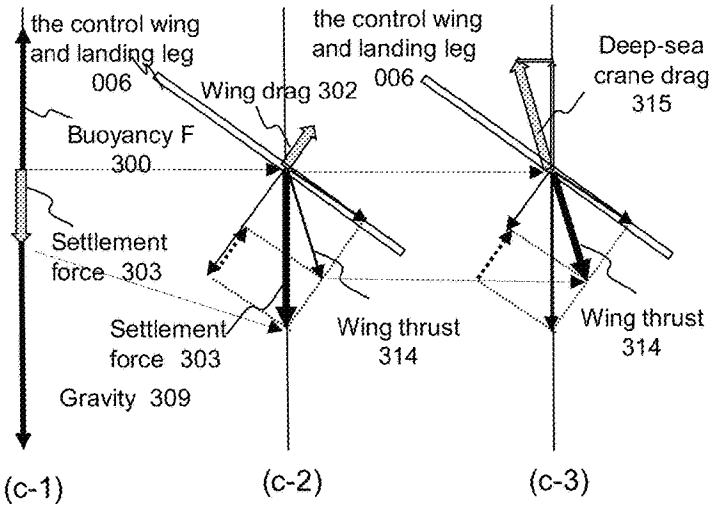
FIG. 23C is a diagram showing generated forces by a wing.
Figure 23D:
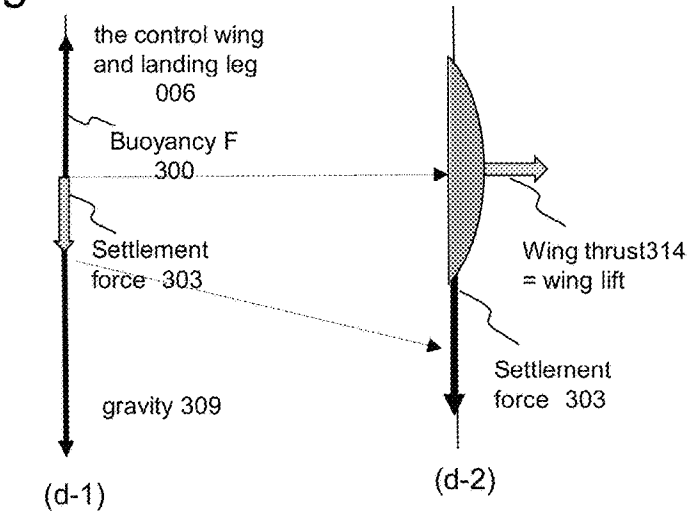
FIG. 23D is a diagram showing generated lift by a wing.
Figure 25A:
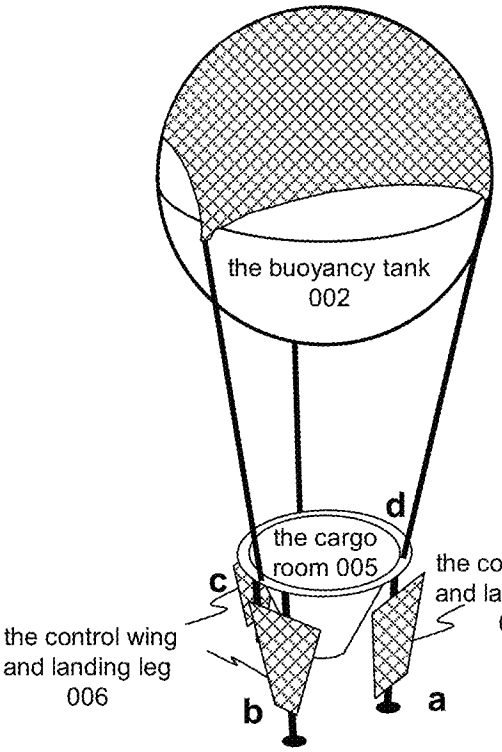
FIG. 25A is a diagram showing no braking operation of a deep-sea crane
Figure 25B:
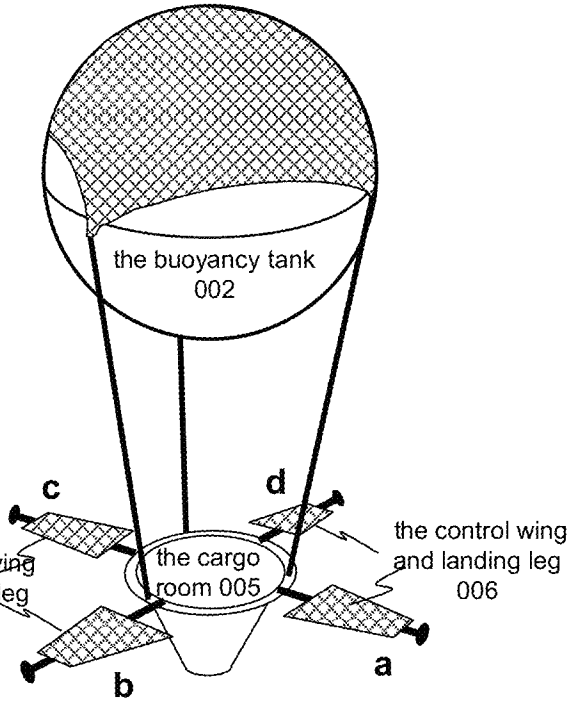
FIG. 25B is a diagram showing full braking operation of a deep-sea crane.
Figure 26A:
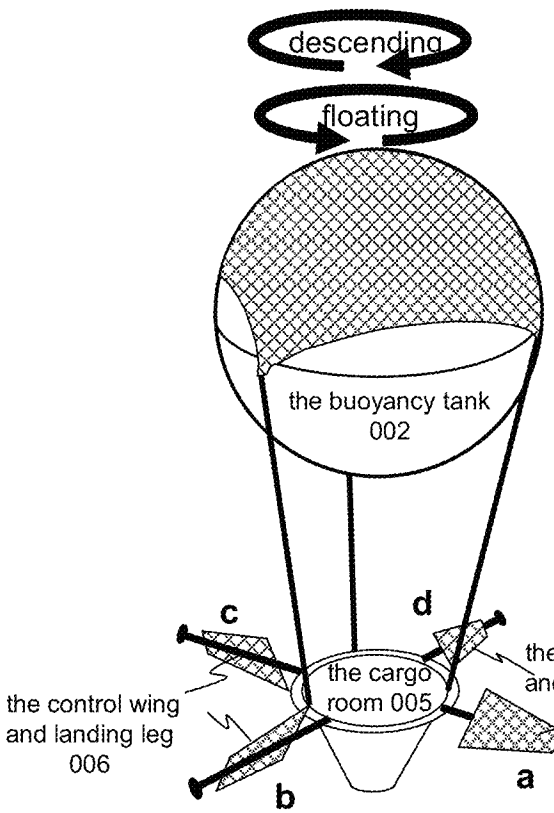
FIG. 26A is a diagram showing rotation operation of a deep-sea crane.
Figure 26B:
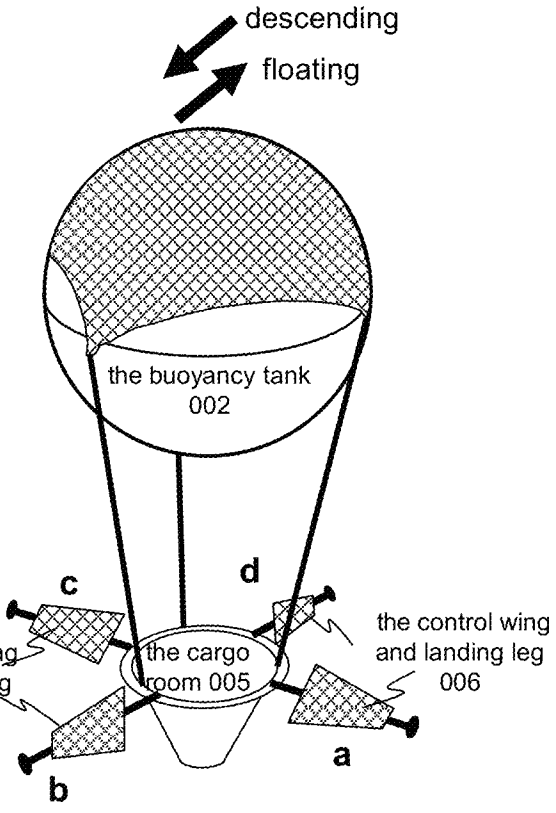
FIG. 26B Is a diagram showing horizontal move operation of a deep-sea crane.
Figure 26C:
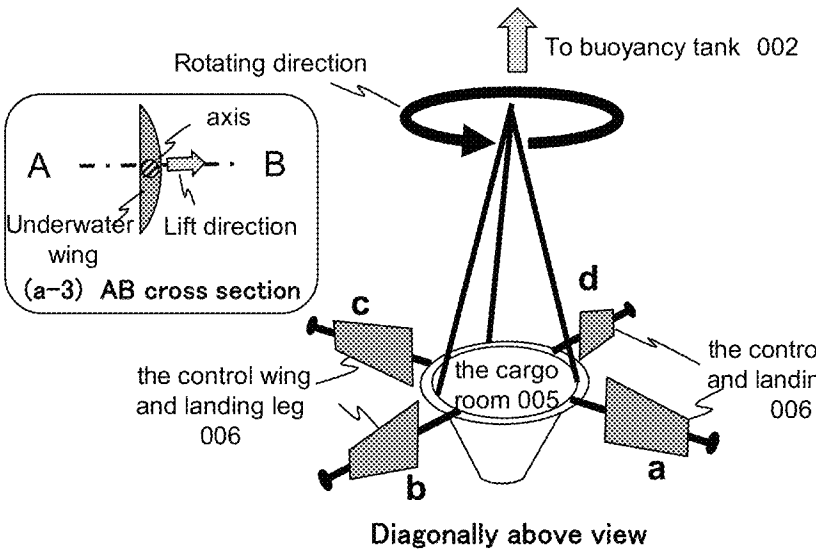
FIG. 26C is a diagram showing rotation operation of a deep-sea crane using lift of wing.
Figure 26D:
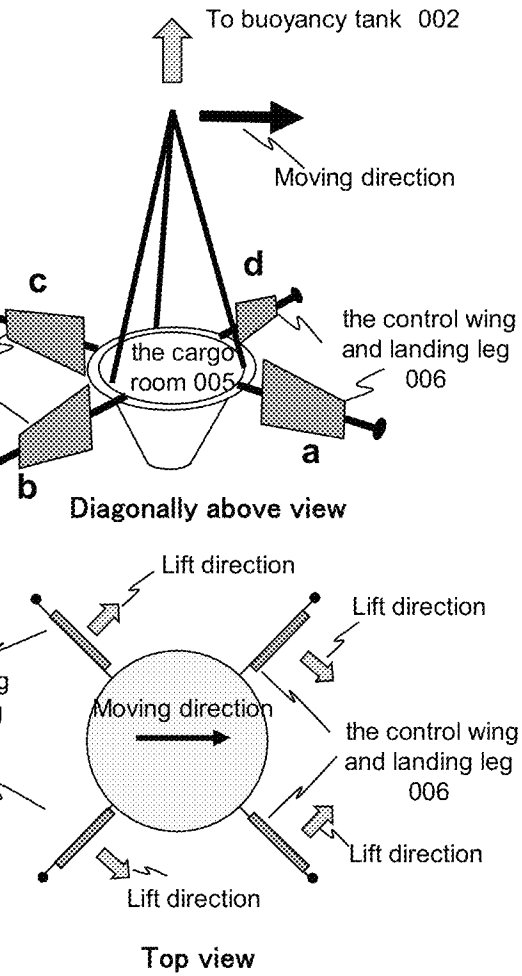
FIG. 26D is a diagram showing horizontal move operation of a deep-sea crane using lift of wing.

FIG. 23C is a diagram showing a mechanism of generation of a control force by the control wing and landing leg 006, and FIG. 23A shows a sinking process in which the gravity vector 309 is larger than the buoyancy vector 300 by the sinking force 303. At this time, if the inclined control wing 006 as shown in FIG. 23B exists, the control blade drag force 302 is generated at a right angle to the control wing 006, and as a result, the wing thrust force 314 is generated. In FIG. 23C, the wing thrust 314 moves diagonally downward, but since the deep-sea crane drag 315 cancels the wing thrust 314 in the opposite direction, it descends at a constant speed in the wing thrust 314 direction. FIG. 23B shows the wing thrust on each control wing and landing leg. For the thrust in the horizontal direction, a lift force vertical to the wing surface may be used. In FIG. 26A, each control blade tilts in the same direction around the axis to rotate the deep-sea crane. The direction of rotation is opposite when descending and when ascending. In FIG. 26B, two opposing control wings are tilted in the same direction on the horizontal coordinate plane. The other two should be vertically oriented so that no control force is generated in the horizontal direction. FIG. 25A shows the case where the degree of open leg is minimized to minimize the braking force, and FIG. 25B is the case where the degree of open leg is maximized to maximize the braking force. In FIG. 1, an opening/closing mechanism of the landing leg and a weight sensor 007 are provided at each root of the control wing/landing leg 006 to set the opening angle of the control wing and landing leg 006 within the opening adjustment range 048. It is controlled by the deep sea crane controller 284. The adjustment of the braking force is performed by the control wing control system 222 based on the decelerator individual control amount calculation 220 of FIG. 14 for the deep sea crane 001.

Figure 4:
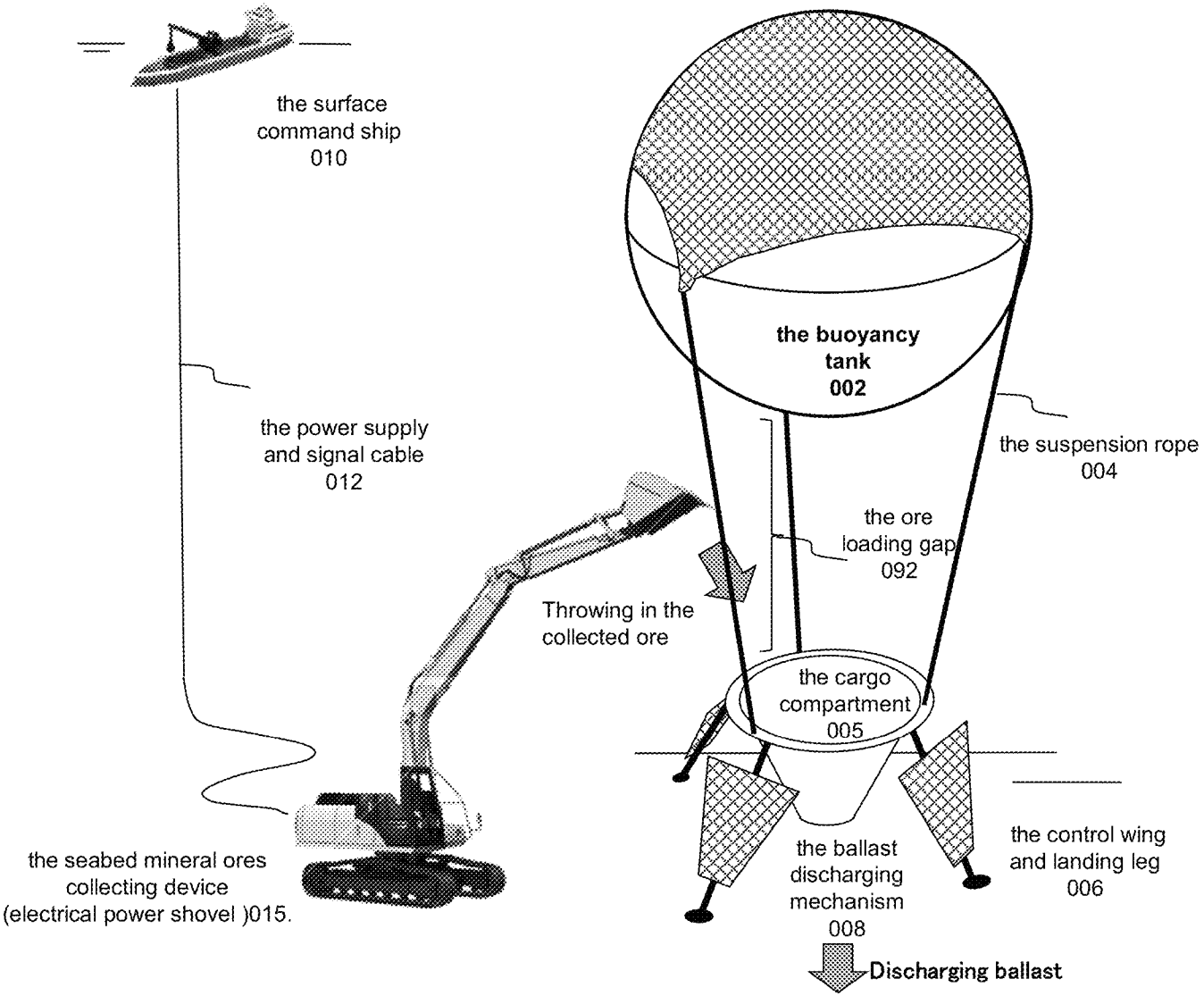
FIG. 4 is a diagram showing ore loading to a deep-sea crane.

FIG. 4 shows the loading operation of the collected seabed mineral ores on the deep sea crane 001. The collected ores are input from above the cargo compartment 005 by an electric power shovel (a seabed mineral ores collecting device), but the input amount is monitored by a weight scale (opening/closing mechanism and weight sensor 007) at the base of the landing leg, and the amount corresponding to the input amount is checked. Discard the ballast from the ballast discharging mechanism. Even if all ballast are dumped, if the specific gravity of the deep-sea crane becomes larger than seawater, it will not be able to ascend. Therefore, the residual ballast amount is constantly monitored by an algorithm from the change in the weighing value at the base of the control and landing wings. The collection of ore is stopped and the surface is raised.

(1) Structure and Operation of Cargo Compartment

The cargo compartment 005 has the following policies.

First, in order to exchange the ores to be collected with the ballast on the sea floor by utilizing the gravity, the structure of the cargo compartment 005 carrying the ballast and the collected ores is determined. The cargo compartment 005 uses gravity to abandon the ballast, has an open shape for loading the collected ore, and has a discharge port that can be opened and closed at the lower end. A suitable shape for this purpose is a truncated cone that opens upwards. The collected ore is loaded from above and the ballast can be discharged from the discharge port at the bottom. For the ballast, fine sand is used to ensure fluidity. Secondly, in order to avoid mixing with the ballast and the collected ore, a partition wall that covers the upper part of the cargo compartment 005 is provided. The structure will move to the discharge port at the lower end while occupying the boundary with the ballast as it is charged. The partition wall may be a bellows type and extends downward, or may be a membrane type.

Third, when exchanging the ballast with the collected ore, the amount of dumped ballast is controlled so that the generated buoyancy is less than the total weight of the deep sea crane (the total weight of the ballast, the collected ore, and the collected equipment). For this purpose, a sensor that measures the total water weight of the deep-sea crane is installed, and the amount of ballast dumped is predicted and controlled by a computer. When loading of recovered ore is completed and levitation is started, the total weight of the deep sea crane should be smaller than that of water. Fourth, it is necessary to secure the liquidity of the ballast. This is because it is necessary, to accurately control the total weight of the deep sea crane according to the loaded ore to be loaded, and the fluidity of the ballast is essential to control the ballast discharge port and the ballast discharge amount accurately. For this purpose, the structure is such that the particle size of the ballast is made fine and at the same time the water stream is jetted in order to increase the fluidity.

Figure 5D:
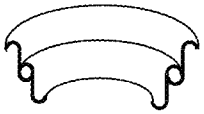
FIG. 5D is a cross section diagram of a partition mechanism.
Figure 5E:
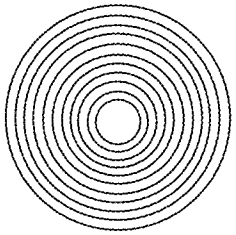
FIG. 5E is a top view diagram of a partition mechanism.
Figure 5A:
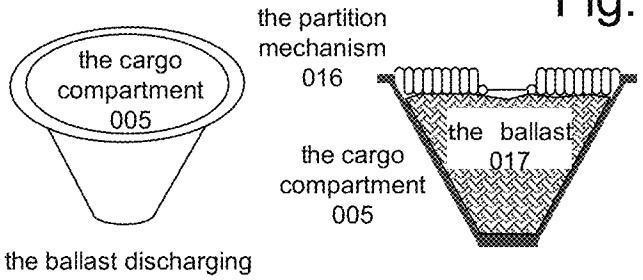
FIG. 5A is a cross section diagram of a cargo compartment before loading collected mineral ores.
Figure 5B:
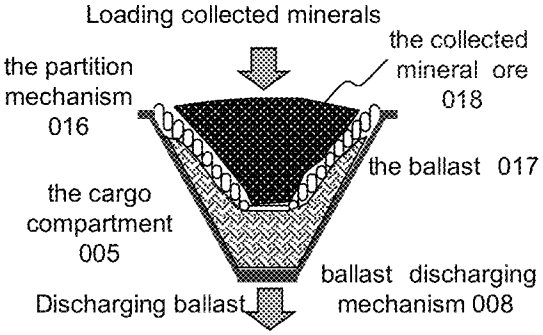
FIG. 5B is a cross section diagram of a cargo compartment while loading collected mineral ores.
Figure 5C:
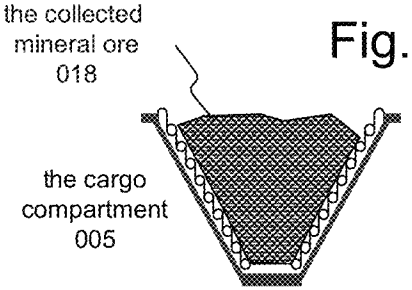
FIG. 5C is a cross section diagram of a cargo compartment after mineral ores loading completed.
Figure 6D:
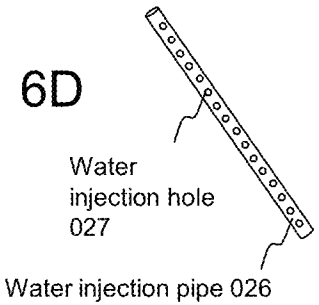
FIG. 6D is an overview of a water injection pipe.
Figure 6C:
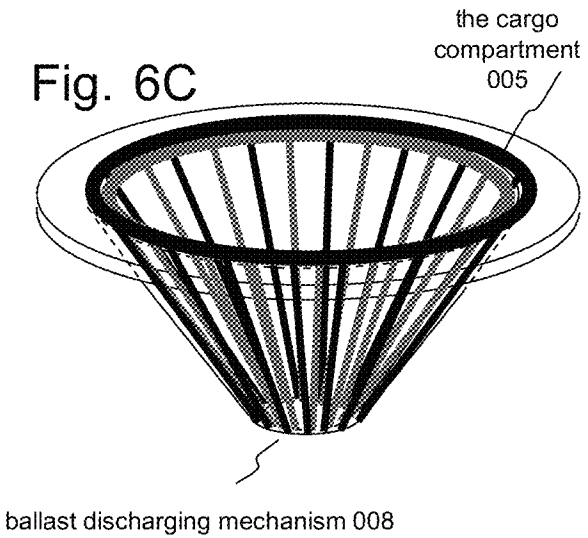
FIG. 6C is an overview of a water injection mechanism 3 of a cargo compartment.
Figure 6A:
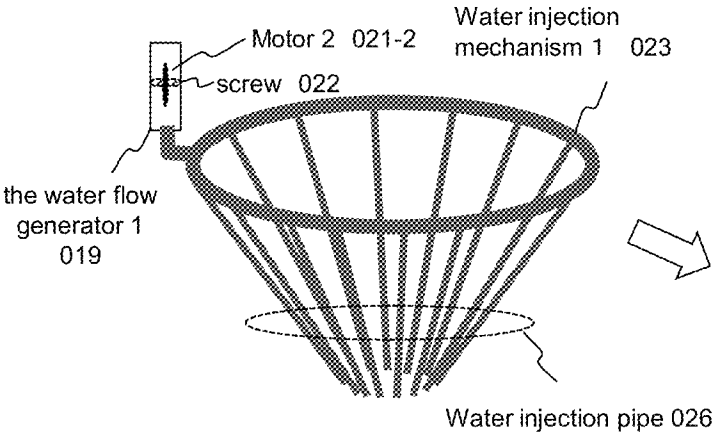
FIG. 6A is an overview of a water injection mechanism 2 of a cargo compartment.
Figure 6B:
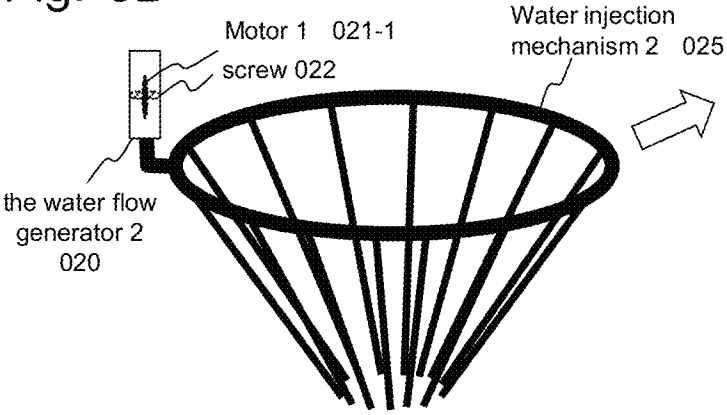
FIG. 6B is an overview of the water injection mechanism 1&2 and a cargo compartment.

FIG. 5A-5C show a mechanism which exchanges the ballast with the thrown-in collected ores. The cargo compartment having a shape of a truncated cone having a structure of squeezing to the lower side. FIG. 5A shows that the cargo compartment 005 at the time of landing is filled with ballast. The ballast is fine-grained earth and sand, and the discharge amount can be finely adjusted by the discharging mechanism 008 provided at the lower end of the cargo compartment 005. The dumping of ballast is performed by gravity, and the transportation cost and environmental load can be reduced by using the concentration slag and the smelter slag of collected ores. By covering the upper part with the partitioning mechanism 016, even if the collected ore is charged from the upper part and the ballast dump is carried out from the ballast discharging mechanism 008 at the lower end, It is possible to prevent dumping of collected ore and mixing of collected ores with ballast. FIG. 5D and FIG. 5E show an example of a partition mechanism having a bellows structure that can be extended downward, and a membrane structure may be used. FIG. 5B shows an intermediate process of charging the collected ores, and FIG. 5C shows the end of charging the collected ores. In actual operation, it is necessary to make the specific gravity of the deep-sea crane lighter than seawater when ascending, so it is necessary to leave ballast for dumping.

Figure 7B:
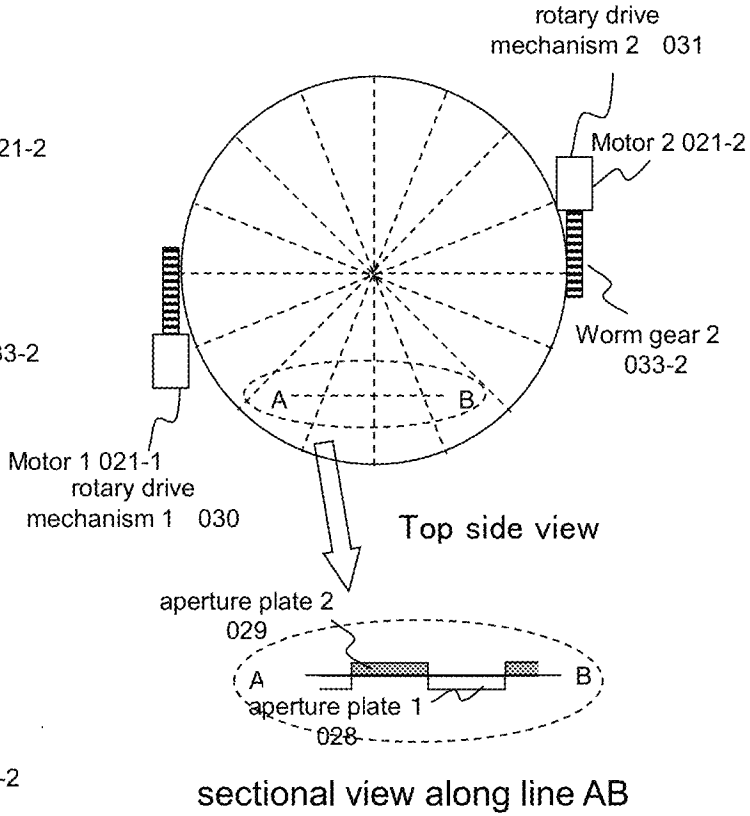
FIG. 7B is a diagram of an aperture mechanism (being closed) of a ballast discharge mechanism.
Figure 7A:
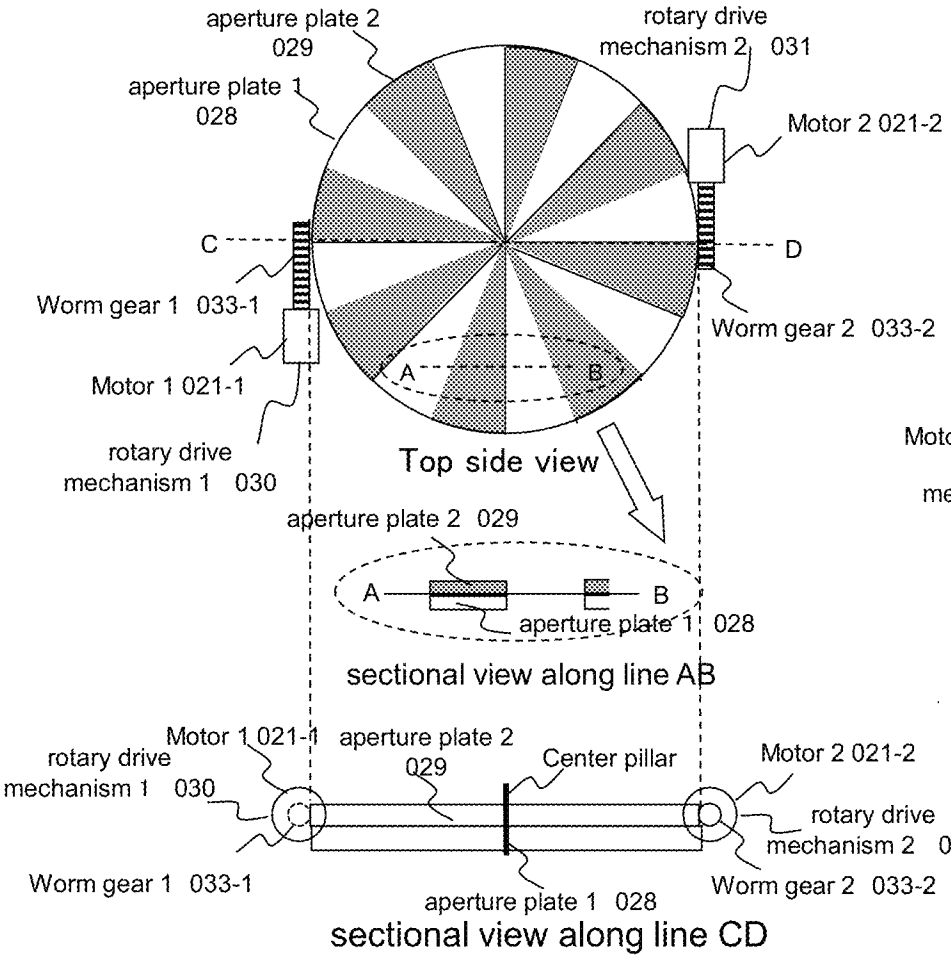
FIG. 7A is a diagram of an aperture mechanism (being open) of a ballast discharge mechanism.

FIG. 7A is a sectional view taken along line AB. An aperture mechanism/weight sensor 007 is provided at each root of the control wing/landing leg 006 to control the opening angle of the control wing/landing leg 006 within the opening adjustment range 048. FIG. 2 shows an operation example of the deep sea crane 001 of FIG. 1A. With the control wings and landing legs 006 of the cargo compartment 005 folded (FIG. 2 (*a*)), a ballast is installed in the cargo compartment 005 to bring the overall specific gravity to $1.0+\alpha$, and the deep sea crane 001 is dropped to the seabed. After the navigation control of the inertial navigation section 090 and the acoustic navigation section 091, the deep-sea crane 001 opens the control wing and landing leg 006 at a position close to the seabed (FIG. 2 (*c*), decelerates, and dumps the ballast if necessary). It makes a soft landing (FIG. 2 (*c*)).

FIG. 4 shows an example of ore loading on the seabed. The collected ore 018 is loaded from the ore loading gap 092 between the buoyancy tank 002 and the cargo compartment 009 by the electric power shovel 015, which drives a hydraulic system with an electric motor. The electric power shovel 015 has a weight of about 6 to 8 tons, and the buoyancy due to the gasoline filled in the buoyancy tank 002 is about 10 tons in the case of the system of FIG. 1A. You can bring it to the sea floor. The cargo compartment 005 is equipped with a ballast that balances the buoyancy of the buoyancy tank 002 and is softly landed on the sea floor, seabed electric power shovel 015 puts the collected ore 018 into the cargo compartment 005. The deep-sea crane 001 discards ballast corresponding to the input collected ore 018 from the ballast discharging mechanism 008, and adjusts the discard amount so that the deep-sea crane 001 does not float. There is an aperture mechanism and weight sensor 007 at each root of the control wing and landing leg 006 in FIG. 1A. If the sum of the measured values is positive, it indicates a landing state. When the collected ore 023 is loaded into the deep-sea crane 001 in a landing state, the weight measurement value increases, so the weight corresponding to the increased amount is discarded from the ballast discharging mechanism 008.

It is possible to attach various attachments (FIG. 27B) to the seabed electric power shovel 015 in advance so as to be convenient for the operation of introducing the collected ores. It is desirable that the ballast 017 is replaced with the collected seabed mineral ores 018 at the as much as possible in the collected mineral input of FIG. 4. The following measures are effective in achieving this.

(1) A discharge throttling mechanism capable of adjusting the degree of opening is installed at the exit of the ballast discharging mechanism 008, and the ballast is prepared with fine particles so that only the ballast is dumped and the final ore loading space is secured.

(2) In order to deal with the case where the collected seabed mineral ores 018 is fine particles such as rare earth mud, the ballast upper surface is covered with a membrane or an expandable partition mechanism, and the portion below the partition mechanism 016 is discarded.

When loading of the collected ore 018 to the deep-sea crane 001 is completed in FIG. 2 (*d*), the remaining ballast is dropped to obtain buoyancy and levitate (FIG. 2 (*e*)). Further, the control wing and landing implantation leg 006 is folded (FIG. 2 (*f*)) to reduce resistance and rise, and as the sea surface approaches, the control wing and landing leg 006 is opened to decelerate. It is guided near the surface command ship 010 in FIG. 16A.

An operation example of ore loading on the seabed will be described with reference to FIG. 4. Since the cargo compartment 005 is suspended from the buoyancy tank 002 by three suspension ropes 004, there is a ore loading gap 092 between the buoyancy tank 002 and the cargo compartment 005. The seabed electric power shovel 015 can put the collected ore 018 there. FIG. 5A shows a state in which the ballast 017 is loaded in the cargo compartment 005 and brought to the seabed. There is a partition mechanism 016 that covers the ballast 017. FIG. 5E is a top view seen from above, and FIG. 5D the partition mechanism 016 is a cutaway view. The partitioning mechanism 016 is a bellows mechanism that can expand and contract as shown in FIG. 5D, and is in the state of FIG. 5A when compressed. When the collected ore 018 is loaded into the cargo compartment 005 from above, the ballast 017 is discarded downward by gravity by the ballast discharging mechanism 008 and the collected ore 018 is mounted above the partition mechanism 016 as shown in FIG. 5B. FIG. 5C shows a state when the collected ores have been loaded, the ballast 017 is completely disposed of below the ballast discharging mechanism 008, and the collected ore 018 is mounted above the partitioning mechanism 016. The partitioning mechanism 016 extends and is in close contact with the inside of the cargo compartment 005. The collected ore 018 pushes out the ballast 017 by gravity.

FIG. 6 shows an example of a water flow mechanism installed below the partition mechanism 016 on the inner wall of the cargo compartment 005. Water is injected from the water injection mechanism 1 023 and water injection mechanism 2 025 through the water injection hole 027 of the water injection pipe 026 to increase the fluidity of the ballast 017. The gravity of the collected ore 018 makes it easier for the ballast 017 to be pushed out of the ballast discharging mechanism 008. In the example of FIG. 6, the water injection mechanism is divided into two systems so as to improve reliability, and even if one system does not operate, there is no hindrance to the total weight control of the deep sea crane. The water flow generators 1 023 and 2 025 that drive the water flow are also installed in each system and are duplicated. FIG. 7 shows an example of the structure of the discharge aperture mechanism. FIG. 7A shows the state when the aperture port is opened. In the case of the configuration example, the aperture mechanism has fan-shaped openings formed in the disk at intervals of 22.5 degrees and is arranged so as to be vertically stacked as shown in the FIG. 7A CD sectional view.

As shown in the cross-sectional view FIG. 7A AB, the diaphragm plate 1 028 and the diaphragm plate 2 029 are placed in an open state. When it is arranged as shown in the sectional view FIG. 7B AB, it is in a closed state. Opening and closing operations are shown in FIG. 7A top view and FIG. 7B top view. The rotary drive mechanism 1 030 moves the aperture plate 1 028 through the motor 1 021-1 and the worm gear 033-1 to move the gear cut around the aperture plate 1 028 to rotate. The rotary drive mechanism 2 031 causes the aperture plate 2 029 to rotate by moving the gear cut around the aperture plate 2 029 through the motor 2 021-2 and the worm gear 2 033-2. This controls the aperture state of the ballast discharge mechanism 008. Opening and closing the ballast discharging mechanism 008 of the cargo compartment 005 is extremely important for controlling the total weight of the deep-sea crane 001, because if the specific gravity cannot be made smaller than that of seawater by failing to release the ballast, it will be impossible to float to the sea surface. If the specific gravity becomes less than seawater before the end of ore loading, unintentional levitation will occur. In order to prevent such a situation, the ballast discharge controlling mechanism of the cargo compartment divides the aperture plate into two parts so that even if one system of the rotary drive mechanism malfunctions, the remaining system can be used to float up the deep sea crane. The double system is also introduced in the water flow mechanism of the cargo compartment shown in FIG. 6C, and is configured so that the function does not stop even if one of the water injection mechanism 1 023 and the water injection mechanism 2 025 fails.

Figure 8:
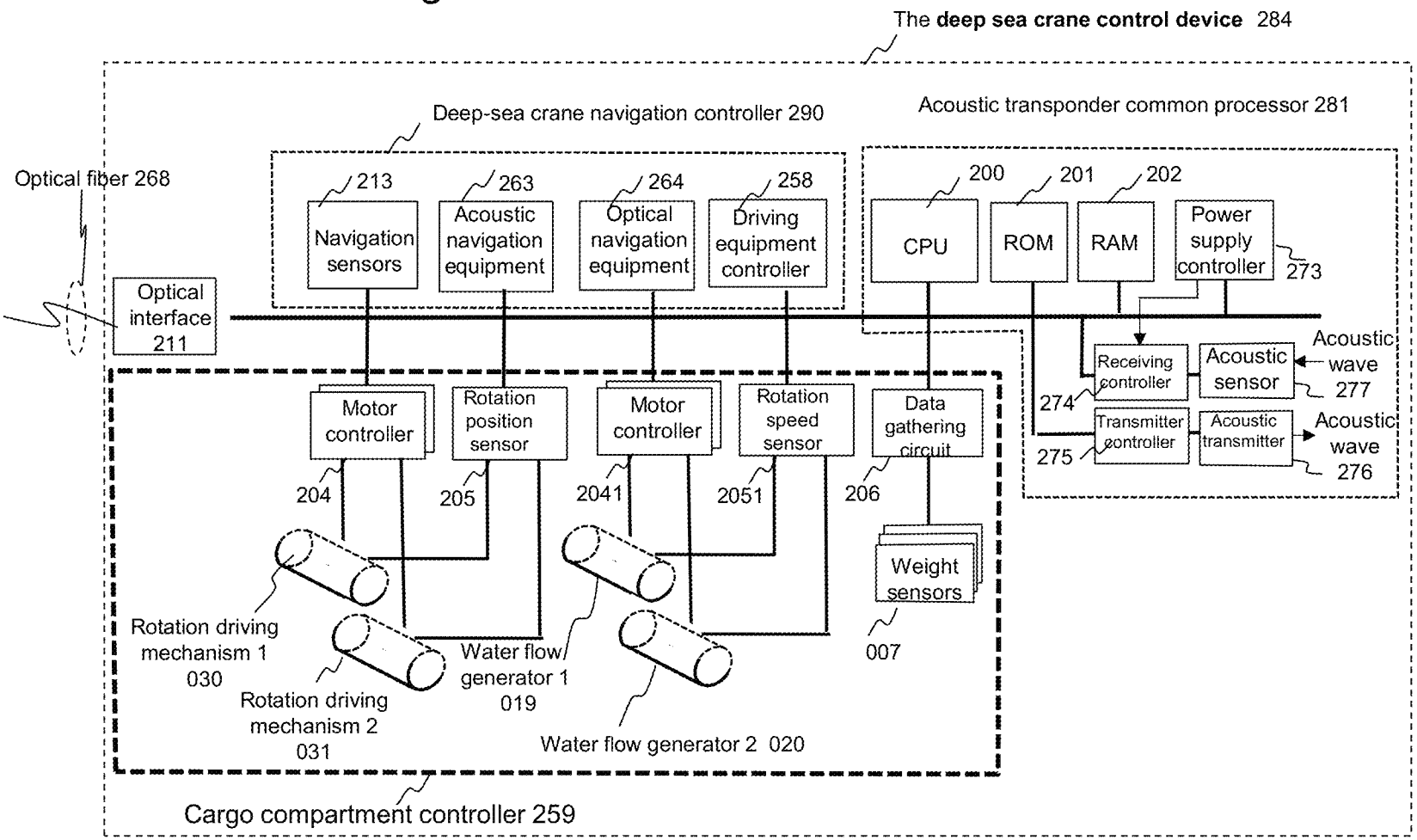
FIG. 8 is a diagram showing a cargo compartment control system.

The cargo compartment control system described in FIG. 8 controls the entire collected ore loading mechanism. The system itself is a microcomputer control system, and the strain gauge of the opening/closing mechanism and weight sensor 007 measures the load applied to each leg of the control wing and landing leg 006. Landing continues if the underwater weight is positive. The weight of the water at the time of the first landing increases by the amount added every time the collected ore 018 is added. Since the ballast weight released from the ballast discharging mechanism 008 can be measured, the remaining ballast amount can be calculated from the known ballast weight brought to the seabed when landing. The collected ore 018 may be added to the extent that it can float if the remaining ballast is completely discarded. The amount of ballast discharged is controlled by adjusting the opening of ballast discharge controlling mechanism shown in FIG. 7. The rotary drive mechanism 1 030 and the rotary drive mechanism 2 031 are controlled by the 2-channel motor controller 204, and the rotational position is captured by the rotation position sensor 205. In order to control the 2-channel water injection mechanism of FIG. 6C, the water flow generator 1 019 and the water flow generator 2 020 are controlled by the 2-channel motor control device 2041, and are taken in by the rotation speed intake device 2051. The status values including the total weight of the deep sea crane 001 are reported to the supervisory control system 283 via the optical interface 211. Further, based on the float up command of the deep sea crane, the ballast discharge controlling mechanism of the cargo compartment in FIG. 7 is controlled to make the specific gravity of the total weight of the deep sea crane 001 smaller than that of seawater for levitation by abandoning the ballast.

Figure 9:
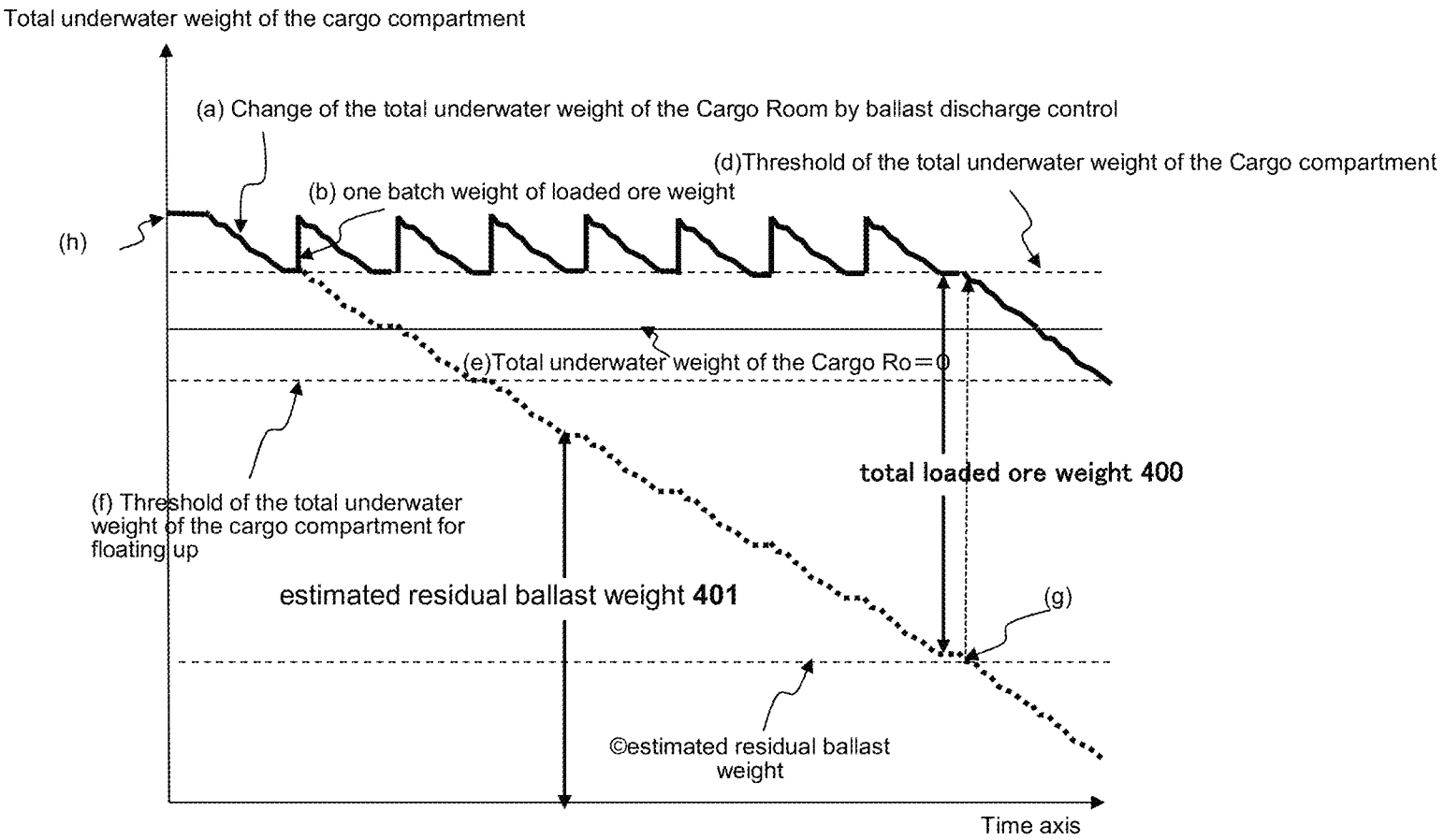
FIG. 9 is a diagram showing a time transition of the cargo compartment components.

FIG. 9 is a graph showing an example of the time transition of the cargo compartment load composition. The actual weight that can be measured is the ballast weight brought into the seabed and the underwater weight of the entire deep-sea crane (hereinafter, "total underwater weight") measured by the weight sensors (strain gauge) 007 (installed in the control wings and landing legs 006).

The solid line in FIG. 9 shows the change over time in the total underwater weight, which is a measurable value.

(e) shows the total underwater weight=0, and when the total underwater weight falls below this value, it floats.

(d) The total underwater weight threshold is controlled so that it does not fall below the total underwater weight threshold in order to avoid unplanned ascent during the seabed stay.

(h) is the state when the deep-sea crane landed on the seabed, and the total underwater weight was >0.

The total underwater weight>(d), which means that "If the total underwater weight is more than the threshold of the total underwater weight, the ballast is discharged."

(b) The total underwater weight change due to ballast dump control shows the weight change at this time. The estimated value of the remaining amount of ballast is reduced by the reduced value at this time (curve with thick dotted line in the figure). When the collected ore is loaded into the cargo compartment 005, the weight of the entire water weight increases by the amount of one batch of ore input. In response to this increase, the ballast is discarded until the total underwater weight reaches (d) the total underwater weight threshold. If collected ore is allowed to be loaded into the cargo compartment (305 after dumping ballast, the total weight of water will increase by (b) one batch of ore input. By repeating this process, when the estimated value of remaining ballast amount reaches the threshold value of estimated remaining amount of ballast (c) at time (g), further ore input is stopped and the remaining ballast is discarded to float up. If you do not, you will not be able to ascend, so throw the ballast so that the total underwater weight is (f) the ascent threshold.

Figure 10A:
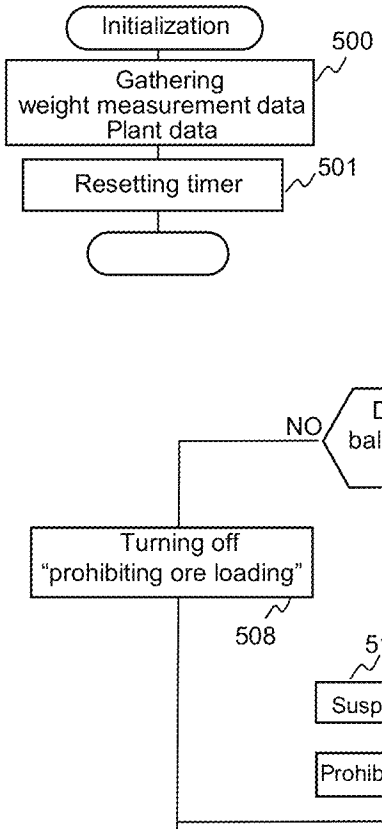
FIG. 10A is a processing flow (A) of a cargo compartment control process.
Figure 10B:
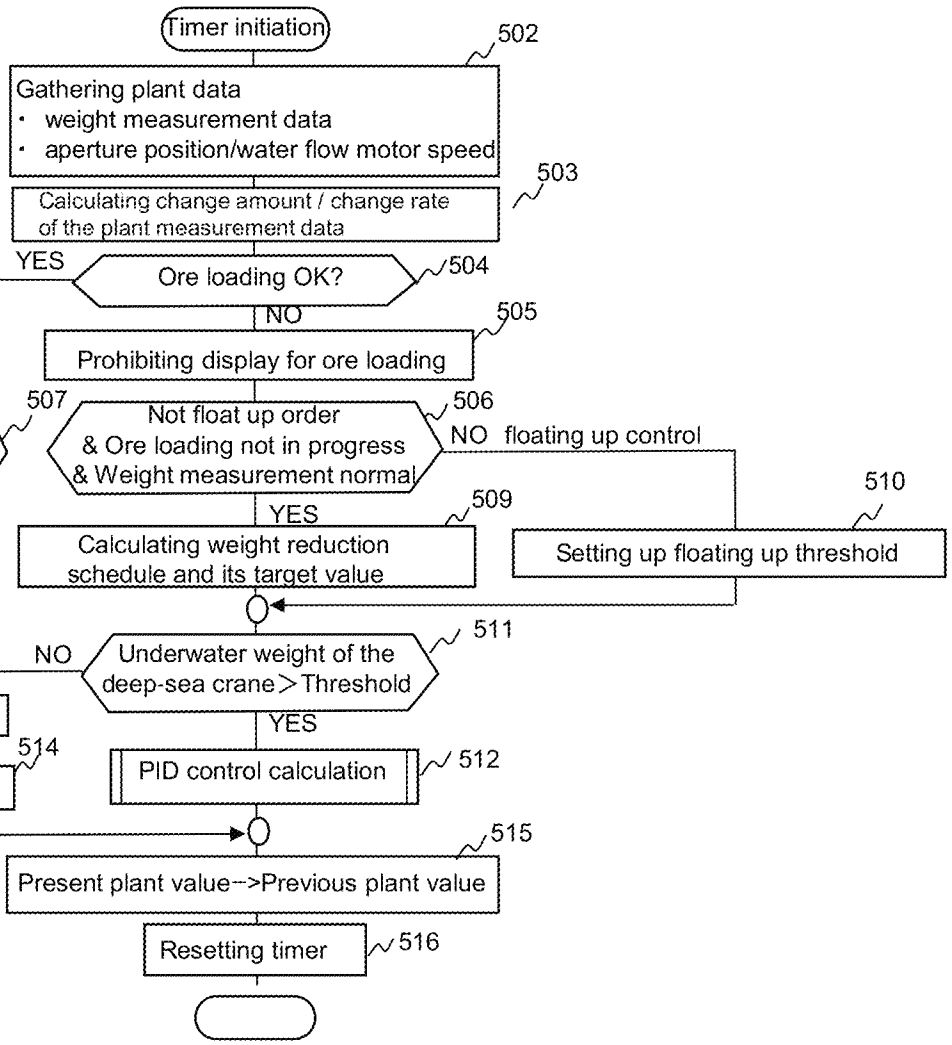
FIG. 10B is a processing flow (B) of a cargo compartment control process.

A diagram of the cargo compartment control system in FIG. 8 is a system configuration for realizing the time transition of the composition of the cargo in the cargo compartment shown in FIG. 9. The software of the cargo compartment control system is shown in the process flow of FIG. 10. The operation of the processing system is the periodic processing by the timer, and the periodic processing is activated at the initial activation in FIG. 10A. FIG. 10B defines the entire cycle process. In FIG. 10, a processing block 502 takes in weight measurement data which is plant measurement data, rotational positions of the rotary drive mechanisms 1 and 2, and rotational speeds of the jet pumps 1 and 2. In a processing block 503, it is calculated a change amount/change rate of the plant measurement data including rationality check and noise removal. The processing block 504 permits the input of ore when the ballast discardable amount is larger than the upper limit of one batch of the input amount of collected ore, when the dumping of the ballast is stopped, and when the total weight of water is settled. The amount of ballast that can be disposed of is the weight of the ballast brought to the seabed minus the integrated value of the ballast discarded, and then subtracting the safety value. The processing block 505 displays an alarm of prohibition of the input of collected ore on the console 441 of the surface command ship 010 in order to prevent the input of the ore into the cargo compartment 005. It is transmitted to the surface command ship 010 via the optical cable 268.

Process block 504 determines if the collected ore input is permitted. Input of collected ore is allowed only while ballast dumping is stopped. If the value of the weight sensors 007 that are periodically taken in are settled, and the display 255 of the surface command ship 010 does not permit the input of the collected ore, then it is determined that the ore input is not permitted, then proceeds to processing block 505. When it is determined that the ore charging is permitted, it is determined that it is dangerous to perform the plant (deep sea crane) control because the state is changing, and the process proceeds to the processing block 507.

In processing block 507, checking if there is no request for dumping ballast and that dumping of ballast is not in progress. Since the ore loading is allowed only when there is no ballast dumping, the display of the ore loading disapproval display on the display 255 of the surface command ship 010 is erased in processing block 508. If there is ballast dumping, the aperture mechanism of the cargo compartment is closed in processing block 513, and an ore charging disapproval display is requested in the display 255 of surface command ship 010 in processing block 514.

If the processing block 504 prohibits the ore loading, the ballast dump control is permitted, and the processing block 505 requests the display 255 of the surface command ship 010 to request an alarm display indicating that the ore loading is prohibited. The processing block 506 determines whether it is not a floating command, ore is not being put in, and the weight measurement data is normal. If the determination result is YES, it means that the ballast dumping control is performed, and if the determination result is NO, it means an emergency command from the surface command ship 010 or a floating control by completion of loading of the ores. In processing block 509, the total underwater weight threshold of FIG. 9 (*d*) is set to the target value of the ballast dump control. In processing block 510, the floating up threshold value shown in FIG. 9(*f*) is set to the target value for ballast dump control.

The processing block 511 shifts to processing block 513 to stop the ballast dumping when the total underwater weight of the deep-sea crane is equal to or less than the threshold value. That is, the rotary drive mechanisms 1, 031 and 2, 032 of the aperture mechanism of the cargo compartment 005 of FIG. 7 are driven to close, and the water injection mechanism of the cargo compartment 005 of FIG. 6 for fluidizing the ballast is also stopped. If the total underwater weight of the deep-sea crane is equal to or greater than the threshold value, a control calculation toward the threshold value is performed in processing block 512. PID control of a digital system that is periodically activated by a timer is a known technique, and controls the opening of the aperture mechanism of the cargo compartment 005 of FIG. 7 and, at the same time, water is injected into the water injection mechanism to increase the fluidity of the ballast. In processing block 515, the present plant value is stored as the previous plant value in preparation for the processing of the next sampling cycle, and in processing block 516, a timer is set to start the processing of the next sampling cycle.

1.2 Ore Collection Operation Using Seabed Mineral Ores Collection Containers

Figure 11B:
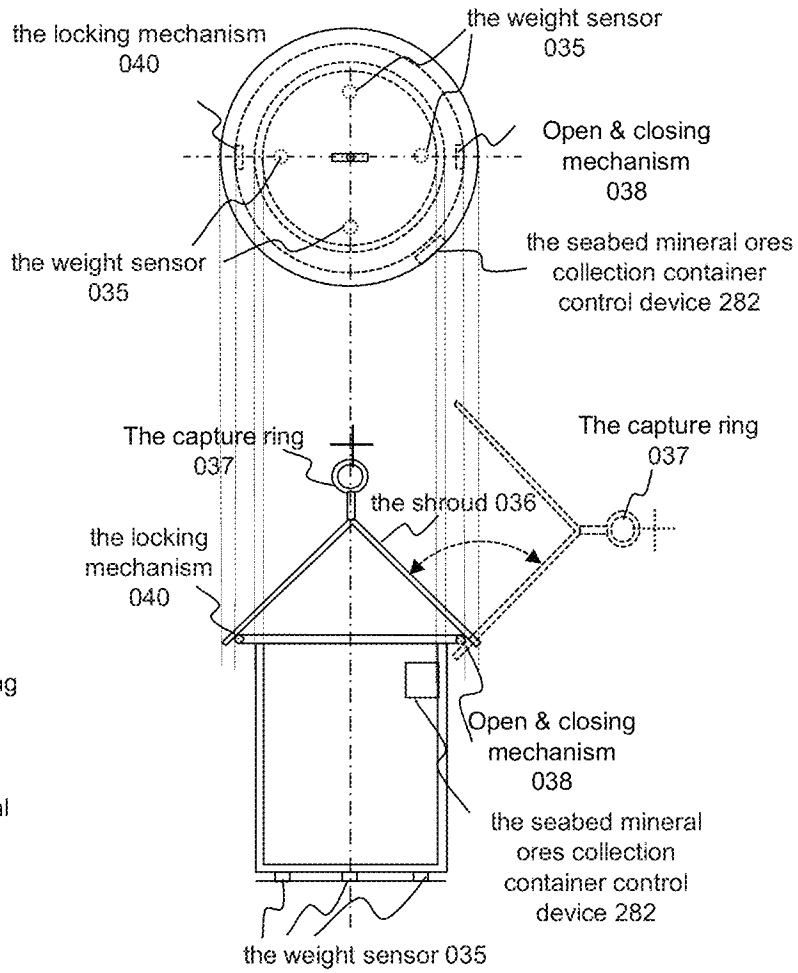
FIG. 11B is a drawing of a seabed mineral ores collection container.
Figure 11A:
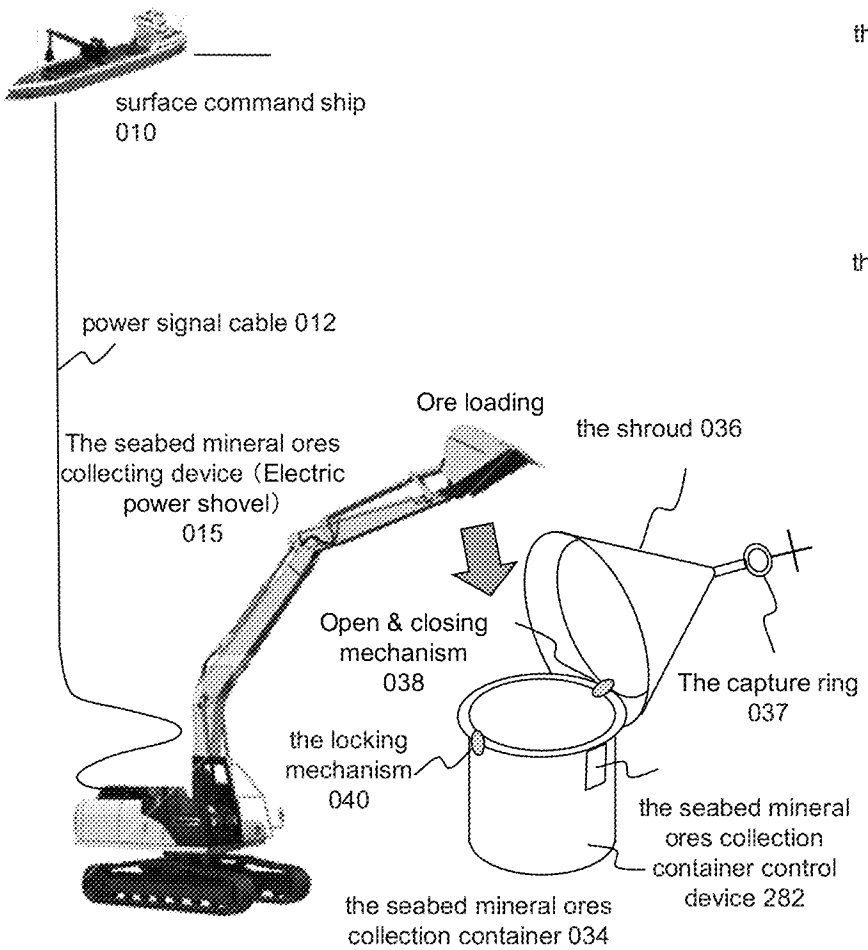
FIG. 11A is an overview of ore loading to a seabed mineral ores collection container.

The ore loading can be performed using the seabed mineral ores collection container 034 shown in FIG. 11 instead of using the cargo compartment 005. It is also possible to throw in the collected mineral ores 018 with the seabed mineral ores collecting device 015 in the seabed mineral ores collection container 034, which has been previously carried into the sea bottom by the deep sea crane 001. As an advantage of this container 034, firstly, it can separate the mining operation by the ore collecting device 015 from the surfacing operation by the deep-sea crane 001. The deep-sea crane 001 can concentrate in the surfacing when the sea surface condition is quiet. We should notice that the sea floor is not easily affected by the sea surface condition, therefore it is possible to continue mining with the ore collecting device 015. Secondly, when the collected ore 018 is overloaded, the risk that the deep sea crane 001 cannot float up and being lost can be eliminated. In particular, it is possible to discharge excess ore from the overloaded ore collection container 034 by the ore collection device 015, and this kind of erroneous operation can be avoided. On the other hand, it is necessary for the lifting hook 047 of the cargo compartment 005 of FIG. 28B to capture the capture ring 037 of the ore collection container 034 in FIG. 11A.

This operation needs precise position control of the deep sea crane 001 (this precise position control can also be used for collecting the ore collecting device 015 from the sea bottom). The ballast discharging mechanism of the cargo compartment 005 and the ore loading mechanism are not required, but the precision position control mechanism of the deep sea crane 001 (FIG. 24A to E) precision control attachment) is required. Further, a ore collection container 034 is additionally required, and a weight sensor 035 for weighing the collected ore 018, functions to be captured using the capture ring 037, and a docking communication function with the deep sea crane 001 are required.

The position/speed control of the deep-sea crane 001 according to FIG. 23 cannot move upward from a stationary state because there is no active propulsive force. In order to perform precise alignment, the precision control attachment shown in FIG. 24 is added to the cargo compartment 005 to provide the following functions.

Figure 24A:
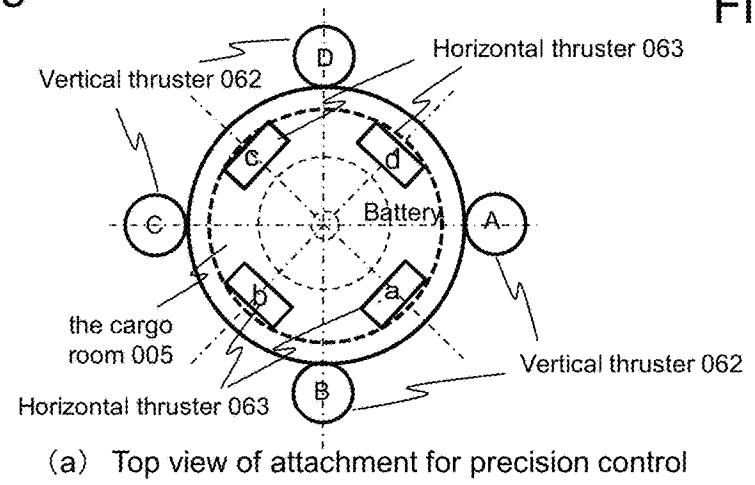
FIG. 24A is a drawing showing a top view of attachment for precision control attachment.
Figure 24C:
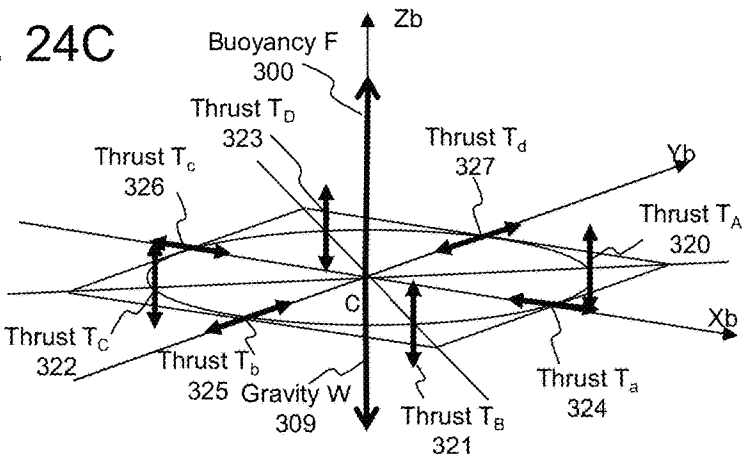
FIG. 24C is a diagram showing generated forces by a precision control attachment.
Figure 24D:
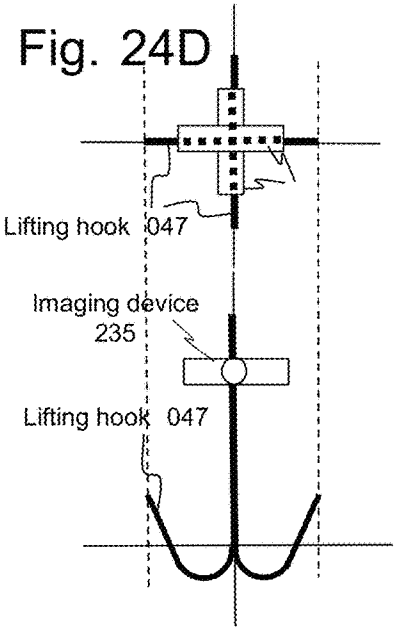
FIG. 24D is a drawing showing a rendezvous mechanism.
Figures 28A, 28B, 28C, 28D:
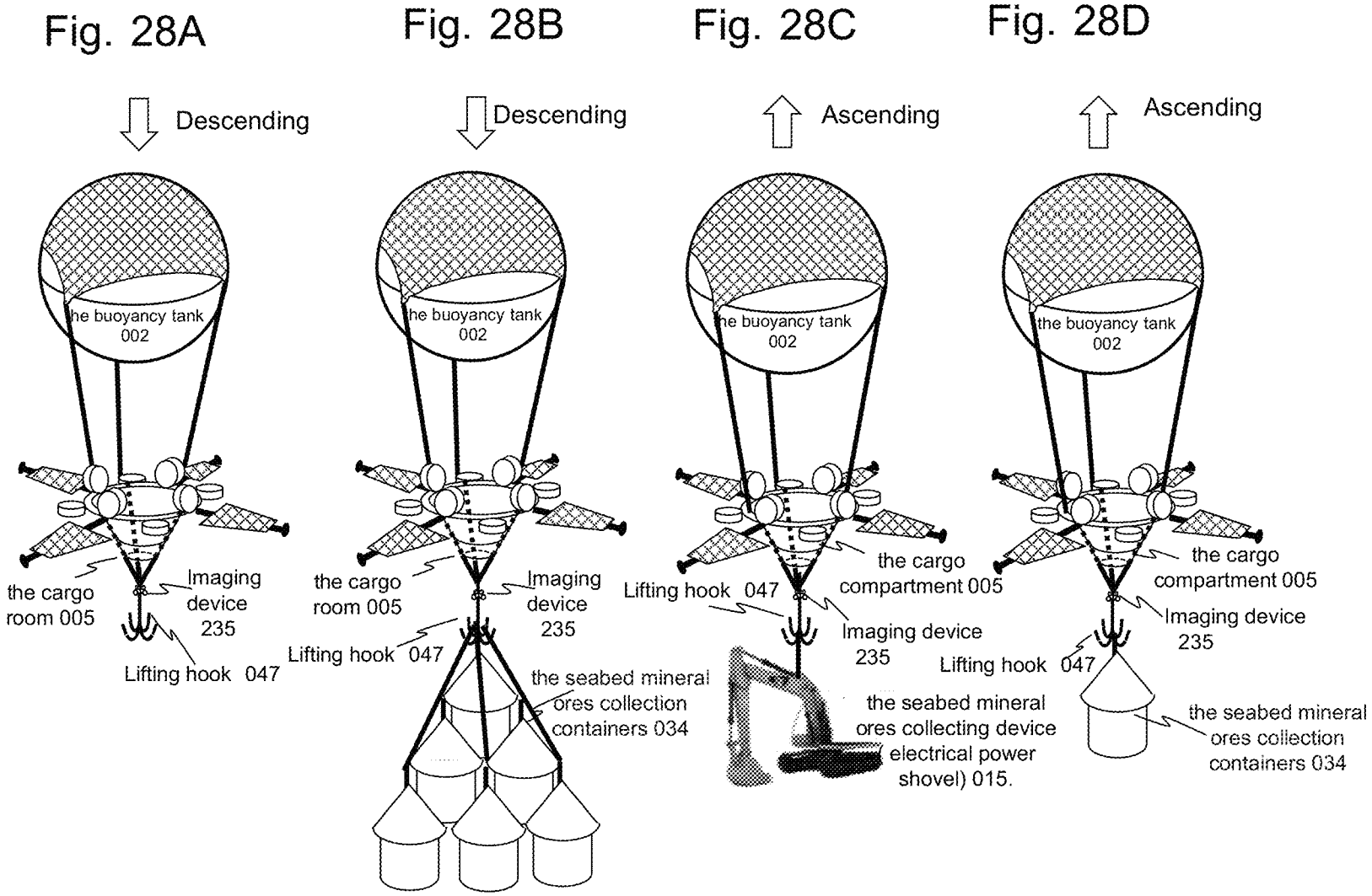
FIG. 28A is a diagram showing a descending deep-sea crane w/o load.
FIG. 28B is a diagram showing a descending deep-sea crane with vacant seabed mineral ores collection containers
FIG. 28C is a diagram showing float up of the seabed mineral ores collecting device.
FIG. 28D is a diagram showing float up of the loaded seabed mineral ores collecting container.

(1) Horizontal thrust FIG. 24A Horizontal thrusters a to d
(2) Vertical thrust FIG. 24A Vertical thrusters A to D
(3) Imaging device for optical navigation
FIG. 24D Imaging device 235
(4) Lifting hook FIG. 24D In above (1) and (2), a thrust force for precise positioning is applied, and in (3), the target position is precisely measured from the captured image by optical navigation. (4) The lifting hook 047 is attached directly below the imaging device 235, and the capture ring is lifted as shown in FIG. 28C. When the precision control attachment is added on the cargo compartment 005 its thrust effects are shown in the action vector diagram of FIG. 24C. FIG. 28B shows a operation which shows the ore collection container 034 is brought to the seabed. Since the ore collection container 034 is empty, it is lightweight and can be brought in large quantities to the seabed instead of the ballast.

FIG. 11 shows an ore collection method using the ore collection container 034 installed on the seabed. When the ore collecting container 034 is installed on the seabed and the capture ring 037 at the tip is lightly pressed down by the ore collecting device 015 with the shroud 036 being closed, then the locking mechanism 040 is released, so the shroud 036 is opened.

The lock mechanism 040 is a push latch mechanism, for example, when a lock of a push latch mechanism is pushed for the first time the lock is released, when it is pushed for the second time, the lock is locked. The opening/closing mechanism 038 is opened by a spring when the lock mechanism 040 is disengaged. The shroud 036 needs to dump the ballast loaded in the cargo compartment 005 when the ore collecting container 034 is suspended and the deep-sea crane 001 floats up.

The seabed mineral ores collection container 034 is equipped with a microcomputer system and exchanges the following information with the deep-sea crane 001 to manage the ore get loaded into it and to float up from the seabed.

Figure 12:
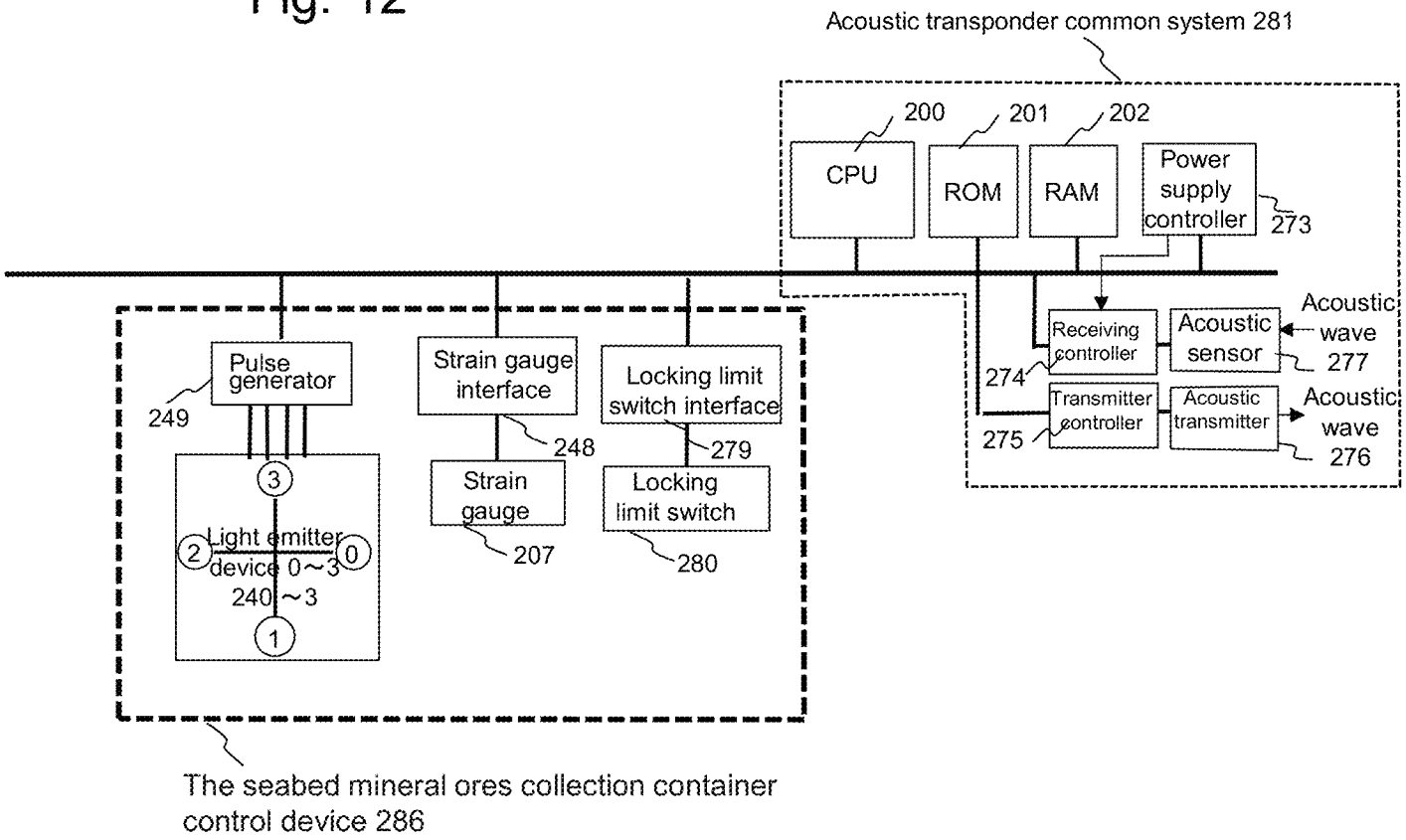
FIG. 12 is a diagram showing a configuration of a seabed mineral ores collection container control device.
Figure 13:
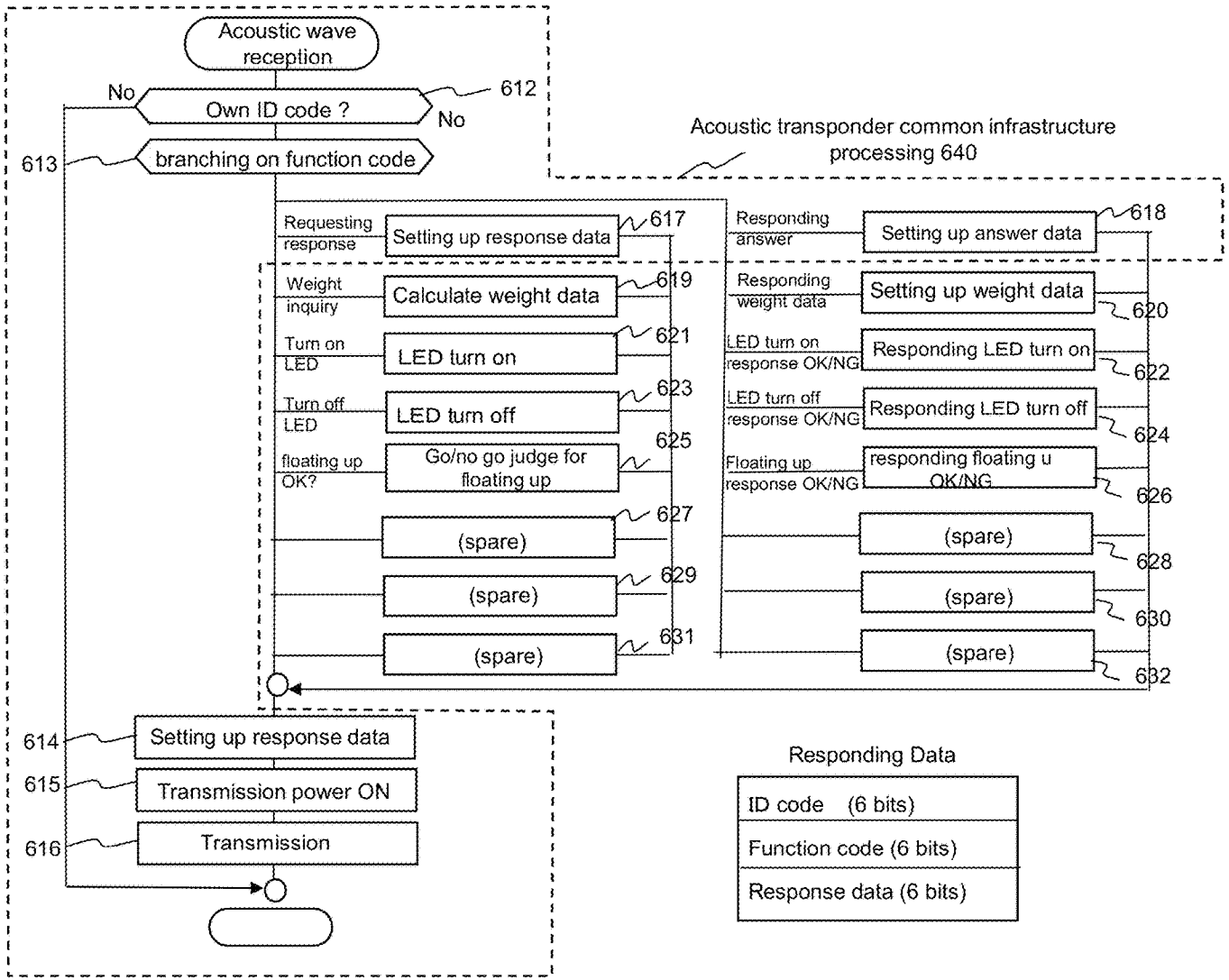
FIG. 13 is a diagram showing a processing flow of the seabed mineral ores collection container control device.

The seabed mineral ores collection container control device 286 shown in FIG. 12 is installed in the ore collection container 034, and its processing flow is as shown in FIG. 13. The identification number (ID) of the ore collection container 034 installed on the seabed is defined in advance.

A series of operations from placing the seabed mineral ores collection container 034 to the seabed to its surfacing is as follows.

(1) As shown in FIG. 28B, plural ores collection containers are carried into the seabed. The posture when placed on the seabed is not guaranteed.

Figure 30:
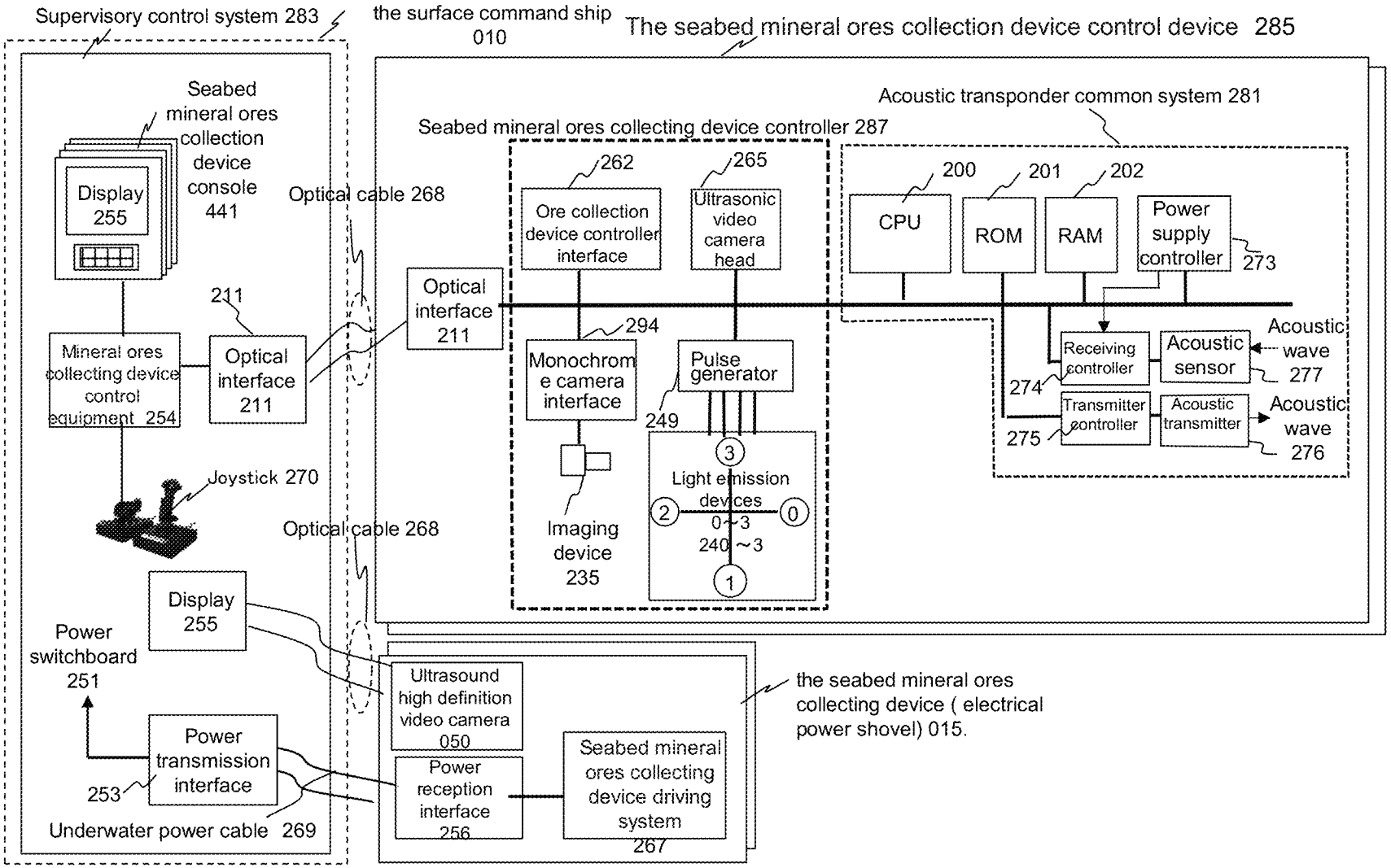
FIG. 30 is a diagram showing a supervisory control device of a seabed mineral ores collecting device.

(2) The moving image captured by the imaging device 235 of the ore collecting device 015 or the ultrasonic high-definition video camera 050 is monitored by the display 255 of the surface command ship 010 in FIG. 30 and the arm of the ore collecting device 015 is operated by the control stick 270 to erect and align each ore collector.

(3) Since it is necessary to know the identification number (ID) of the ore collection container 034 into which the ore is put, the acoustic transponders sequentially make inquiries. The ore collection container 034 blinks the capture ring 037.

(4) Since the ore collection container 034 into which the ore is put is determined together with the ID, it is necessary to open the shroud 036. Therefore, since the lock mechanism 040 is a lock of the push latch mechanism, the shroud 036 is locked from above and the ore collection device is pressed. When pushed down by the 015 arm, the shroud 036 opens.

(5) When the collected ore are put into the ore collection container 034, the weight increases. Since the weight sensor 035 measures the weight, the seabed mineral ores collection container control device 282 calculates the weight based on the processing flow (FIG. 13), and responds to the weight inquiry.

When the control device 285 of the ore collecting device determines that the specified weight has been reached, the arm of the ore collecting device 015 is operated to close the shroud 036 of each ore collecting device 034 and push down from above to lock the lock mechanism 040. Since the ore collection container control device 282 is ready for collection, it is displayed on the seabed mineral ores collection device console 441 through the control device 285 that the collection is OK. The capture ring 037 for lifting the ore collection container 034 is illuminated turning on the LED adjacent to the upper side (6) The deep sea crane 001 is precisely position-controlled to be docked on the hoisting hook and the LED-lighted capture ring 037, and the lifting hook 047 is used for fishing as shown in FIG. 28D. FIG. 43 shows the operation of lifting up the ore collecting device 015 from the seabed, and also the container 034 filled with the collected ores can be lifted up instead of the ore collecting device 015.

(7) When the ballast in the cargo compartment 005 is dumped in the state of FIG. 28D, the specific gravity of the deep-sea crane becomes lighter than that of seawater, and it floats above the sea surface.

2. Ore Collector

Since deep sea crane 001 does not use a lifting pipe to lift up the ores, it does not need to make the ores into a slurry or to granulate them, and the collected ores can be floated up in a state close to the original shape.

Therefore, the ore collecting apparatus 015 can can best utilize the know-hows of the ground mining machines.

Mining itself is done on the ground with mining equipment, and supports various vein conditions. There are the following types of seabed resources, and each has different characteristics when mining is done.

(1) Seawater hydrothermal deposits exist as rock masses in the form of mounds
(2) Cobalt-rich crust exists on the seabed in the shape of pillows (3) Manganese nodules scatter as nodules of 10 centimeters or more (4) Rare earth mud exists several meters to 10 meters below the seabed mud in layers of several meters to 10 meters.

Figure 29A:
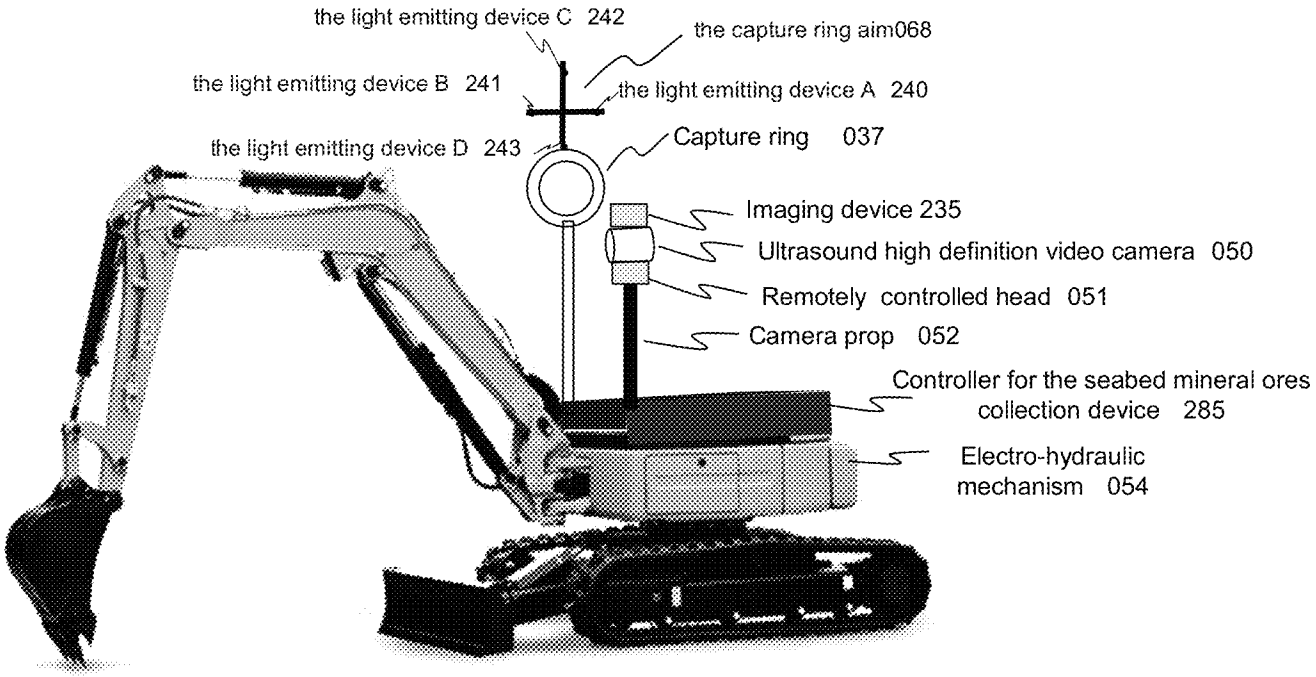
FIG. 29A is an overview a seabed mineral ores collecting device (electric seabed power shovel).
Figure 29B:
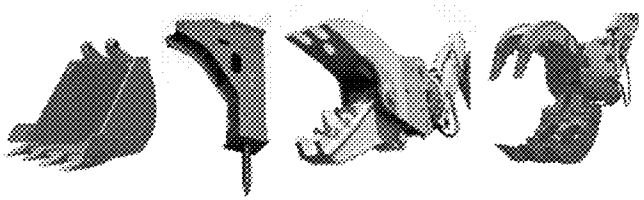
FIG. 29B is an overview of various attachments for a a seabed mineral ores collecting device.

All mining equipment is a large-scale construction machine, and if you add various attachments (bucket, breaker, rotary crusher, rocking swing gripper, etc.) to the construction machine, for example, the power shovel shown in FIG. 29, It can handle different forms of resource existence on the seabed. Since the drive mechanism of the construction machine is operated by a hydraulic mechanism and the drive force is a differential pressure, the high pressure on the seabed is not related to the differential pressure, so there is no obstacle in principle. Since a construction machine on the ground operates a hydraulic pump by an internal combustion engine, it can be operated in water by replacing it to an electric motor. Construction equipment that operates underwater with a remote control has already been put to practical use. FIG. 29 shows an example of a remote controlled underwater construction machine. In order to be operated from the surface command ship 010, a power signal cable 012 is connected to transmit power from a generator on the surface command ship, and a signal is sent by an optical cable.

Since the Sun light does not reach the seabed, the visibility may not be guaranteed. As a countermeasure an ultrasonic video camera (for example, http://www.soundmetrics.com/) is installed in addition to the floodlight and optical imaging device. The capture ring (337 in FIG. 11C is used when the ore collection container 034 is picked up from the sea bottom by the deep sea crane 001. LED light emitters and an acoustic transponder are provided around the capture ring, and the deep sea crane 001 is precisely guided. It is used for the purpose of guiding the lifting hook of 047 in FIG. 24C so that it can be easily captured.

2.1 Installation and Collection Operation

In addition to collecting mineral ores collected from the seabed, the deep-sea crane 001 needs to perform operations such as bringing a seabed mineral ores collecting device 015 (electric power shovel) from the surface to the seabed instead of ballasts in the cargo compartment 005 and lifting up the mineral ores collecting device 015 from the seabed to the sea.

In order to perform this operation, the following points are different from the case where the collected ores are loaded from the seabed into the cargo compartment 005.

(1) Bringing the Seabed Mineral Ores Collecting Device 015 to the Seabed

Figure 27A:
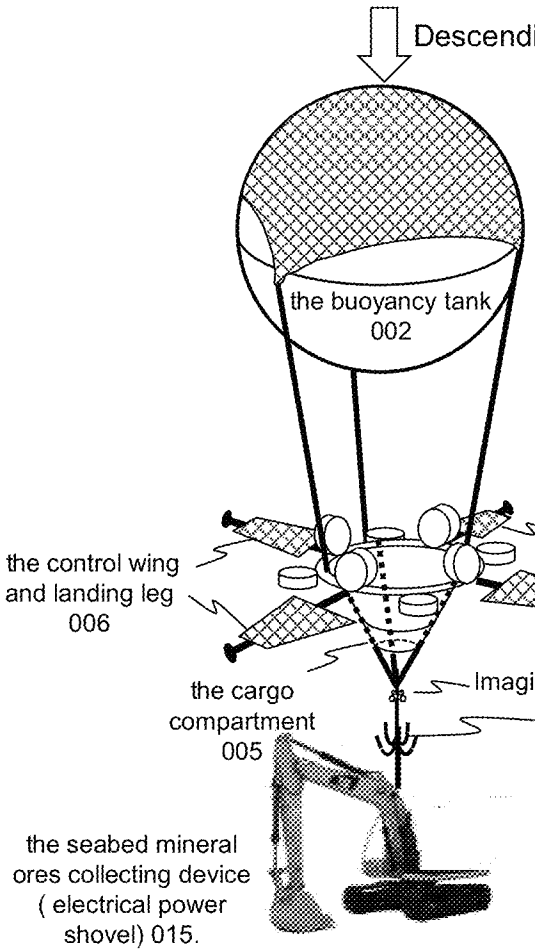
FIG. 27A is an overview showing installation of a seabed mineral ores collecting device.

When descending to the seabed, as shown in FIG. 27A, a seabed mineral ores collecting device 015 can be suspended under the cargo compartment 005 and be softly landed on the seabed. When descending, a ballast for adjustment is installed so as to satisfy the conditions for the buoyancy of the buoyancy tank 002, and when approaching the seabed, the control wing and landing leg 006 is opened and the ballast is dumped and landed adjusting the speed.

Figure 27B:
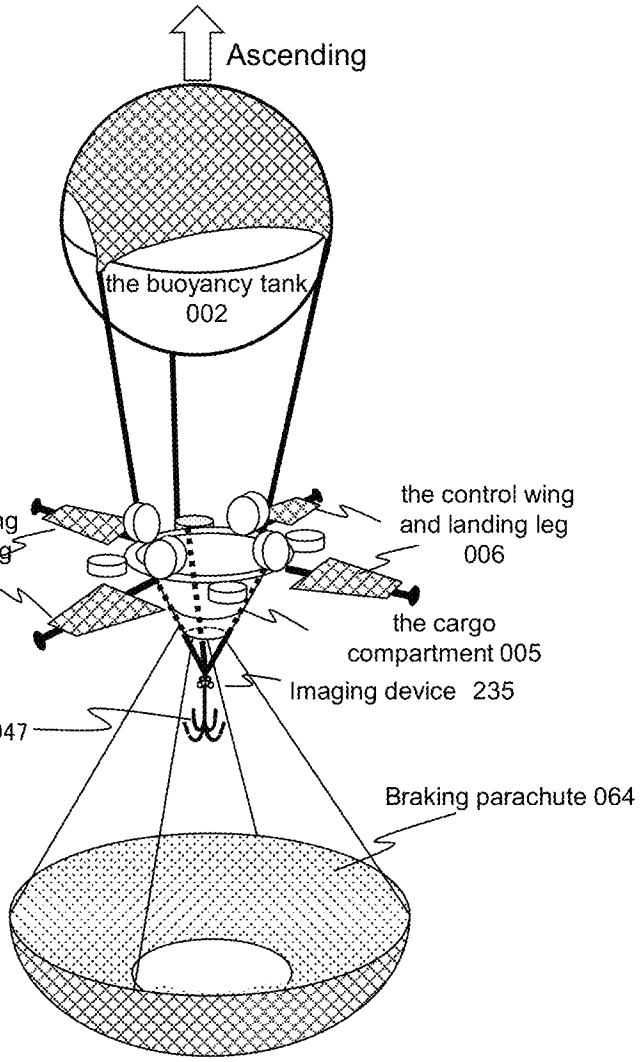
FIG. 27B is an overview showing floating up after installation of a seabed mineral ores collecting device.

After the ore collecting device 015 is installed on the seabed, there is insufficient ballast in the cargo compartment 005, and there is no ore collecting device 015, the total buoyancy of the deep sea crane 001 becomes excessive and it rapidly rises, causing damage to the deep sea crane 001 by the stress at sea surface. To prevent this situation, the braking parachute is opened when climbing (FIG. 27B). The ore collecting device 015 can also be lowered to the seabed by the crane 065 of the gut crane ship 067.

(2) Recovery of the Seabed Mineral Ores Collection Device from the Seabed

In order to collect the seabed mineral ores collecting device 015 existing on the seabed, it is necessary to capture it using the lifting hook 047 installed at the lower part of the cargo compartment 005. It is also required the precision control of millimeter order in position accuracy and several centimeters per second in relative speed. After capturing the ore collecting device 015 on the lifting hook 047, the ballast in the cargo compartment 005 is discarded, and the specific gravity of the deep-sea crane 001 is made lighter than that of seawater and floated to the surface of the sea.

Since the operations of (1) and (2) of the ore collection device 015 require precise control unlike the collection of the collected seabed mineral ores, the partition mechanism 016 in FIG. 5A-E for separating the ballast and the collected ore at the upper part of the cargo compartment 005 is replaced. The precision control attachments are shown in FIG. 24AB. In FIG. 24, there are four electric vertical thrusters and four horizontal thrusters are provided, and a secondary battery is attached as a power source. The thrusters are controlled by images from the image device 235 provided on the lifting hook 047.

FIG. 27A is a diagram showing the operation when the ore collecting device 015 is installed on the seabed. FIG. 28C and FIG. 43 are diagrams showing the operation when the ore collecting device 015 is recovered from the seabed. Since recovery from the seabed is not a frequent operation, the precision control attachment is installed at the top of the cargo compartment temporally. The weight of the precision control attachment and the ore collecting device 015 needs to be less than the ore collecting capacity of the deep sea crane 001. FIG. 43 shows an operation example when the ore collecting device 015 is collected from the seabed for the purpose of maintenance, etc. A ballast is mounted on the deep-sea crane 001 and lowered to the seabed (FIG. 43A (1)). When approaching the seabed, the control wings and landing legs 006 are opened for precise position guidance and to decelerate to the maximum extent, and the ballast is also adjusted and discarded to stop at the seabed (FIG. 43A (2)). The lifting hook 047 is precisely and optically guided to the capture ring 037 attached to the upper part of the ore collecting device (electric power shovel) 015 by the imaging device 235 at the tip, and the lifting hook 047 is moved to the capture ring 037 to suspend it (FIG. 43A (3)). The ballast in the ore collecting device 015 is dropped to float up (FIG. 43A (4)).

3. Surface Command Ship 3.1 Selection of Ship Type

In the operation of the deep-sea crane 001 of the present invention, since no underwater structure such as an offshore drilling rig is used, a fixed position control mechanism, a moon pool and a bow thruster are not required, in addition, by devising a cargo handling method so that it can be handled by a small crane on board and can be operated by a 699-ton class gut ore carrier, it can be used as a surface command ship 010.

The gut ore carrier can also be used as a collection ore carrier. The carrier carries the ballast from the departure port, functions as a surface command ship 010, loads the collected minerals instead of the ballast, returns to the port of departure, and repeats this round trip. Since the ballast is freely dropped to the seabed from the ballast discharge mechanism 009 at the lower end of the cargo compartment 005, fine particles are indispensable, and it is convenient in terms of quantity and transportation to use metal-extracted slag.

The surface command ship 010 occupies the sea surface of the collection seabed, directs the mining of resources, maintains equipment, carries one or more deep sea cranes 001 and a seabed power shovel 015, and advances to the ore collection point and deploys them in the sea. The surface command ship 010 controls the operation of all related equipment.

The functions that the surface command ship 010 should have are as follows.

(1) From the mother port, equipped with a plurality of deep-sea cranes 001, seabed mineral ores collection devices (electric power shovels) 015, and power generation equipment to advance to a mineral collection point, occupy the sea of the collection seabed, deploy these equipment in the sea and on the sea surface. In addition, it will be guided from the sea to its own ship and collected.

(2) An acoustic position marker 075 for guiding the deep-sea crane 001 is dropped and installed at a suitable place for collecting minerals.

(3) Accurately maintain its own position with respect to the ocean currents in the Pacific Ocean where there are seabed resources.

(4) The location will be changed depending on the resource status of the seabed and the new location will be deployed.

(5) Collect and maintain equipment that is deployed in the sea or on the surface of the sea.

(6) Supply power to equipment deployed underwater and on the surface of the sea.

(7) The deep-sea cranes 001 and ballast are mounted to settle toward the sea floor and the mineral resources collected from the sea floor are recovered.

3.2 Cargo Handling Method

Figure 32:
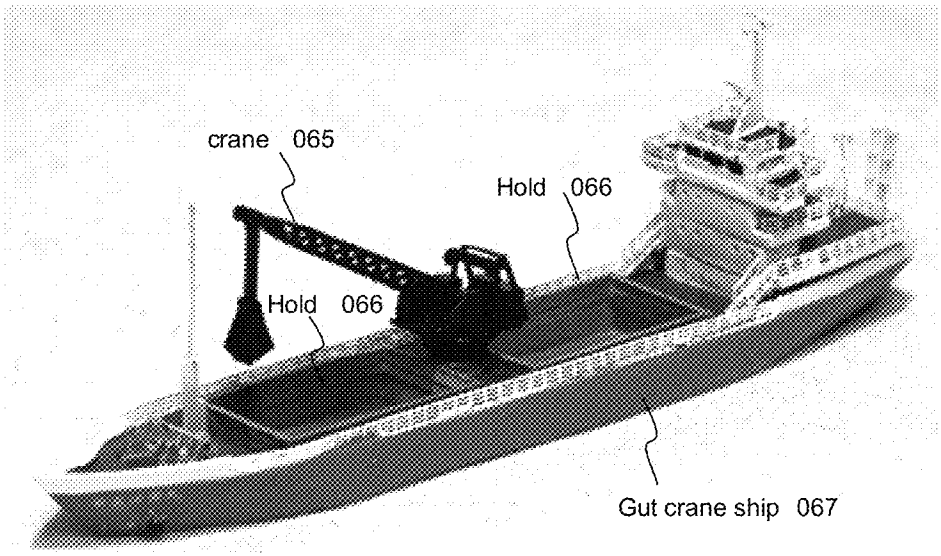
FIG. 32 is an overview of a surface command ship, a gut crane ship.

The gut crane ship is a small standard cargo ship in which one or two compartments for loading gravel as shown in FIG. 32 are provided and a crane used to lift gravel from the seabed is mounted on the ship. Assuming the operation of the seabed resources, the assumed operating area is legally classified as "near sea" and must be at least 699 tons. Loading capacity is possible up to about 1300 tons. Consider an operation in which the ballast is loaded to the mining point on the ocean, and the ballast is exchanged for the collected ore and returned. Gut crane vessels have the advantage of low charter costs, but as shown below, they must be operated according to their capabilities, including cargo handling methods.

(1) Fixed Point Maintenance Function

The bow thruster, which is not equipped, corrects the ship position by measuring the position by GPS against the direction in which the sea current and the wind flow. By using the Japanese GPS positioning satellite "MICHIBIKI", the position itself can be grasped with high accuracy. The direction of the ship depends on the sea condition, but there is no undersea structure. It is necessary to equip the automatic position holding function by GPS in order to reduce the load on the personnel.

(2) Cargo Handling

Figure 33B:
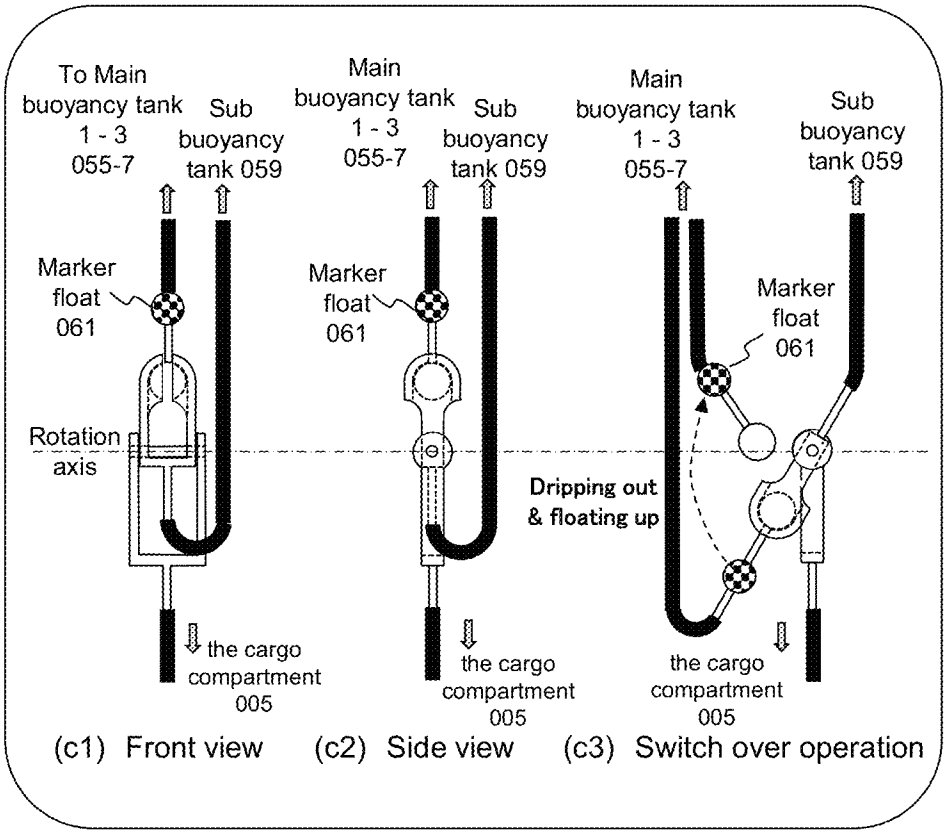
FIG. 33B is an diagram showing operation of buoyancy tank switch a deep-sea crane w/ three buoyancy tanks.

Since the crane 065 shown in FIG. 32 is used for cargo handling in the open sea, it is necessary to take measures against wind storms. Since the buoyancy tank 002 of the deep-sea crane 001 weighs 30 tons or more, it is avoided to unload the entire deep-sea crane 001, and only the cargo compartment 005 is unloaded, leaving it on the sea surface. FIG. 33 shows cargo handling equipment. In order to separate the cargo compartment 005 from the buoyancy tank 001 and collect it, it is desirable that the connection point between the buoyancy tank 001 and the cargo compartment 005 comes to the sea surface in the center of the buoyancy tank, so the buoyancy tank as shown in 31 (*b*), is divided into three parts so that a gap is formed in the center (FIGS. 31B,C,D,E,F).

Figure 33A:
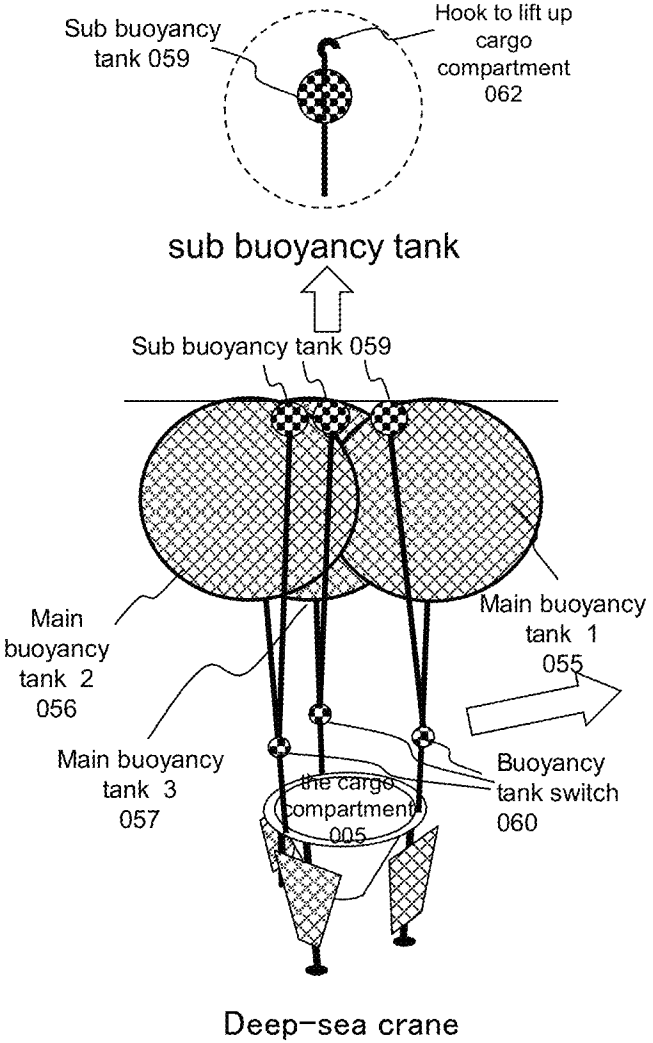
FIG. 33A is an overview of a sub buoyancy tank of a deep-sea crane w/ three buoyancy tanks.

Each of the three divided main buoyancy tanks 055 to 057 shown in FIG. 33A is provided with a sub-buoyancy tank 059 with a cargo compartment lifting hook 062 so that the sub-buoyancy tank 059 can be lifted up above the sea surface. The tip of the crane 065 hooks the hook to lift up cargo compartment at sea surface work (FIG. 34B, or FIG. 34G).

When the load applied to the sub buoyancy tank 059 becomes large, the connection with the main buoyancy tank is automatically disconnected (FIG. 33B.FIG. 31E), and as shown in FIG. 34C or FIG. 34G.H, the main buoyancy tank is separated and floats on the sea surface. Further, as shown in FIG. 34D and FIG. 34H, being lifted up from the sea surface the ores are collected. The cargo compartment 005 loaded with ballast is also hung on the sea surface, and as shown in FIG. 34D or FIG. 34I As shown in FIG. 34E or FIG. 34I, the marker float of the main buoyancy tank on the sea surface and the buoyancy tank changeover switch are adjacent to each other on the sea surface, so that the two are connected by sea level work.

Further, when the cargo compartment is lowered to the sea surface, the buoyancy source is switched to the main buoyancy tank and the descent is started (FIGS. 34B,A and 34F). The cargo compartment 005 caught by the crane has a size and weight that can be handled on board. In the case of descent, the tip of the crane wire is released in FIGS. 34B and 34F.

The following work must be done manually at sea.

That is, the work of hooking the tip of the crane to the cargo compartment of the deep-sea crane that has surfaced to the sea surface (FIG. 34A,B, FIG. 34F), and the work of connecting the cargo hold to the main buoyancy tank before descending to the seabed (FIG. 34E, FIG. 34I, FIG. 34B, FIG. 34F), and the operation of releasing the tip of the crane wire.

By the ingenuity shown in FIGS. 34A-I, 34A-E, cargo handling by the gut crane is made possible and diving work could be avoided, but the work was carried out by lowering the small boat from the gut crane ship. It must be calm to some extent.

On the seabed, the electric power shovel 015, which is an electric construction machine, is operated by remote control to perform mining, but prior to loading into the cargo compartment, preparatory work such as mining, crushing, and accumulation is required. Since the work on the seabed is not affected by the wind waves on the sea surface, these preparatory work should be performed when the cargo handling work on the sea surface is not possible due to the wind waves, and the collection of seabed mineral resources collected when the cargo handling work on the sea surface is possible.

4. Acoustic Position Marker

As positioning by radio waves such as GPS is not possible on the sea bottom, including the deep sea, a precise position reference on the sea surface is obtained by GPS. An acoustic position marker will be installed directly below the precise position reference on the sea surface to serve as a precise position reference on the seabed, so as to work using position information on the seabed will be possible. Position markers are placed on the seabed in a form that allows the latitude and longitude to be referenced, and open pit digging on the seabed can be efficiently advanced. Since the GPS latitude/longitude information can be obtained with high accuracy on the sea surface, there is a technical feature in using this information as a fixed point position reference for the sea floor immediately below. As a method of guiding the acoustic position marker from the sea surface to the sea floor immediately below the high-accuracy latitude and longitude on the sea surface, there are a method of using sound and a method of inertial navigation as described below.

4.1 Installation by Acoustic Guidance

As a technical feature,

Firstly, the only sound wave that can be used as an information transmission means is used as a means for setting a position marker between the sea surface and the sea bottom, but the sound wave is characterized by refraction and not going straight because the temperature distribution in the sea is not uniform . . . . For this reason, we pay the utmost attention to the sound propagation characteristics in the sea for position location. That is, the temperature distribution changes in layers with respect to the depth in the sea, and there is the characteristic that straightness is guaranteed without refraction in the direction perpendicular to the layer, and acoustic signals can be used in the range near the direct point.

Secondly, the acoustic marker is guided and installed under the fixed point position reference on the sea surface by the signal processing and control technology using the acoustic signal.

An example of the configuration and installation procedure of the acoustic position marker is described with reference to FIG. 36A-C. FIG. 37A is an outline view of the acoustic position marker 075, which sinks in the sea by gravity. At the time of sinking, the X-axis steering blade 076 and the Y-axis steering blade 077 are controlled to change the sinking path. Acoustic position marker setting method is as shown in FIG. 36C, the position marker ship 070 is occupied on the surface of the sea, then the acoustic position marker 075 is lowered immediately below, and the position of the acoustic position marker 075 is located on the seabed 009 by its own weight by the penetrating weight 079. As the flow velocity on the seabed is 1 to 2 cm/sec in the deep sea, the location can be kept by setting the X-axis steering wing 076 and the Y-axis steering 077 horizontally on the seabed.

Figure 37A:
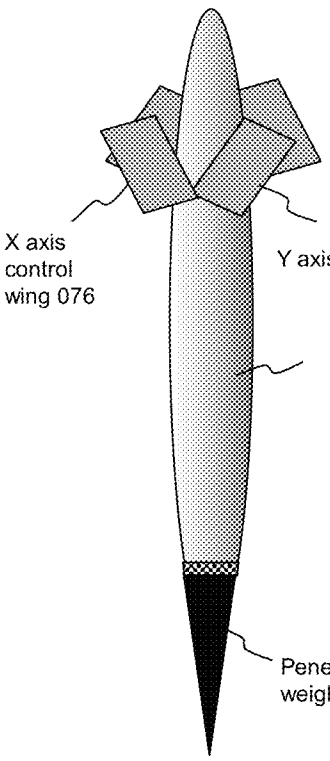
FIG. 37A is an overview of an acoustic position marker.
Figure 37B:
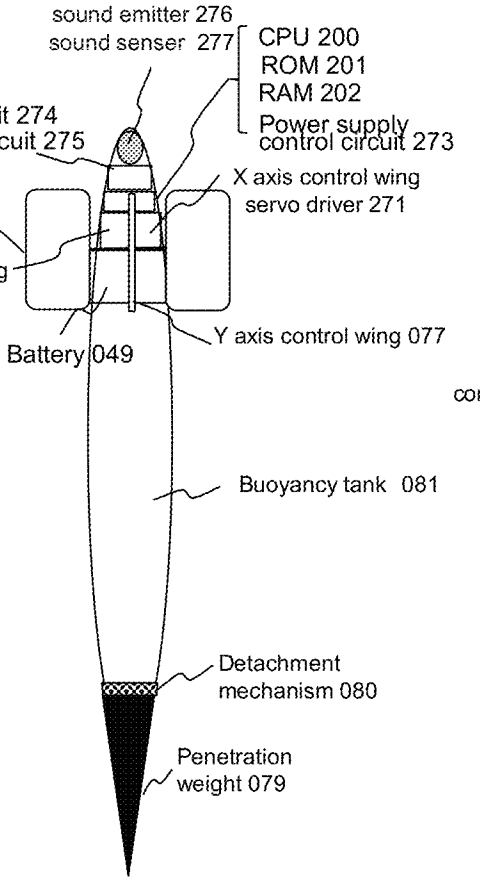
FIG. 37B is a diagram showing structure of an acoustic position marker.

FIG. 37B shows the structure of the acoustic position marker 079. FIG. 37A is a front view showing that an X-axis steering blade 076 for guidance and a Y-axis steering blade 077 for guidance are installed orthogonal to the long axis of the cylindrical acoustic position marker 075. FIG. 37B is a side sectional view of the acoustic position marker 079. There are one set of X-axis steering wings 075 and one set of Y-axis steering wings 075 outside the acoustic position marker 075, and an X-axis steering wing servo drive device 271 and a Y-axis steering wing servo drive device 272 are incorporated to control the angle for guidance. Since the acoustic position indicator 079 needs to withstand the high-pressure environment in the deep sea, the inside must be oil-immersed and the equipment inside must function completely in the oil-immersed state. The X and Y axis steering wing servo drive device may be of a level realized by a radio control machine.

Figure 37C:
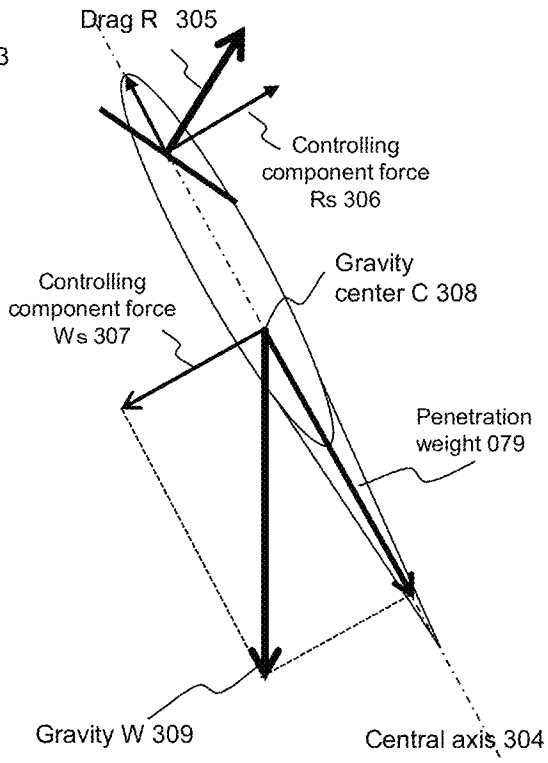
FIG. 37C is a diagram showing structure of an acoustic position marker.

The sound emitter 276 and the sound sensor 277 are installed at the tail of the acoustic position marker 079. The dynamic characteristic for the guidance control is defined by the motion characteristic acting force vector in FIG. 37C. By placing the center of the reaction force including the X-axis steering wing 076, the Y-axis steering wing 077, and the acoustic position marker 075 in the tail, the X-axis steering wing 076 and the Y-axis steering wing 077 are operated to be able to control the dropping direction of the acoustic position marker 075. The steering component force Ws and the steering component force Rs act on the acoustic position marker 075 as a rotational moment.

Figure 42A:
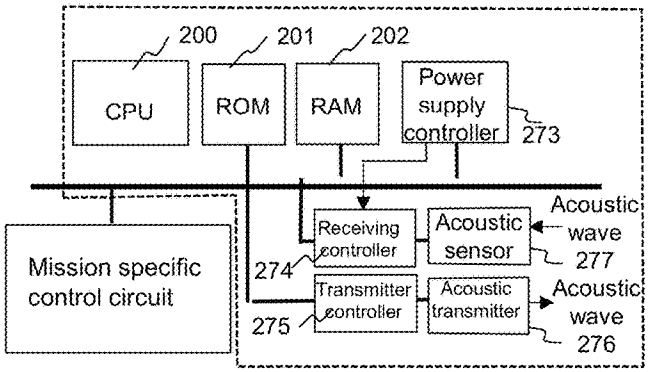
FIG. 42A is a processing flow diagram of an acoustic transponder common system.

After the acoustic position marker 075 is installed on the seabed, it is used as a transponder for a long time as an acoustic position marker. For this reason, a battery 031 that can be used for a long time is built in, a power supply control circuit 039 is also provided, and circuits other than those essential to the transponder are shut off to prepare for long-term operation. Since the acoustic position marker 075 is operated by a battery, a means for recovering to the sea surface is prepared as a countermeasure when the battery is consumed. As shown in FIG. 37B, a buoyancy tank 081 in which an acoustic position marker 075 is filled with gasoline and a penetrating weight 079, which is, for example, an iron weight, are connected and integrated by a detachment mechanism 080. The specific gravity of 075 is larger than that of seawater, and when the penetrating weight 079 is separated, it becomes lighter than seawater so that it can be floated and collected on the surface of the sea. In the detachment mechanism 080, when the digital output is turned on by the acoustic position marker control unit 289 of FIG. 38C, the explosion bolt 078 is detached. The acoustic position marking portions other than the penetrating weight 079 can be reused by recharging after ascending. In the acoustic transponder common infrastructure shown in FIG. 42A, the penetrating weight 079 is detached by a blast bolt or the like by a "floating command". The levitation command is issued by monitoring the operation time after the acoustic position indicator 075 is input by the deep sea crane monitoring control system 209 of the surface command ship 010.

Figure 38A:
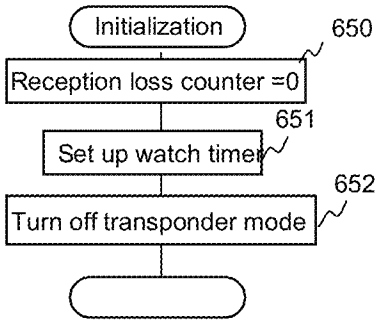
FIG. 38A is A processing flow diagram of an acoustically guided acoustic position marker/initialization.
Figure 38B:
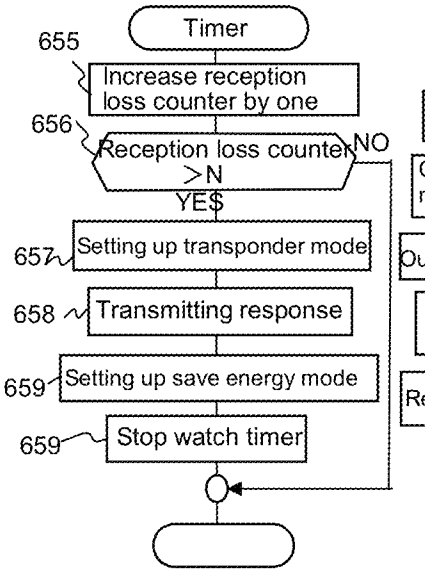
FIG. 38B is A processing flow diagram of an acoustically guided acoustic position marker/guidance supervision.
Figure 38C:
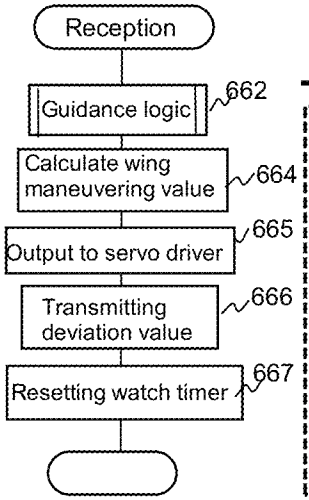
FIG. 38C is A processing flow diagram of an acoustically guided acoustic position marker/guidance processing.
Figure 38D:
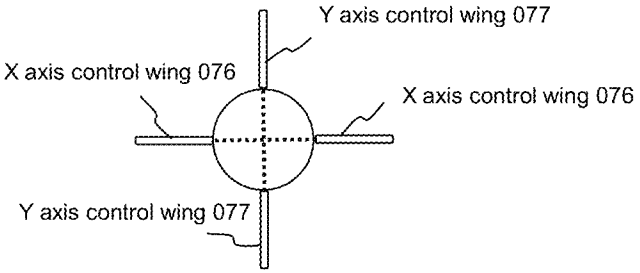
FIG. 38D is a drawing showing an axial view of acoustic position marker.
Figure 38E:
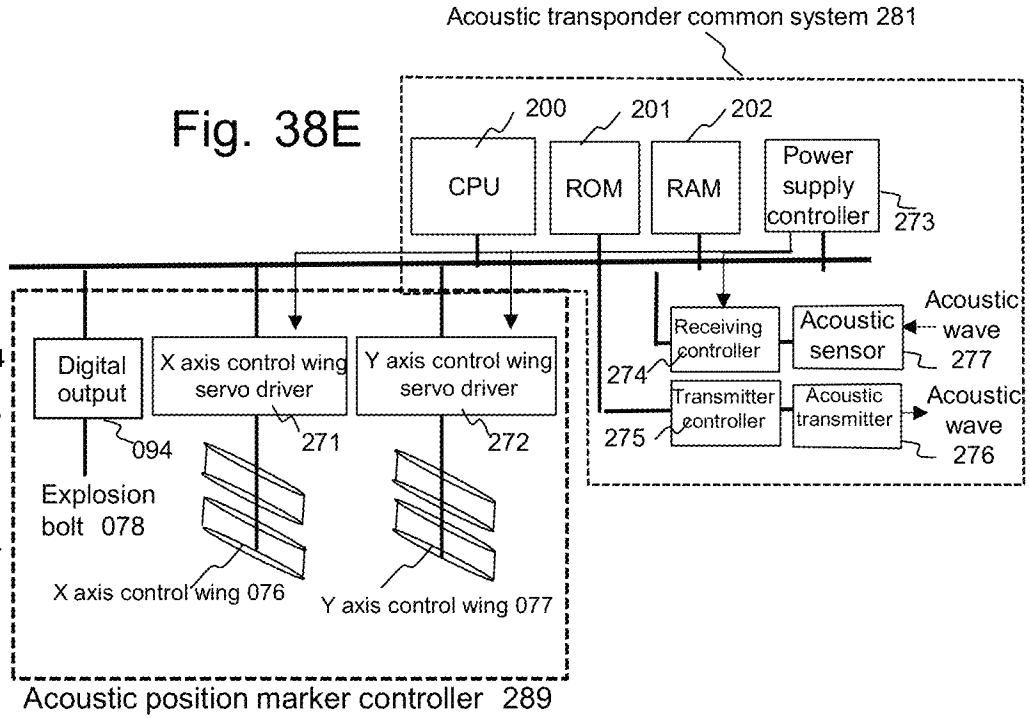
FIG. 38E is a diagram showing an acoustic position marker control system.

FIG. 38C shows the system configuration in the acoustic position marker 075. The CPU 200, the ROM 201, and the RAM 202 are similar to the acoustic transponder common processing unit, and the X-axis steering wing servo drive device 271 and the Y-axis wing servo drive device 272 are publicly implemented in a radio-controlled system. The receiving controller 274 and the transmitter controller 275 are circuits that drive acoustic transmitter and acoustic sensor, which are piezoelectric elements, and are publicly implemented to convert sound waves and electric signals. The power supply control circuit 273 controls ON/OFF of power supply to system components in the acoustic position marker 075 shown in FIG. 38B to reduce power consumption of the battery when operating as a transponder after installation on the seabed. It is implemented by the software described in FIG. 38B.

The acoustic position marker 075 has the following operation modes.

(1) Guidance control mode (2) Transponder mode

Before putting the acoustic position marker 075 into the sea, initialization is performed to set the guidance control mode in FIG. 38A, and the transponder mode is turned off to set the guidance control mode.

When the guided acoustic signals are received from the position marker ship 070 on the sea surface and the unmanned auxiliary position marker ships A to D, the guidance process of FIG. 38C calculates the steering wing operation amount 664 by the guidance logic 662 (FIG. 38C).

The signal reception monitoring timer is reset in 667. In the guidance monitoring process of FIG. 38B, when the guidance signal is not continuously received N times of the timer setting value, it is determined that the guidance control is not performed, and the mode is changed to the transponder mode (processing block 657).), And shifts to the energy saving mode (processing block 659). If the acoustic vibration is received within the predetermined timer value, it is judged that the guidance control is continuously performed, and setting another monitoring timer to check whether there is no acoustic vibration in the next time frame (processing block 667).

Figure 36A:
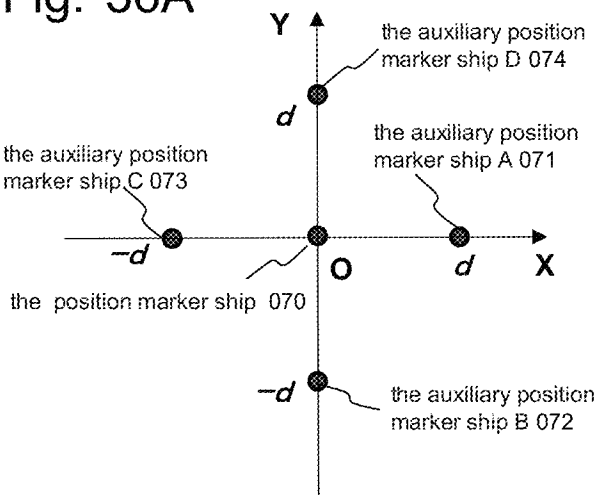
FIG. 36A is a top view diagram showing installation of the acoustically guided acoustic position markers.
Figure 36C:
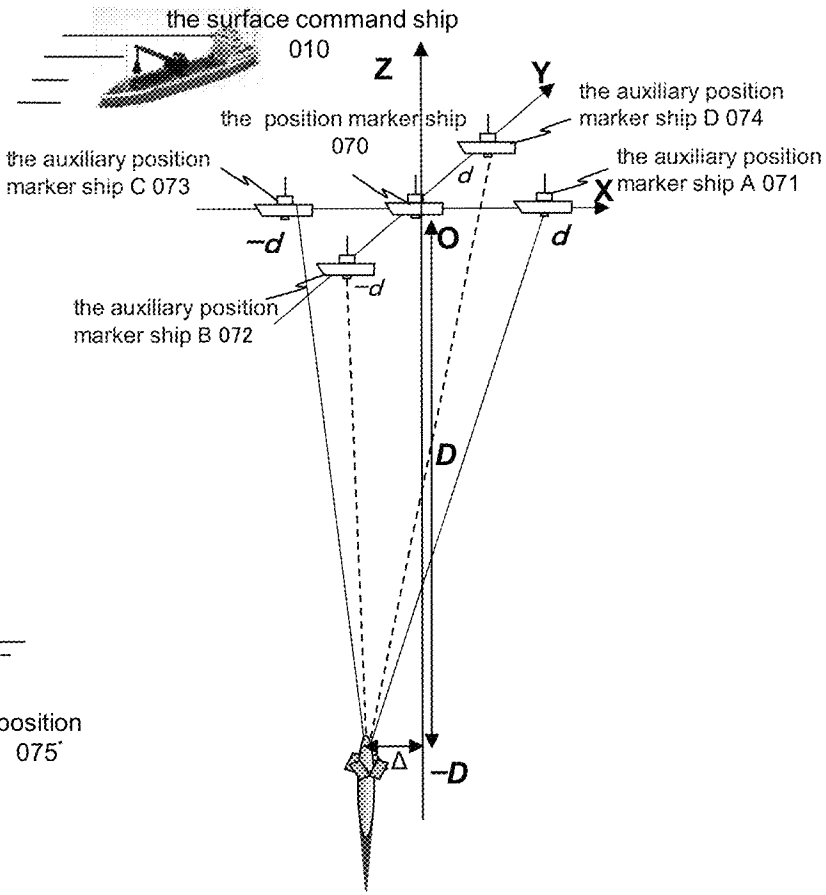
FIG. 36C is a diagram showing an installation method of acoustic position markers.
Figure 36B:
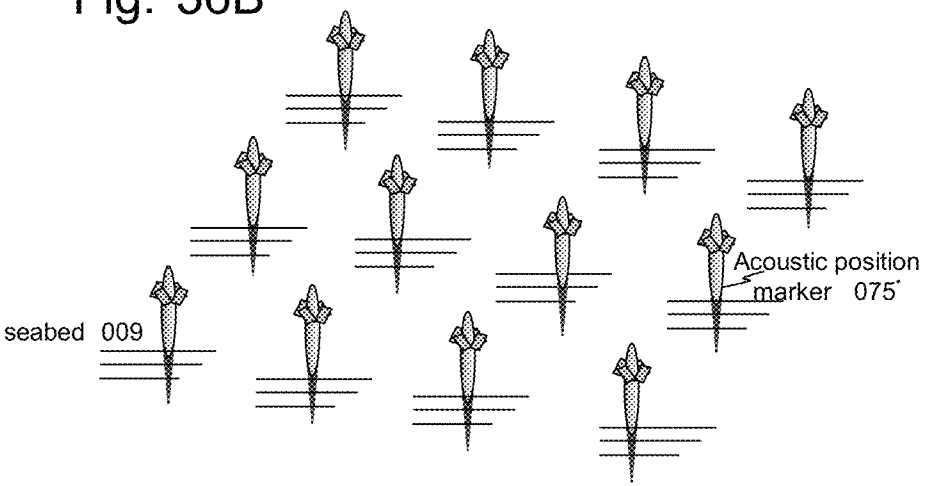
FIG. 36B is an overview acoustic position marker field.
Figure 39A:
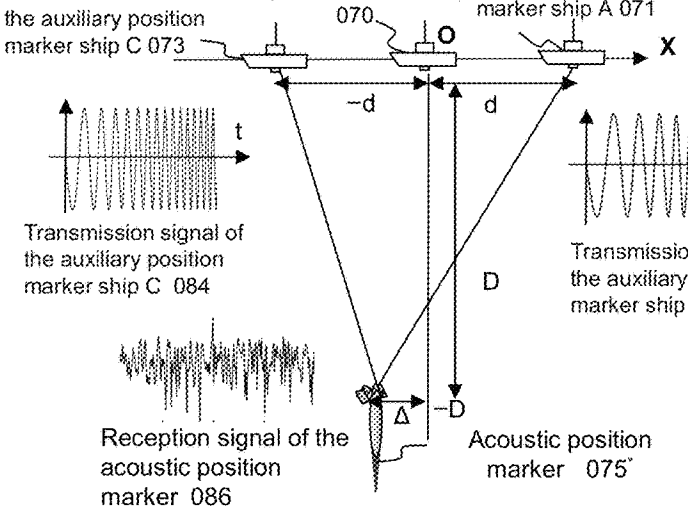
FIG. 39A is a diagram showing the guidance logic of the acoustically guided acoustic position marker/sound propagation diagram.

As shown in FIGS. 36A and 39A water surface view (XY), auxiliary position indicator vessels A, C, B and D 071 to 074 are arranged, centered on the position indicator vessel 070 at distances d in the X-axis and Y-axis directions respectively, and acoustic oscillation is command-controlled from the position indicator ship 070 wirelessly.

The distance of d can be made large, when the acoustic position marker 075 moves toward the seabed, the auxiliary position marker ships A and C B and D can not oscillate at the same time. Therefore, the propagation path difference for 075 cannot be obtained.

The two sets of vibration source are needed to oscillate at the same time. In order to distinguish the received vibration, the oscillation frequencies of one pair of the auxiliary position marking ships A and C are made different, 2.0 kHz to 2.4 kHz and 2.6 kHz to 3.0 kHz of the chirp signal, respectively.

FIG. 39A is a vertical plane (XZ) diagram of the guidance. When the acoustic position marker 075 at the depth D is deviated by Δ from the vertical line, and the auxiliary position marker ship A071 and C073 are separated from the position marker 070 by d, the propagation path difference is calculated to be (Equation 001).

$$\text{Difference of propagation path length} \approx 4d\Delta/(D^2+d^2)^{1/2} \quad \text{[equation 01]}$$

Since the difference of propagation path is shown by (Equation (01), when the seabed depth is large, the installation error on the seabed can be reduced by increasing d. When d=100 m, a propagation path difference of 0.8 m can be ensured with an error of 10 m even for a depth of 5000 m, which is sufficiently practical.

Figure 39B:
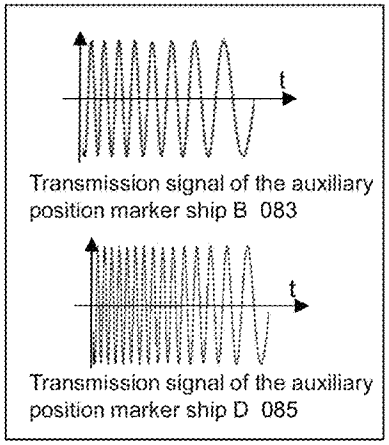
FIG. 39B is a diagram showing the guidance logic of the acoustically guided acoustic position marker/sound wave form.
Figure 39C:
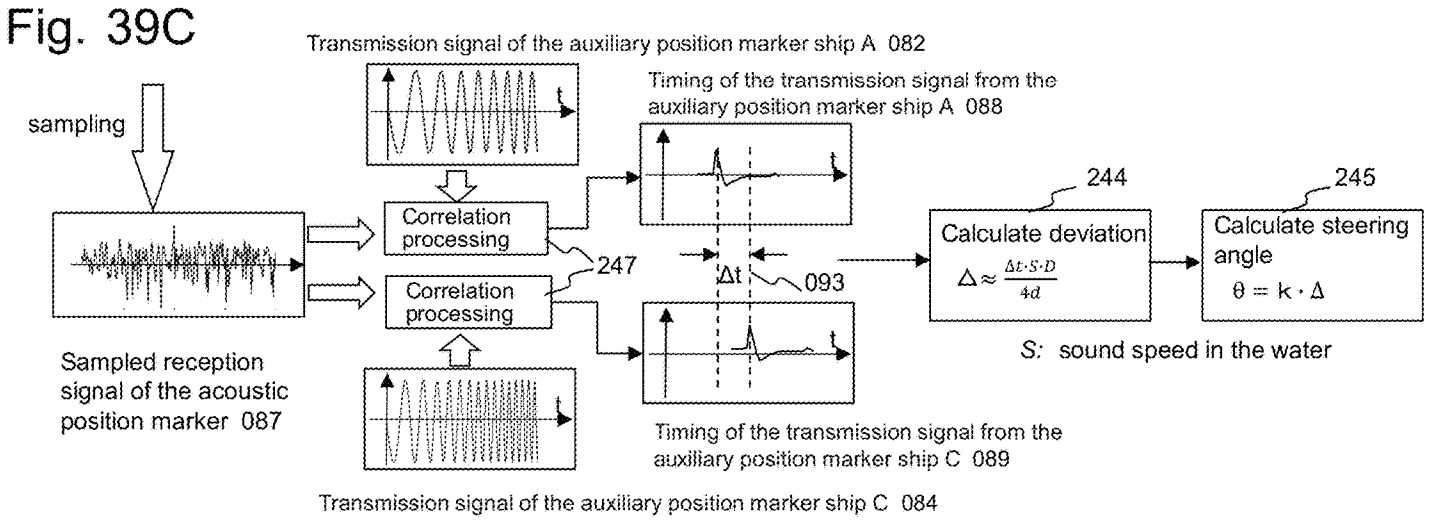
FIG. 39C is a diagram showing the guidance logic of the acoustically guided acoustic position marker/Signal processing logic.

The process block 662 guidance logic of FIG. 38C is as shown in the guidance logic of the acoustic position marker in FIG. 39A-C. The auxiliary position indicator ships A 071 and C 073 simultaneously oscillate acoustic signal 082 and 084 (FIG. 39C). In order to be identifiable by the acoustic position marker 075, the oscillating frequencies of the auxiliary position marker ships A and C and the auxiliary position marker ships B and D are made different, for example, 2.0 kHz to 2.4 kHz and 2.6 kHz to 3.0 kHz of chirp signal are respectively used. The transmission signal of the auxiliary position marker ship A 082 and the transmission signal of the auxiliary position marker ship C 084 are in linear increasing frequency, and in linear decreasing frequency. Thus, the deviation in the X-axis direction and the deviation in the Y-axis direction can be discriminated.

Although the sound propagation diagram in FIG. 39A is for obtaining the deviation in the X-axis direction, the same discussion can be made in the Y-axis direction. The auxiliary position marking ship A oscillating sound 082 and the auxiliary position marking ship C oscillating sound 084 are received as the acoustic position target sounding sound 086 by overlapping with the acoustic position marker 075 with a time shift due to the difference in the propagation distance. The received signal is digitally sampled, and the correlation calculation processing 247 performs correlation with each of the auxiliary position marker ship A's oscillation sound 082 and the auxiliary position marker ship C's oscillation sound 084 stored in advance in the ROM.

As a result, the auxiliary position marker ship A's oscillation sound timing 088 and the auxiliary position marking ship C's oscillation sound timing 089 can be obtained, and the difference between them is Δt 093 and the response delay of the auxiliary position marking ship C 023 and the acoustic position marker 075. Since the depth of the acoustic marker 075 is known, the X-axis component of the deviation A from the vertical line can be obtained from the processing block 244. Based on this deviation, the X-axis control amount is obtained in the processing block 245, and the X-axis control wing 076 and the Y-axis control wing 077 are operated to eliminate A. The same process is performed for the Y axis, and the X axis and the Y axis are alternately processed to perform guidance control.

Figure 40B:
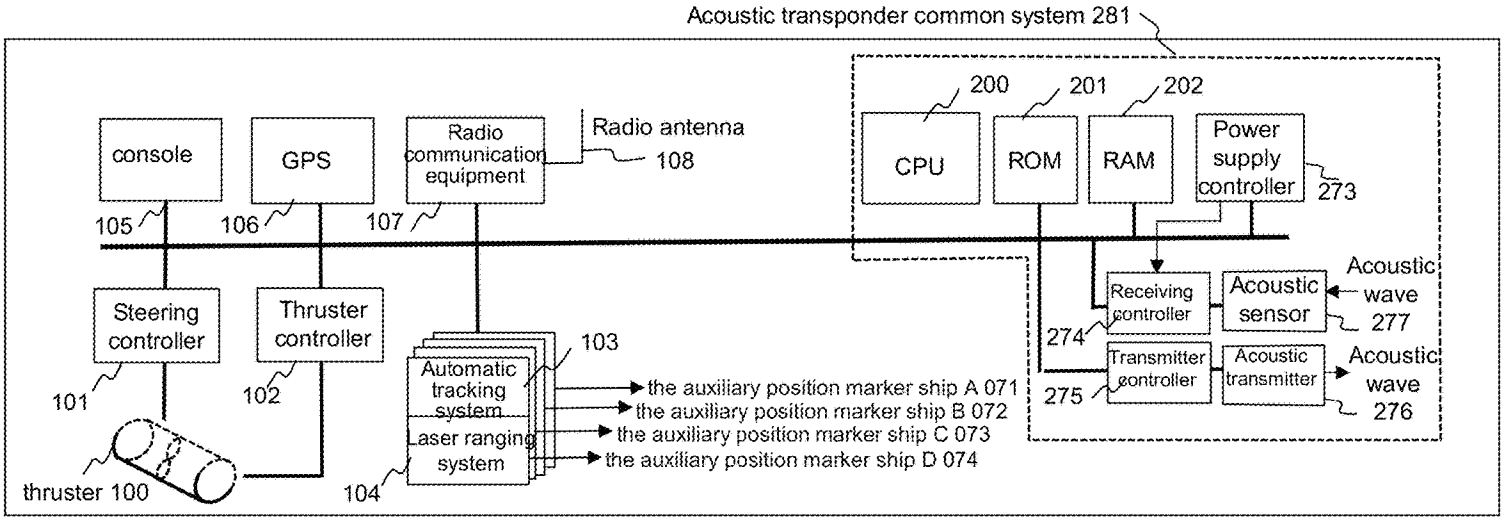
FIG. 40B is a diagram showing a position marker ship 071.
Figure 40C:
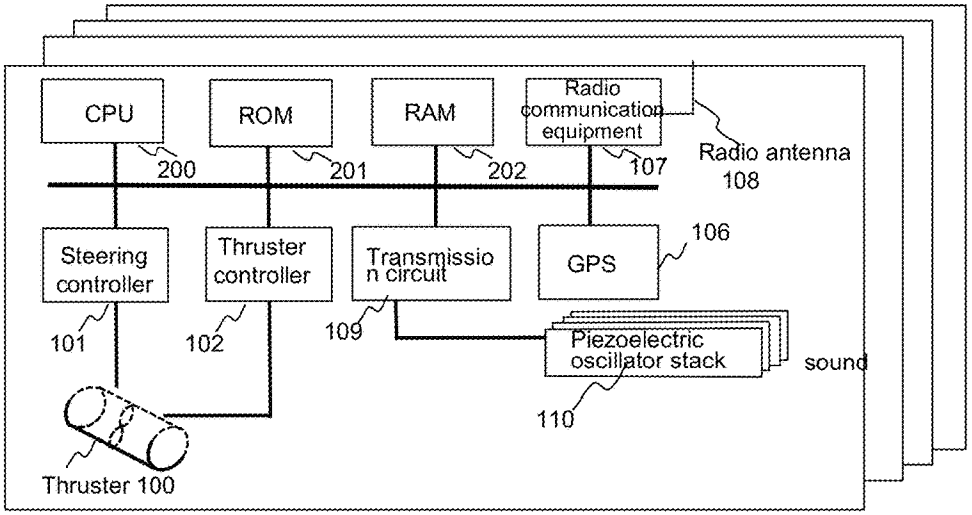
FIG. 40C is a diagram showing auxiliary position marker ships.
Figure 40A:
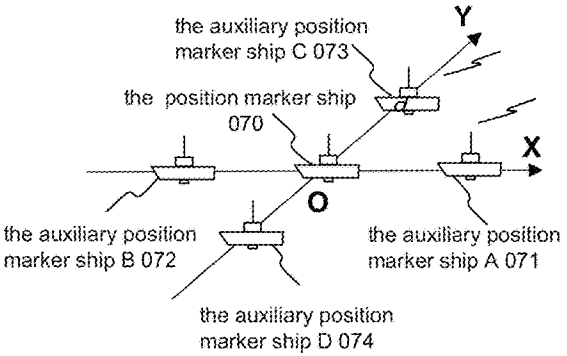
FIG. 40A is an overview of an operation of installing acoustic position markers.

As shown in FIG. 40A, the position marker ship 070 is placed on the sea surface at the latitude and longitude where the acoustic position marker 075 is installed, and the auxiliary position marker ship A 071 is located at both sides in d m apart in the orthogonal X axis and Y axis directions. The auxiliary position marker ships C073, D074, A071, and B072 are deployed. The position-marking vessel 070 is assumed to be a small boat that is operated offshore when laying an acoustic position-marker, and the auxiliary position-marking vessels A, B, C, and D are assumed to be unmanned self-propelled boats.

FIG. 40B shows a control system for the position marker ship 070, which has the following four functions.

(1) Fixed point maintenance function for specified latitude and longitude (2) Fixed point holding monitoring and control command function for the auxiliary position marking ship A071, the auxiliary position marking ship B072, the auxiliary position marking ship C073, and the auxiliary position marking ship D074

(3) Precise guidance mode oscillation command function for the auxiliary position marking ship A071, the auxiliary position marking ship B072, the auxiliary position marking ship C073, and the auxiliary position marking ship D074

(4) Tracking and monitoring function for the acoustic position marker 075

(1) Fixed Point Maintenance Function for Specified Latitude and Longitude

The direction and propulsive force of the thruster 100 are controlled by the directional control device 101 and the propulsive force control device 102 to match the current position latitude/longitude measured by the GPS 107 with the target position latitude/longitude specified by the deep sea crane console 210. Since the thrust of the thruster 100 is at a level capable of holding its own position against disturbances such as tidal currents, the position marker ship 070 is operated to move to the target position. The CPU 200 carries out the processing of FIG. 41D.

(2) Monitoring Fixed Point Retention Holding and Command Control Functions for the Auxiliary Position Marker Ship A071, B072, C073, and D074.

The auxiliary position marker ship A071, B072, C073, and D074 are lowered from the position marker ship 070 to the sea surface and deployed to fixed positions. Until the deployment, it can be realized by the technology of remote-controlled boat that is publicly implemented. After reaching the vicinity of the predetermined position, the positions of the auxiliary, position marking ships A to D are periodically measured in the processing block 587 by the function of FIG. 41C, and the deviation from the fixed position is calculated in the processing block 588. The processing block 589 calculates the movement order, and the processing block 589 transmits the movement order to each of the auxiliary position marker ships A to D via the wireless communication device 107. Processing block 591 is a timer setting for periodic execution. The laser distance measurement and laser azimuth measurement of the processing block 587 are assisted by locating the auxiliary position marker ships A to D by the laser position locating device 104, then locking on and tracking by the automatic tracking device 103. Even if the position marker ships A to D disturb their positions due to tidal currents and waves, the laser position locator 104 can continue tracking, and the distance and direction of the auxiliary position marker ships A to D can be continuously and automatically acquired. Such automatic tracking devices have been publicly implemented.

The movement order, which is transmitted to each of the auxiliary position marker ships A to D by the wireless communication device 107, is received by the processing block 581 in FIG. 41G, while the processing block 582 determines the own ship position from the measured value of the GSP 106. The accuracy of GPS has improved to 6 cm, and if such GPS is available, instead of tracking by the laser position locator 104 and the automatic tracking device 103, the latitude/longitude position is determined by the GPS 106 in FIG. 40C. Measurement is performed, and the own ship position location value by GPS is used in processing block 584 of FIG. 41G. A processing block 584 calculates a movement order, a processing block 585 obtains a thruster control command, and the directional control device 101 and the propulsion force control device 102 of FIG. 40B,C controls to a fixed position.

When the position of the position marker ship shown in FIG. 40A is held, the acoustic position marker 075 can be guided to the seabed in the guidance mode. The position marker ship 070 in FIG. 40B is initialized in FIG. 41A. In the processing block 579, the guidance can be enabled when the certain depth D m is exceeded (FIG. 41E). This is because until the depth exceeds a certain depth D m, the angle of the propagation path of the sound wave with the sea surface is small and accurate guidance cannot be performed. In FIG. 41F, the acoustic position marker 075 is controlled so that the auxiliary position marker ships A, B, C and D oscillate acoustic signals. Since the oscillation is periodically performed, a timer is set in the processing block 602 to periodically activate the timer. At processing block 595, it is determined whether the guidance is eligible. This is because the sounding body is installed at a horizontal distance d, and unless a certain depth is provided, the sound wave has no straightness and cannot be guided. The processing block 596 determines whether the positions of the auxiliary position marker ships A, B, C, D are settled, and if the positions are settled, acoustic oscillation is performed. The processing blocks 597 to 601 are for alternately oscillating the group of the auxiliary marker ships A and C and the group of the auxiliary marker ships A and D, and alternately measuring and guiding the deviation between the X axis and the Y axis.

4.2 Installation by Inertial Guidance

An inertial navigation sensor that uses a solid vibrating body as a position sensor and an acceleration sensor can be used as a small-sized, low-cost solid package for smartphones and robots. If the error accumulation due to the descent time is within a range that does not cause a problem, inertial navigation that can simplify the system can be used. FIG. 45 shows a method of installing an acoustic position marker by inertial guidance. First, in (b-1), an acoustic position marker is hung from a position marker ship 070 capable of accurately measuring latitude and longitude by a rope to settle it, and an inertial navigation sensor is initialized. When the hanging rope 113 is cut, it descends along the vertical line 111 toward the seabed as shown in (b-2). The X-axis steering wing 076 and the Y-axis steering wing 077 control not to deviate from the vertical line 111, and trace the acoustic position marker descent path 112 to penetrate the seabed 009.

The external shape of the inertial guided acoustic position marker is the same as that of the acoustically guided acoustic position marker (FIG. 37) although a position acceleration sensor 295 is added as shown in FIG. 46.

Figure 47A:
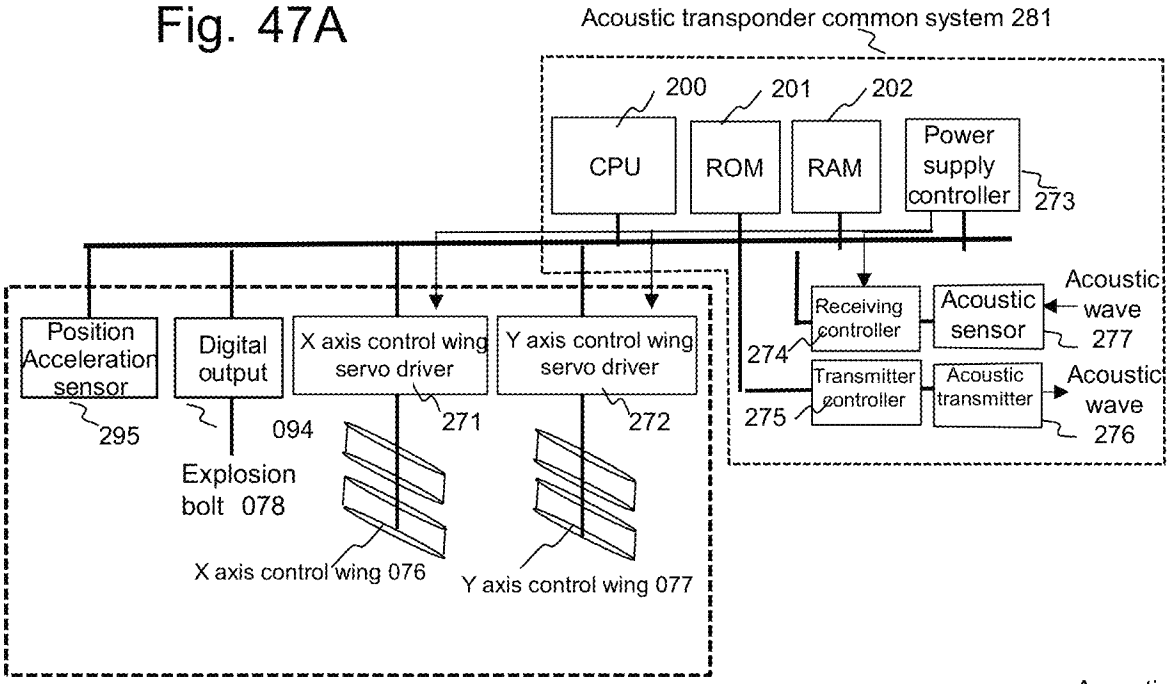
Figure 47C:
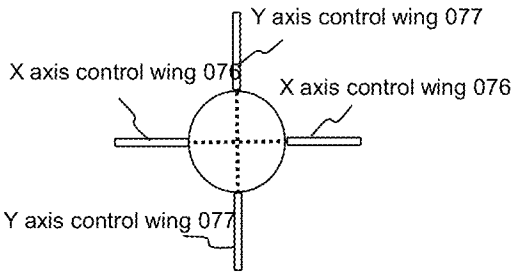

FIG. 47 shows the configuration of the control device for the inertial guidance acoustic position marker. While the position & acceleration sensor 295 is added as compared with FIG. 38C, the process of the guidance logic of the acoustic guidance shown in FIG. 39 can be omitted. When the guidance logic of FIG. 39 is processed by software, the software executed by CPU 200 should be changed (deleted).

Figure 42B:
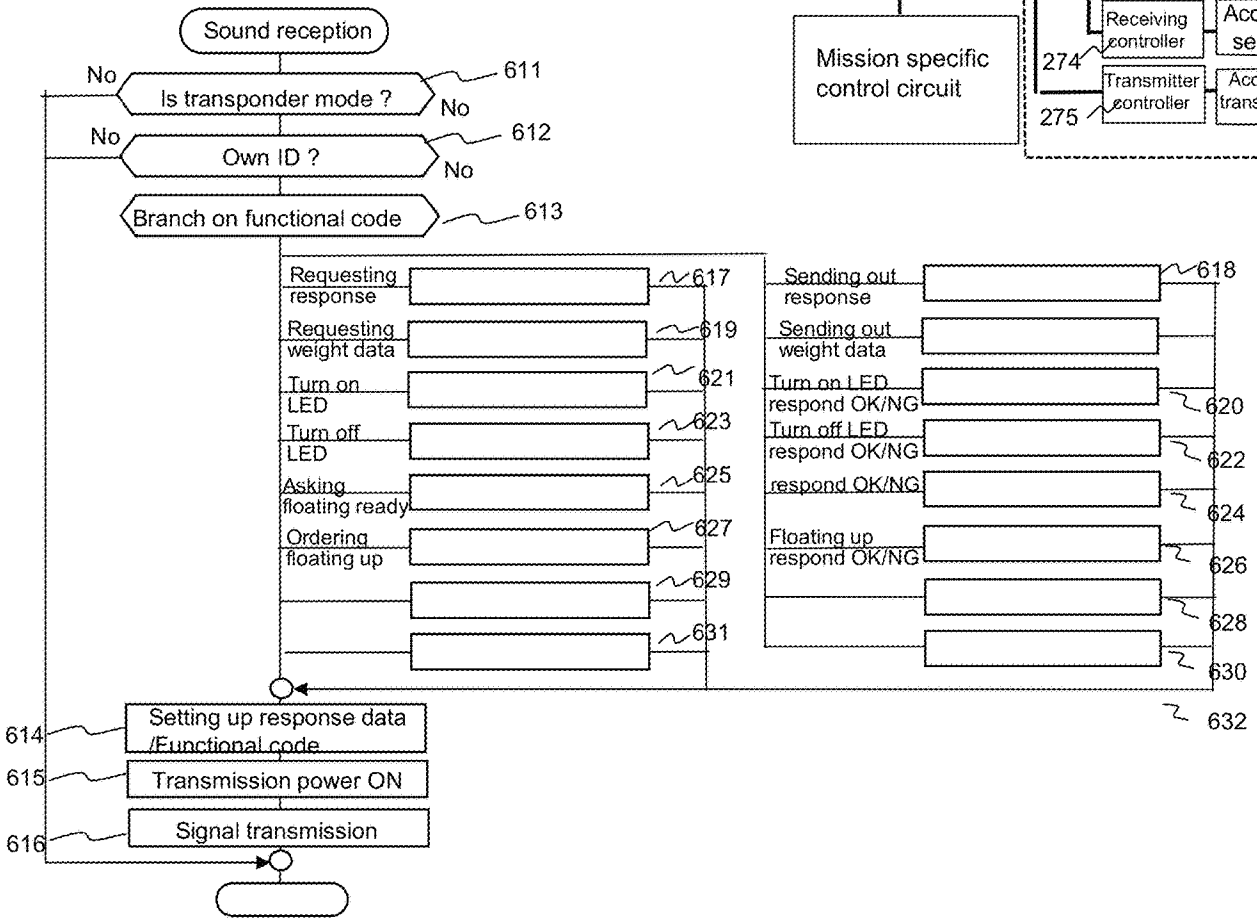
FIG. 42B is a diagram showing flow of transponder common system.
Figure 47B:
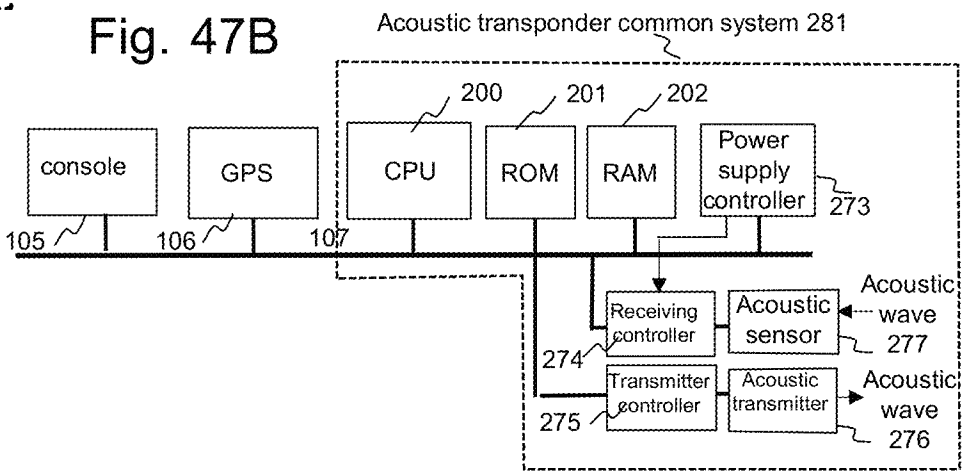
Figure 48B:
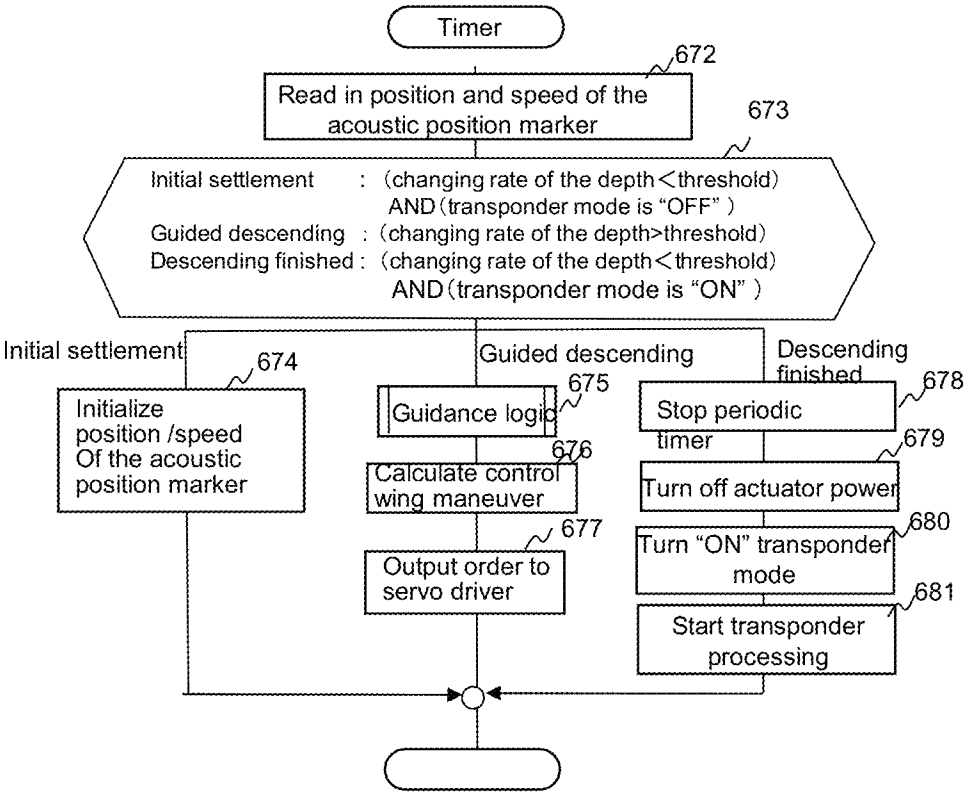
Figure 48A:
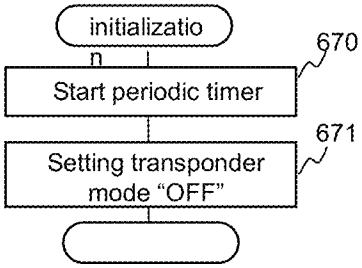

FIG. 48A and FIG. 48B define the processing flow of the inertially guided acoustic position marker control device. Prior to FIG. 45B, the initialization process of FIG. 48 A is executed once. After the periodic timer of the processing block 670 is started, FIG. 48B the acoustic position marker guiding process is started. In the process block 672, the state value of the position acceleration sensor 295 is read, and when there is no depth change in the process block 673, the initialization of the position/velocity variable of the acoustic position marker is repeated corresponding to FIG. 45B. Since the depth changes when the suspension cord is cut in FIG. 45C, the process branches to descent guidance at a processing block 673. The guidance logic of the processing block 675 obtains the deviations in the X-axis direction and the Y-axis direction from the vertical line 111, and the control order is calculated in the processing block 676 by the control logic including the well-known PID control. Output to the servo system is performed in a processing block 677, and the control wing is driven by the X-axis control wing servo driver 076 and the Y-axis control wing servo driver 077 in FIG. 47A. When the acoustic position marker reaches the seabed 009 in FIG. 45D, the depth does not change, and the cycle timer is stopped in processing block 678 in FIG. 48B to stop the guidance processing. After the guidance control is stopped, since it functions as an acoustic transponder, the actuator power is turned off in processing block 679 to start the transponder processing (FIG. 42). The processing of the position marker ship 070 that installs the inertially guided acoustic position marker is shown in FIG. 49A. FIG. 47B shows the hardware, in which the precise latitude/longitude is taken in by the GPS 106, and the latitude/longitude is continuously taken in from the GPS 106 in the processing block 683 while the hanging rope 113 is not cut, and the information is updated (processing. Block 684). When the hanging rope 113 is cut, it is set that the hanging rope 113 is cut on the console 105 (PC keyboard) in FIG. 47. Once the suspension cord 113 has been cut, the transponder is periodically activated for monitoring (processing block 685). Response requests are sent periodically until there is a response from the acoustic position marker installed in FIG. 49B. FIG. 49C is activated when there is a response signal from the installed acoustic position marker, and if the ID matches the interrogating ID, it is determined that the installation is complete, and the acoustic position marker ID, latitude/longitude, and installation time are registered. (Input to the deep sea crane monitoring control system 209 of the surface command ship 010 using a USB memory or the like)

II. Navigation System

1. Composition Principles

In the lift-off using the buoyancy of the present invention, the deep-sea crane 001 which is a lift-up device autonomously travels between the starting point and the arrival point (the surface ship on the sea surface and the point on the seabed) by the control technology. It eliminates the need for mechanically connected structures such as pipes, and relaxes the mechanical constraints required for the system.

There are the following physical properties in the sea:

(1) In the sea, radio waves with straightness cannot be used and GPS cannot be used as a position sensor.

(2) The error of the inertial position sensor increases with time after initial setting (3) The magnetic compass can be used if the pressure resistant shell is not the magnetic body.

(4) Sound waves with good propagation in the sea are not suitable for distance measurement and target azimuth detection when they deviate from the vertical direction.

(5) Optical distance measurement is indispensable for precise position measurement, but there is no guarantee of visibility in the sea except in the immediate vicinity. Furthermore, the movement of the seabed resources is mainly in the vertical direction, and the distance is as short as 6.5 km at most, but the landing point control is characterized by the requirement of meter order accuracy. In addition, although the navigation control requires a large amount of information to be transmitted, optical fiber communication is suitable because a radio wave does not pass through the sea and a sound wave with good propagation has a small amount of information capacity. Sensors that can be used underwater include (1) inertial position sensor, (2) depth gauge, (3) acoustic sensor, (4) optical sensor, and (5) geomagnetic sensor. For navigation control using these, There are inertial navigation, acoustic navigation, and optical navigation, these sensors are used in combination with the characteristics of navigation.

Figure 16B:
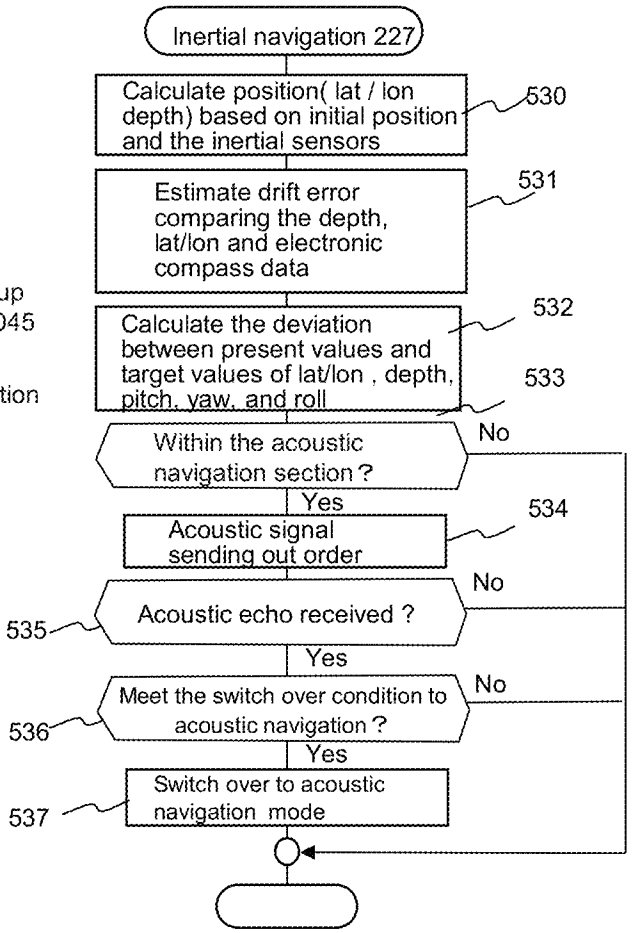
FIG. 16B is a diagram showing a processing flow of an inertial navigation system.
Figure 16A:
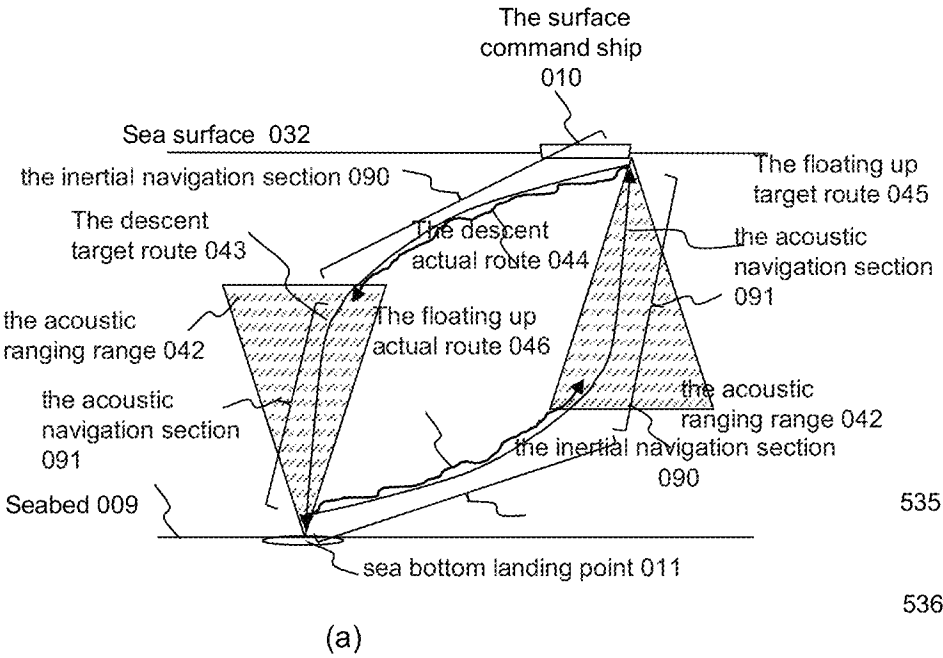
FIG. 16A is a diagram showing an navigation strategy of a deep-sea crane.

FIG. 16A shows the entire navigation control for the deep sea crane 001 to reciprocate between the surface command ship 010 and the landing point 011.

During the inertial navigation section 090, less time has passed since departure and the initial position can be accurately known. Therefore, the inertial sensor, depth gauge, and geomagnetic sensor (magnetic compass) are used together to determine the position/speed/attitude and the descent target. It is guided so as to minimize the deviation from the path 043. In the descent target route 043, the inertial navigation section 090 first approaches the range just above the landing point on the seabed, which is the target at the time of descent, and in the ascent target route 045, it first approaches directly below the target maritime command ship 010.

In the succeeding acoustic navigation section 091, the influence of the bending of the sound my due to the undersea temperature distribution is eliminated by reducing the deviation from just below and above the target when descending and when ascending. When the deep-sea crane 001 floats on the sea surface 032, as the sea water is almost stopped at the sea bottom, the disturbance to the position and speed is small there, but on the sea surface, it is necessary to consider the relative motion of the waves near the surface command ship. In order to avoid the effects of sea waves, it is possible to concentrate in the lift up work when the sea climate is calm, and to concentrate on the sea bottom work when the sea weather is not suitable.

3. Navigation Control System

Figure 14:
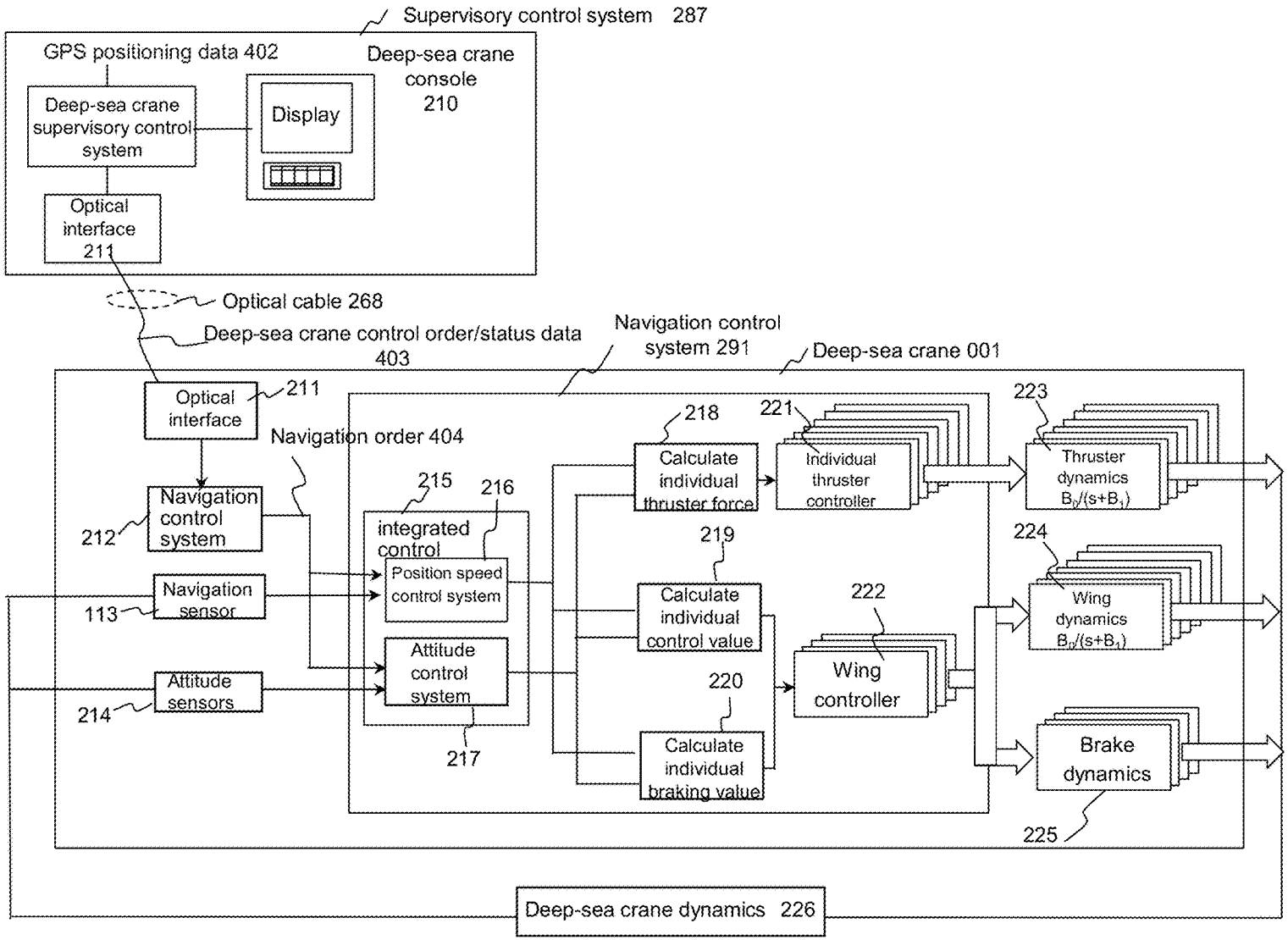
FIG. 14 is a diagram showing a block diagram of a supervisory control system.
Figure 15:
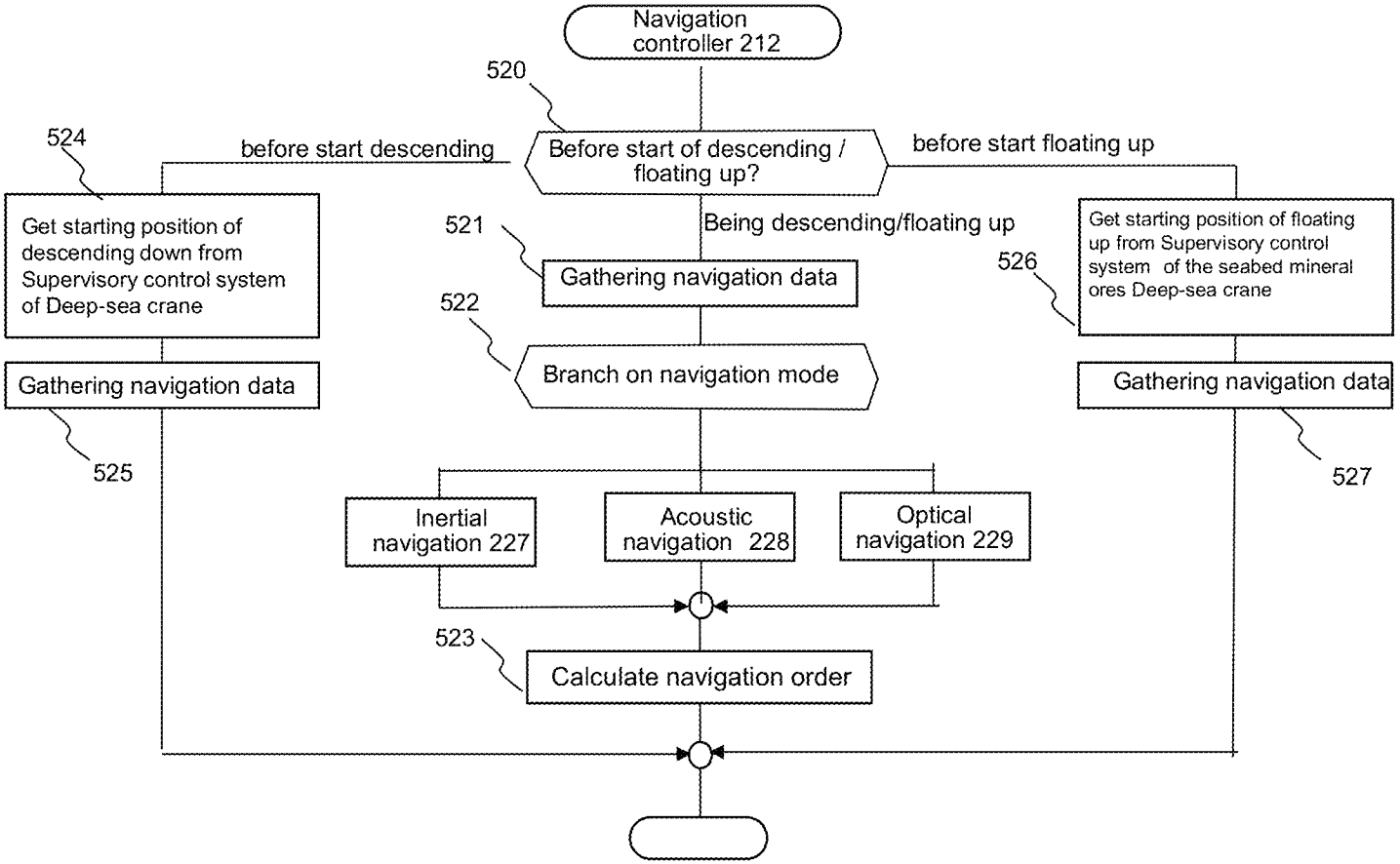
FIG. 15 is a diagram showing a processing flow of an navigation control system of the deep-sea crane.

The navigation control system 212 in FIG. 14 operates according to the operation flow chart of the navigation control system in FIG. 15.

In processing block 520, it is determined whether the deep sea crane 001 leaves the surface command ship 010 before or after the surface command ship 010 is separated. In FIG. 14 the GPS positioning data 402 of the supervisory control system 287 is acquired as initialization data. If the deep sea crane 001 has not yet started floating from the seabed, the processing block 526 in FIG. 14 sets the position data held by the deep sea crane 001 as the initialization data. After the ascent or descent is started, the inertial navigation system will take measures to prevent the accuracy from deteriorating over time due to drift accumulation. At processing block 521, navigation data including an inertial sensor, a digital compass, and a depth gauge is acquired. At process block 522, a branch is made according to the navigation mode (inertial navigation, acoustic navigation, optical navigation). The navigation command 404 is given to the integrated control 215 of the operation control system 291 in the processing block 523.

The default setting at the start of ascent or descent is inertial navigation.

4 Inertial Navigation

The operation of the inertial navigation system is described in FIG. 16. The pitch, yaw, and roll shown in FIG. 23A are assigned to the deep-sea crane 001. Since GPS cannot be used underwater, inertial navigation will accumulate position errors due to drift over time after initialization to the standard coordinates. For this reason, it is used at the initial stage where drift does not accumulate during both ascent and descent (inertial navigation section 090), the deep-sea crane 001 is brought close to the target as much as possible in the horizontal plane, and the acoustic navigation of the next stage is performed to reach the target making sure the proximity is directly above or below. By making the sound wave propagation path closer to the vertical, the influence of refraction of sound wave propagation is eliminated. In the early stage of the path, while the inertial sensor drifts is small, the deep sea crane descends down or ascends up directly above or below the target, and then switches to acoustic guidance to minimize refraction of sound wave propagation due to seawater temperature distribution.

The process of inertial navigation 227 follows the process flow of the operation of the inertial navigation system shown in FIG. 16B. Since GPS cannot be used, the current position is calculated by adding the moving distance obtained by the inertial navigation system to the initial position obtained at processing block 524 or 526 in FIG. 15 (processing block 530). In processing block 531, the drift of the inertial navigation sensor is estimated from the moving direction obtained from the depth system data and the electronic compass. In processing block 532, the maximum likelihood latitude/longitude depth, velocity, and attitude corrected by the drift estimated value are obtained, and the deviation from the target route is further obtained.

In consideration of the refraction of the sound wave propagation path, the acoustic distance measuring range 091 has a cone that is directly above or directly below the final target point (sea bottom landing point 011 when descending, surface command ship 010 position when ascending) with high level of propagation straightness. In FIG. 16B when it is confirmed in processing block 533 that deep sea crane 001 has entered the acoustic ranging range 042 in the inertial navigation system, processing block 534 issues a sounding command to acoustic navigation system 228. A processing block 535 receives and confirms an echo from an acoustic position indicator (transponder) installed at the target point, and a processing block 536 confirms that the signal level exceeds the threshold value and the distance is equal to or less than the threshold value. At block 537, switching to the acoustic navigation mode is performed.

5 Acoustic Navigation

Figure 19:
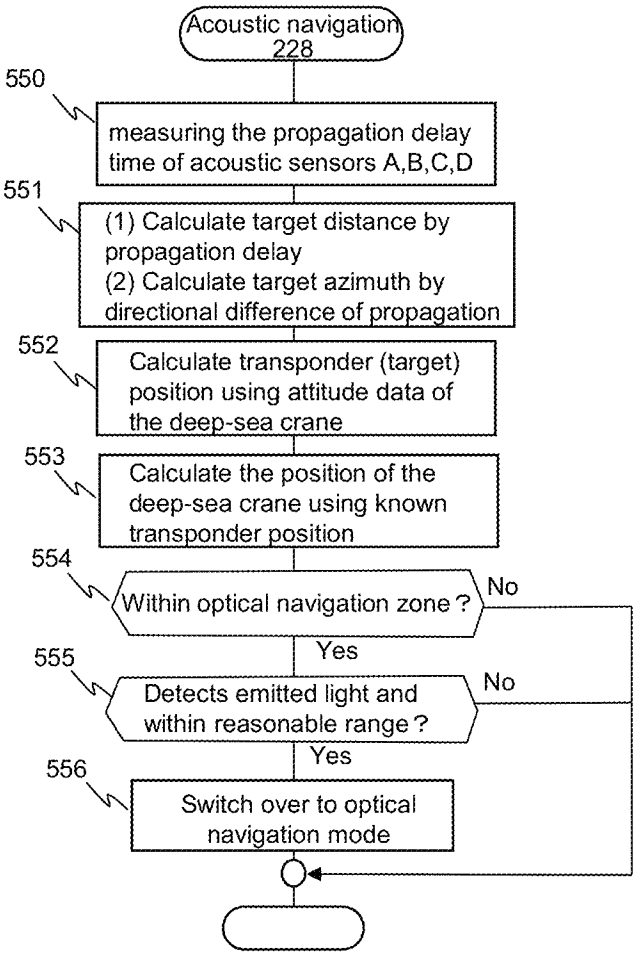
FIG. 19 is a diagram showing processing flow an acoustic navigation.

The principle and method of realizing acoustic distance measurement are described in FIGS. 17-19.

The acoustic sensors A to D 231 to 234 and the sound generator 230 are arranged on the top of the deep sea crane 001 (FIG. 17A) and the bottom of the deep sea crane 001 (FIGS. 17A, 17B and 17C). The acoustic navigation is used in the acoustic navigation section 042 of FIG. 16 succeeding to the inertial navigation. This is because there is an error in position localization because the straightness of sound waves is not guaranteed due to the temperature distribution of seawater.

It is suitable to use the acoustic navigation in the medium and short distance range, because the light does not reach anywhere except the immediate vicinity in the sea. The temperature distribution of seawater exists in the depth direction, but is generally uniform in the horizontal direction. When positioning with a target using a transponder, the azimuth in the horizontal direction can be grasped relatively accurately, but the error in the vertical direction increases as the angle with the vertical direction increases. If the sound wave propagation is more than 20° away from directly above or below, the sound wave will not reach the target reliably.

The principle and implementation method of the acoustic navigation 228 in FIG. 15 are shown in FIG. 17B,C. The acoustic sensors A 231, B 232, C 233, and D 234 are installed on the surface 292 of the traveling direction of the deep sea crane 001. A Sound generator 230 is installed at the center of them, and when the acoustic navigation section 091 is entered, a sound is generated periodically. When the transponder installed at the arrival target (seafloor landing position) returns an echo, there is a time lag in arrival of the echo signal with respect to each of the sound sensors, as shown in FIG. 17B,C. In FIG. 17B, the echo from the transponder 236 reaches the acoustic sensor C 233 on the acoustic propagation front 1 237 and reaches the acoustic sensor A 231 on the acoustic propagation front 2 238, causing a time shift. FIG. 18 shows this situation three-dimensionally. It shows that the transponder azimuth vector 239 is obtained by calculation from the deviation of the arrival time of the echo signals to the four acoustic sensors A to D 231-234 surrounding the origin O on the XY plane. The distance to the transponder 236 can also be obtained from the difference between the sounding time and the arrival time of each echo. If the sound source is a point, the calculation is not easy, but if the sound source is sufficiently far compared to the distance between the acoustic sensors, it can be treated as a sound source of the plane, and it is relatively simple to calculate its direction and distance. Acoustic distance measurement uses the same principle as active sonar, but firstly it is not necessary to create an image of the target, and secondly a transponder can be installed on the target, and thirdly the purpose is to guide directly below or above the target, and fourthly system simplification and lower output power are possible because the precise target orientation is left to optical navigation.

FIG. 20 shows the configuration and operation of a device used in acoustic navigation.

Figure 20A:
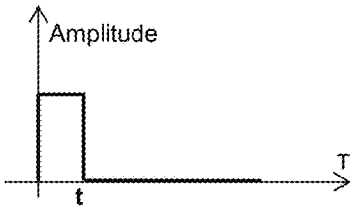
FIG. 20A is a diagram of an acoustic transmission signal pattern.
Figure 20B:
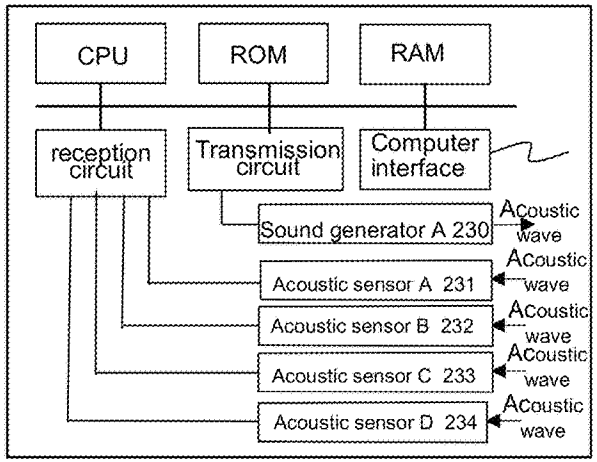
FIG. 20B is a diagram showing a block diagram of a acoustic navigation system 141.
Figure 20C:
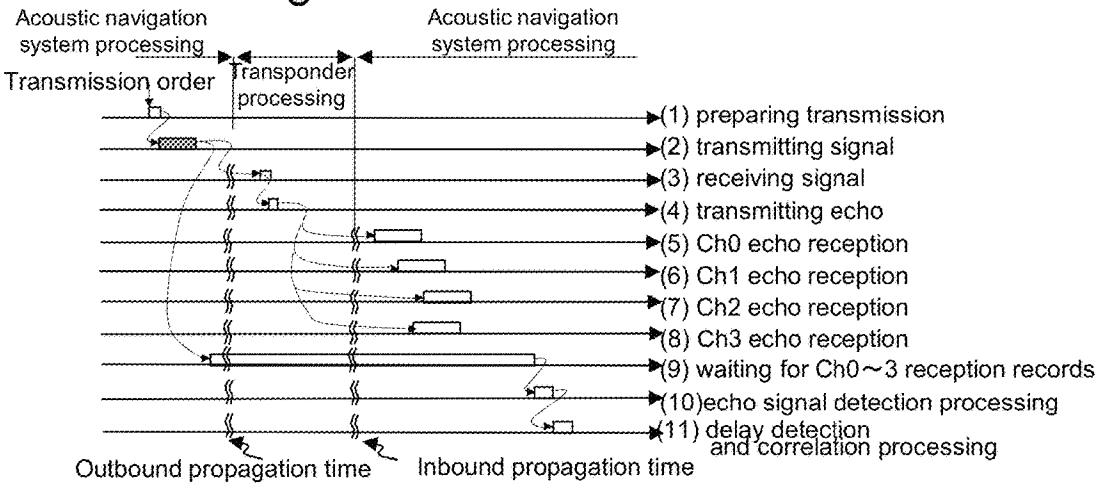
FIG. 20C is a time chart of an acoustic transmission/reception sequence.
Figure 20D:
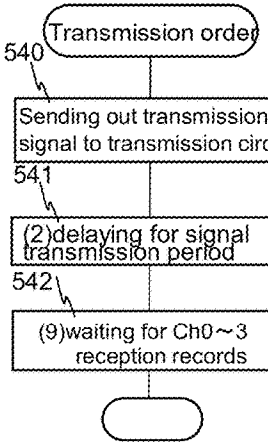
FIG. 20D is a diagram showing processing flow 1 of an acoustic distance measurement.
Figure 20E:
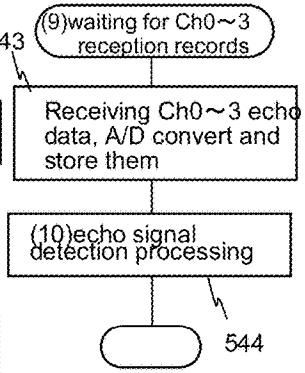
Figure 20F:
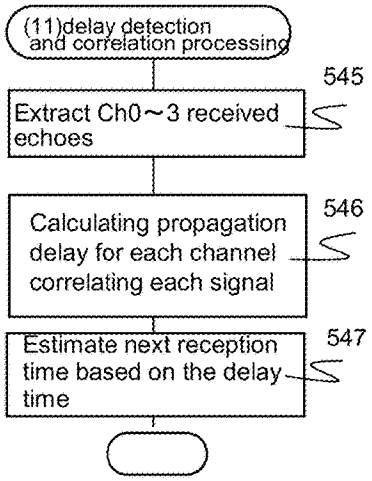

In FIG. 20B piezoelectric ceramics are widely used in active sonars as the sound-sensors A to D 231-234 and the acoustic generator 230 for the acoustic navigation device. Recently, high-power piezoelectric ceramics have been marketed as general consumer demand. A vibration transmission signal pattern in constant frequency and voltage in FIG. 20A is applied to the piezoelectric vibrator to oscillate a sound wave. In FIG. 20B, the vibration transmission and the vibration reception are performed by different piezoelectric elements, but they may be shared. In order to control the deep sea crane 001, the acoustic navigation system in FIG. 20B is installed in the deep sea crane 001, and the transponder in FIG. 42 is installed on out side of the surface command ship 010. The operation of the acoustic navigation is as described in the processing sequence of FIG. 20C, and the acoustic navigation device performs (2) signal vibration according to the vibration command from the navigation control system. After the forward propagation time, the transponder detects (3 vibration reception and immediately transmits (4) echo vibration. After the return propagation time. (5) to (8) Ch0 to 3 echoes are received by the acoustic navigation device 141. Immediately after transmitting the vibration, the CH0-3 data is recorded waiting in (9). Correlation between the recording data while waiting and the transmitted source signal is performed in (10) and (11) to obtain the propagation delay time for each of the acoustic sensors (FIG. 20D to 20F) Processing flow 1 to 3)

FIG. 19 is a processing flow describing the operation of the acoustic navigation system using the acoustic navigation device. In FIG. 20, processing block 546 and processing block 550 acquire the round-trip sound wave propagation delay of each acoustic sensors A, B, C, and D. and processing block 551 obtains the distance from the target from the average delay time of each sensor and the sound velocity in the sea.

A case where the sound source is approximated by a surface sound source will be described in detail with reference to FIGS. 18A to 18C.

In FIG. 18A, the transponder azimuth vector 239 indicates the sound wave intrusion direction, and the angle formed with the XY plane is φ, and the angle formed with the projection on the XY plane with the X axis is 0. In FIG. 18 AB is the arrival direction of the acoustic wave, and FIG. 18B is a view seen from above the Z axis. FIG. 18C is a sectional view of FIG. 18B taken along a plane including the acoustic wave arrival direction AB and the Z axis, and shows the relationship between the acoustic wave propagation path and the delay time with respect to the acoustic sensors A to D 231 to 234.

If the sound reception time (seconds) of the acoustic sensors A to D 231-234 are ta, tb, tc, and td, respectively, and the sound velocity in the sea is s m/sec.

Then, based on the propagation distance between the acoustic sensors A and C due to the time difference of propagation, and the propagation distance between the acoustic sensors B and D due to the time difference of propagation, the followings are obtained.

$$(t_c - t_a)s = r\cos\varphi\cos\theta \qquad \text{[equation 02]}$$

$$(t_d - t_b)s = r\cos\varphi\sin\theta$$

$$\cos\varphi = \pm\frac{s}{2r}\sqrt{(t_c - t_a)^2 + (t_d - t_b)^2}$$

$$\sin\theta = \pm\frac{(t_d - t_b)}{\sqrt{(t_c - t_a)^2 + (t_d - t_b)^2}}$$

Then, the processing block 551 is obtained. In Equation 02, cos φ=0 and sin θ cannot be obtained unless there is a propagation delay time difference with respect to the sound sensor, cos φ=0 means that the control purpose is achieved because the transponder is directly below or above.

In processing block 552, the transponder azimuth is corrected based on the attitude data obtained from the inertial sensor, and in processing block 553, the position of the deep sea crane 001 on the sound generator side, which is the control target, is obtained from the known transponder position.

6 Optical Navigation

Especially on the seabed, the reaching distance of light is shortened by the mud that rolls up, but since accurate positioning is possible at a short distance of 10 to several meters or less. LED light emitting devices can be used for precise position control. The principle of optical navigation will be described with reference to FIGS. 21(*a*) (*b*) (*c*) (*d*). When the imaging device 235 detects the light emitted from the light emitting devices A to D 240 to 243 of the capture ring 037 by the imaging device 235 at the tip of the lifting hook 047 of the cargo room 005 of the deep sea crane 001, then the process shifts to optical navigation 229.

Figure 24E:
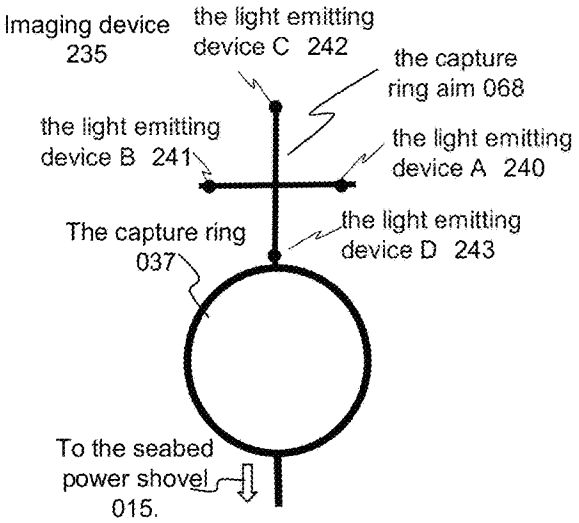
FIG. 24E is a drawing showing a rendezvous target.

Since the capture rings of the light emitting devices A to D 240 to 243 are used for pulling up the seabed mineral ores collecting device 015 (electric power shovel) and the seabed mineral ores collecting container 034, it may be assumed that they are in the vertical relationship as shown in FIG. 24E.

The imaging devices 235 are installed above the lifting hook 047 of the cargo compartment 005 of the deep-sea crane 001, and are installed in a horizontal plane at a right angle of 90 degrees apart so that one of the four imaging devices 235 can capture light emitting devices A to D 240 to 243.

When the central axis of the imaging device 235 is shifted;

(1) to the light emitting devices AB side, then (d3) in FIG. 21C is imaged.

(2) to the light emitting devices BC side, then (d4) in FIG. 21C is imaged.

(3) to the light emitting devices CD side, then (d1) in FIG. 21C is imaged.

(4) to the light emitting devices DA side, then (d2) in FIG. 21C is imaged.

When the central axis is not displaced, the image of (d0) in FIG. 21C is obtained.

FIG. 21B shows the principle of optical navigation. The imaging device 235 installed at the tip of the lifting hook 047 is an ordinary electronic camera, and it is assumed that the viewing angle is 90° at 1000×1000 to 4000×4000 pixels. FaFbFcFd in FIG. 21B is the imaging surface 293, and the images of the light emitting devices A to D 240 to 243 are formed as shown in FIG. 21C.

In the optical navigation in FIG. 21 and FIG. 22 using the following data from (1) to (7):

(1) Pixel positions of images of the light emitting elements A to D 240 to 243 on the imaging surface 293

Figures 22A, 22B, 22C:
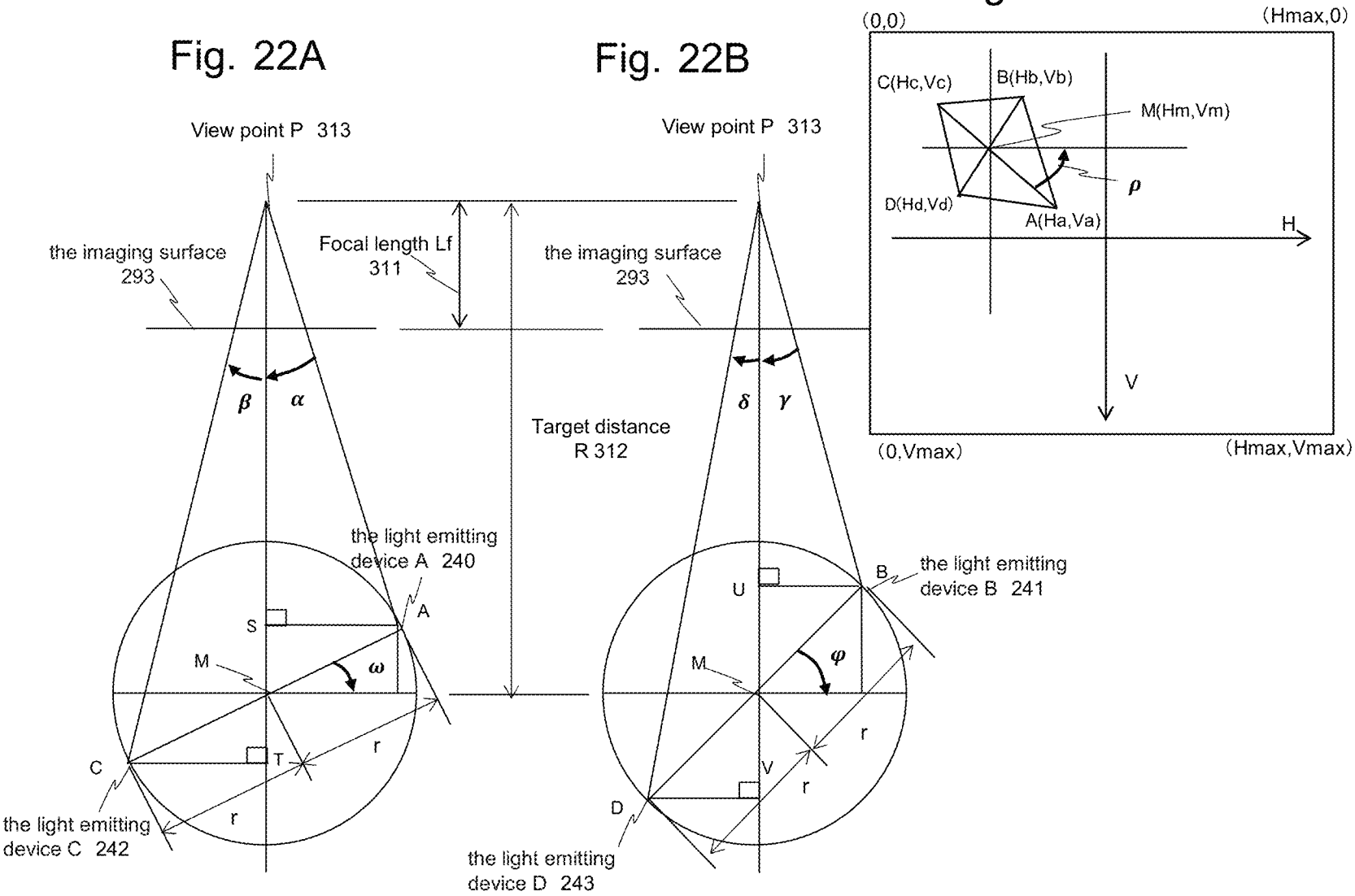
FIG. 22A is a diagram showing a principle of optical distance measurement using line segment AC.
FIG. 22B Is a diagram showing control force vectors.
FIG. 22C is a diagram showing imaged aim for an optical distance measurement.

Light emitting device A (Ha, Va), light emitting device B (Hb, Vb), light emitting device C (Hc, Vc), light emitting device D (Hd, Vd) in FIG. 22C (2) Identification information of light emitting elements A to D 240 to 243

(3) Focal length Lf 155 of the image pickup device 235

(4) Vertical and horizontal angle of view (αV, αH) and number of vertical and horizontal pixels (Vmax, Hmax) of the imaging device 235

(5) Angle β formed by the line AC connecting the light emitting devices A and C 240 to 243 with the XY plane (6) The angle γ formed by the line BD connecting the light emitting elements B and D240 to 243 with the XY plane (7) Angle δ that straight line BD makes with the Y-axis Then, the following data (A) and (B) can be obtained by the method described below, where the above (1) and (2) are measurement data of the imaging device 235, and (3) and (4) are unique data of the imaging device 235, which are all known.

(A) Position of deep sea crane 001 (latitude/longitude (LatT, LonT), depth (DpT))

(B) Posture of deep sea crane 001 (pitch pb, yaw yb, roll rb)

The above (A) and (B) are determined using quaterion.

Using the reference coordinate system, with XYZ axis; X axis: horizontal Y axis: vertical Z axis: front and rear, the position of the imaging device 235 is defined as P, and using a coordinate system (XbYbZb), the posture of the imaging device 235 is defined as Pb.

It is assumed that the capture ring aim 068 in FIG. 21B is rotated by the quaterion Qt with respect to the reference coordinate P and becomes the view coordinate Pt of the target direction vector 310.

$$P_i = Q_T P Q_T^* \quad \text{[equation 03]}$$

The capture ring aim 068 in this coordinate system is projected on the imaging surface 293 to obtain the image in FIG. 21C. Since the capture ring aim 068 is on a plane orthogonal to the Z axis of the reference coordinate P and is located at a position deviated from the Z axis of the reference coordinate P, the plane formed by the target orientation vector 310 and the capture ring aim 068 is not vertical. Details of the PAC and PBD of FIG. 21B are shown in FIG. 22 A,B.

A indicates the presence of the light emitting device A 240, and the same applies to BCD. M is the intersection of AC and BD. FIG. 22C shows the image forming coordinates of the imaging surfaces 293 of A, B, C, and D. In the HV coordinates, the upper left is (0,0) and the lower right is (Hmax, Vmax). The coordinates of the intersection M of the line AC connecting the light emitting devices A and C and the line BD connecting the light emitting devices B and D are given below.

$$\begin{bmatrix} H_m \\ V_m \end{bmatrix} = \begin{bmatrix} V_b - V_d & -H_b + H_d \\ -V_a + V_c & H_a - H_c \end{bmatrix}^{-1} \begin{bmatrix} H_d V_b \\ H_c V_c \end{bmatrix} \quad \text{[equation 04]}$$

In FIGS. 22A and 22B, when the angles for expecting line segments AM and MC are α and β and the angles for expecting line segments BM and MD are γ and δ from the viewpoint P, they are given by Equation 03. Here, R is the distance from the viewpoint P to the intersection M of AC and BD, r is the distance between the light emitting element and M, and ω and φ are the angles formed by the line segments AC and BD with respect to the plane orthogonal to the line-of-sight vector PM. Then, it is given by Equation 05.

$$\tan\alpha = \frac{r\cos\omega}{R - r\sin\omega}$$

$$\tan\beta = \frac{r\cos\omega}{R + r\sin\omega}$$

$$\tan\gamma = \frac{r\cos\varphi}{R - r\sin\varphi}$$

$$\tan\delta = \frac{r\cos\varphi}{r + r\sin\varphi}$$

$$R = \frac{r(\tan\alpha + \tan\beta)}{\sqrt{(\tan\alpha - \tan\beta)^2 + 4\tan^2\alpha\tan^2\beta}}$$

-continued or $$R = \frac{r(\tan\gamma + \tan\delta)}{\sqrt{(\tan\gamma - \tan\delta)^2 + 4\tan^2\gamma\tan^2\delta}}$$

taking the average $$R = \frac{1}{2}\left(\frac{r(\tan\alpha + \tan\beta)}{\sqrt{(\tan\alpha - \tan\beta)^2 + 4\tan^2\alpha\tan^2\beta}} + \frac{r(\tan\gamma + \tan\delta)}{\sqrt{(\tan\gamma - \tan\delta)^2 + 4\tan^2\gamma\tan^2\delta}}\right)$$

$$\sin\omega = \frac{R}{r}\frac{\tan\alpha - \tan\beta}{\tan\alpha + \tan\beta}$$

$$\sin\varphi = \frac{R}{r}\frac{\tan\gamma - \tan\delta}{\tan\gamma + \tan\delta}$$

On the other hand, since α, β, γ, and δ are obtained from the coordinates of the image of the light emitting devices on the imaging surface 293 as in Equation 05, the values of R, ω, and φ in Equation 06 are determined.

[equation 06]

$$\alpha = \sqrt{\left\{\frac{(H_a - H_m)\alpha_H}{H_{max}}\right\}^2 + \left\{\frac{(V_a - V_m)\alpha_v}{V_{max}}\right\}^2}$$

$$\beta = \sqrt{\left\{\frac{(H_c - H_m)\alpha_H}{H_{max}}\right\}^2 + \left\{\frac{(V_c - V_m)\alpha_v}{V_{max}}\right\}^2}$$

$$\gamma = \sqrt{\left\{\frac{(H_b - H_m)\alpha_H}{H_{max}}\right\}^2 + \left\{\frac{(V_b - V_m)\alpha_v}{V_{max}}\right\}^2}$$

$$\delta = \sqrt{\left\{\frac{(H_d - H_m)\alpha_H}{H_{max}}\right\}^2 + \left\{\frac{(V_d - V_m)\alpha_v}{V_{max}}\right\}^2}$$

$$\tan\rho = \frac{V_a - V_c}{H_a - H_c}$$

It should be noted that ρ represents a rotation around the line-of-sight vector PM with respect to the reference coordinates. In Equation 05, the capture ring aim 068 is assumed on the XY plane, but it is generally inclined with a certain posture angle. As shown in FIG. 21A, when the X* axis is inclined by α with respect to the horizontal and the Y* axis is inclined by β with respect to the horizontal, r cos ε and r cos τ may be used instead of r.

From FIG. 22C, the relationship between $P_b$ and the view coordinate $P_t$ of the target direction vector 157 (Equation 007) can be obtained in the coordinate system (XbYbZb) representing the attitude of the deep-sea crane 001. The definitions of Pitch, Yaw, and Roll follow the definition in FIG. 23.

[equation 07]

$$\text{Roll} = \frac{H_m - \frac{H_{max}}{2}}{H_{max}}\alpha_H$$

$$\text{Pitch} = -\frac{v_m - \frac{V_{max}}{2}}{V_{max}}\alpha_V$$

$$\text{Yaw} = \tan^{-1}\left(\frac{V_a - V_c}{H_a - H_c}\right)$$

If the rotation quaterion of (Equation 007) is $Q_t$, then (Equation 008) is obtained.

$$P_t = Q_t P_b Q_t^* \quad \text{[equation 08]}$$

Equation 09 is obtained from Equation 08 and Equation 03, and the posture of the imaging device 235 with respect to the reference coordinates P is obtained.

$$P_b = Q_t^{-1} Q_T P Q_T^* Q_t^{*-1} \quad \text{[equation 09]}$$

The processing block 561 in FIG. 21D is obtained from Equation 05 and Equation 06, and the processing block 562 is obtained from Equation 08.

[equation 05]

As a result of the optical navigation 229 in FIG. 15, the command value is calculated to the control system in the processing block 523 of FIG. 15, and the deep sea crane 001 is brought close to the capture ring aim 068 by the control system of FIG. 14.

III Control System

1. Control Principle 1.1 Control System Configuration

FIG. 14 is a block diagram showing the control logic.

The measured values of the navigation sensor 113 including the inertial position sensor, the depth gauge, the acoustic sensor, the optical sensor, and the geomagnetic sensor are input to the position/speed control system 216. Pitch, yaw, and roll signals from the attitude sensor 214 are input to the attitude control system 217. The navigation control system 212 gives a navigation command 404 to the position/speed control system 216 according to the navigation mode selected in the processing block 522 of FIG. 15.

The navigation command 404 is a time function of the target position, and includes the seabed landing position that is the arrival target position, and the moving trajectory that is the time function between the current position of the deep-sea crane 001 and the control target position. The attitude control system 217 can practically ignore other than the rotation around a vertical axis, as the deep sea crane 001 in which a cargo room 005 is suspended in a buoyancy tank 002 has a similar shape to balloons (FIGS. 1A and 31).

In the case of the inertial navigation 227 and the acoustic navigation 228, the position/speed control system 216 calculates the control order by Equation 015 and Equation 016, and individual thruster controllers 221 send out control order to each control wings. In these cases, braking and rotation or horizontal thrust is obtained by controlling the opening angle and rotation angle of the control wings and landing leg attached to the cargo room as shown in FIG. 26A,B.

Figure 24B:
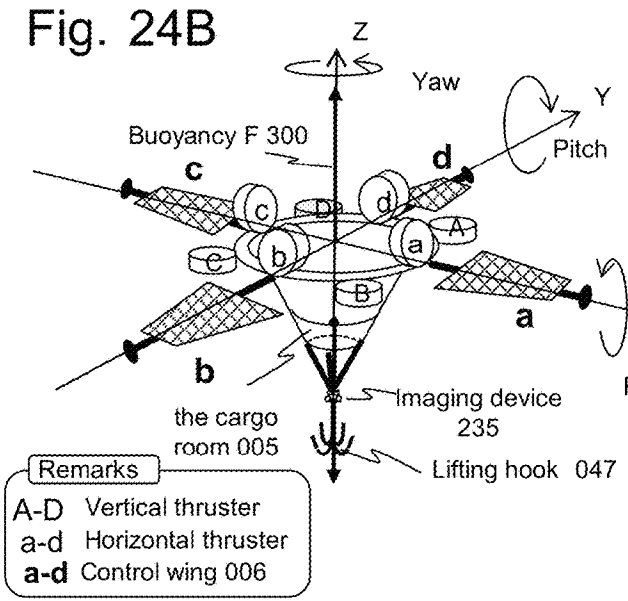
FIG. 24B is an overview of the of attachment for precision control attachment.

When performing precise position/velocity control by optical navigation 229, the position/velocity control system 216 calculates the control order by Equation 015 and Equation 016, and the individual thruster controllers 221 output the command signals to the individual thrusters. When performing the precise position/velocity control by the optical navigation 229 in FIG. 15, the precise position control is performed by adding precision control attachments with thrusters added to the cargo compartment 005 as shown in FIGS. 24B and 44B. The precise control is performed only when the rendezvous control is needed in order to hoist the capture ring 037 of the seabed mineral ores collection device 015 (electric power shovel) and the seabed mineral ores collection container 034 by the lifting hook 047. Other than that, the potential energy is passively used for the round-trip between the sea surface and the seabed without using thrusters.

The deep sea crane 001 is navigated by controlling the individual thrusters and the command orders to the control wings. Since this is common to all of the following operation modes (inertial navigation, acoustic navigation, optical navigation), the integrated control 215 changes the components of the diagonal matrix A of Equation 016 corresponding to the state variables, and the feedback coefficient of Equation 016 so as to realize the each control mode commonly, corresponding to each of the position/speed control system 216 and the attitude control system 217.

The navigation control system 291 shown in FIG. 14 is described below in detail. The structure and coordinate system are as shown in FIGS. 23 and 24. FIG. 23B,24C, and FIG. 44C model the external force vectors acting on the cargo compartment 005 of the deep-sea crane 001.

As the shape of the deep-sea crane is axisymmetric, the attitude control is mainly the rotation about the vertical axis When hoisting the container 034, it is necessary to face the capture ring 037 of the rendezvous target (FIG. 24E, FIG. 44E). There are the following two measures as this solution.

Figure 31A:
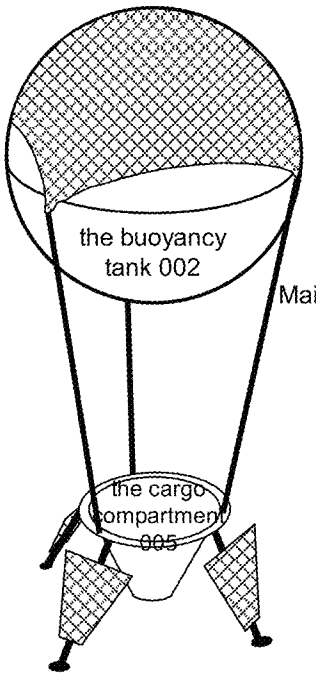
FIG. 31A is an overview of a deep sea crane w/ one buoyancy tank.
Figure 31B:
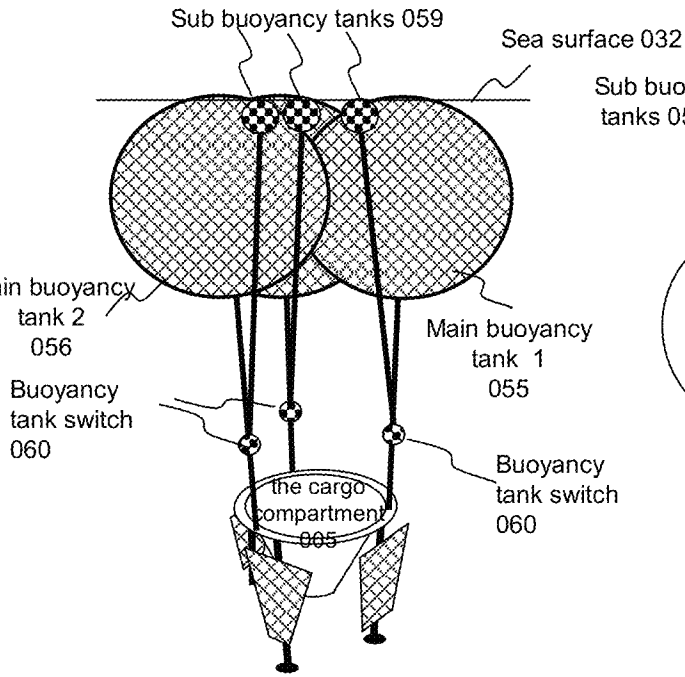
FIG. 31B is an overview of a deep sea crane w/ three buoyancy tanks.
Figure 31C:
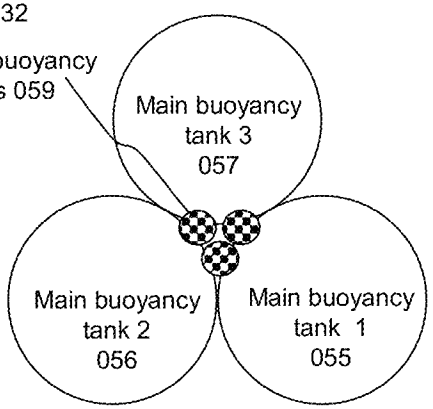
FIG. 31C is a top view of a deep-sea crane w/ three divided tanks.

(1) Since the shape of a deep-sea crane is axisymmetric, the attitude control is focused to the rotation control in the axial direction, however it is absorbed by the twist of the suspension rope and it is difficult to control the rotation in the cases of suspension types of FIG. 31A.B. Therefor no rotation control is performed. The capture ring 037 of the rendezvous target (FIG. 24E) can be directly faced regardless of the axial rotational position. For example, four imaging devices 235 having a viewing angle of 90 degrees apart are arranged orthogonally, and four lifting hooks 047 are provided so as to face the center of the visual field of one of the imaging device 235. In FIGS. 24B and 24D, the imaging device 235 suspended in the cargo compartment 005 keeps the entire circumference in view. Of these, the imaging device 235 that captures the rendezvous target (FIG. 24E)) is selected to perform precise position/speed control. In this case, the horizontal thruster of FIG. 24A is not provided with a thruster for rotating the cargo room 005 around its axis.

(2) The policy is to control the rotation around the axis of the deep-sea crane 001, and if the suspension method as shown if FIG. 31D is employed, the rotation is absorbed by the buoyancy tank connector 060. No problem due to the rotation of the hanging rope occurs, Thus the imaging device 235 suspended in the cargo compartment 005 is rotationary controlled to image the capture ring 037 of the rendezvous target (FIG. 44E) within the field of view is generated. In FIGS. 44A and 44B, thrusters e and f are provided for rotating the cargo compartment 005 around an axis.

1.2 Position and speed control

In the case of inertial navigation 227 and acoustic navigation 228, braking and lateral thrust are obtained by controlling the degree of opening and rotation angle of each of the four control wings 006 shown in FIG. 23A. The degree of opening and rotation are same for the control wing/leg a and c, and same for b and d.

$$Ra=Rc$$

$$Rb=Rd$$

The components of the above vector are defined as follows.

$$R_a = \begin{bmatrix} 0 \\ R_{ay} \\ R_{az} \end{bmatrix} \quad R_b = \begin{bmatrix} R_{bx} \\ 0 \\ R_{bz} \end{bmatrix} \qquad \text{[equation 10]}$$

The drag force is defined by the following parameters.

Wing opening angle: $\alpha_a$ (subscript is wing ID)

Wing rotation angle: $\beta_b$ (subscript is wing ID)

Ascending/Descending force S=W−F

Cargo compartment weight W

The function Fxy is an empirical formula that generates a thrust component with respect to the horizontal plane.

The function Fz is an empirical formula that generates a thrust component in the vertical direction. Since the vertical thrust is generated by the passive resistance vanes, it acts only as a resistance that counteracts the difference between buoyancy and gravity.

$$R_{ay}=F_{xy}(S,W,\alpha_a,\beta_a)$$

$$R_{az}=F_z(S,W,\alpha_a,\beta_a)$$

The following is obtained by integrating each component.

$$T = 2\begin{bmatrix} R_{bx} \\ R_{ay} \\ R_{az} + R_{bz} \end{bmatrix} \qquad \text{[equation 11]}$$

1.3 Precision Control of Position/Speed

When the precise position/velocity control is performed by the optical navigation 229, FIG. 24C and FIG. 44C show forces acting on the deep-sea crane 001.

Before performing the precise position/speed control, the ballast is adjusted to balance the buoyancy and gravity of the deep-sea crane 001, and the crane is once stopped before moving to rendezvous operation by the precise position/speed control. The position and speed of the cargo compartment 005 is controlled in FIG. 24A,B,C and FIG. 44A,B,C and the cargo compartment 005 is suspended by a rope from buoyancy tanks.

It is not necessary to control the posture of the lifting hook 047 and the imaging device 235 due to their structure. In FIG. 44, the attitude control is performed so that the lifting hook 047 and the imaging device 235, which are suspended from the cargo compartment 005, can face the rendezvous target (FIG. 44E).

In the precise position/speed control, the thrusts of the vertical thrusters A to D in FIG. 44B are TA, TB, TC, TD, and the thrusts of the horizontal thrusters a to f are Ta, Tb, Tc, Td, Te, and Tf, (In the case of FIG. 24B, Te=Tf=0)

Since the control in the vertical direction is performed while maintaining the horizontal posture, the thrust of the vertical thruster is the same.

$$Tz=TA=TB=TC=TD$$

Expressing the components of the above vector, $$T_z = \begin{bmatrix} 0 \\ 0 \\ T_z \end{bmatrix} \qquad \text{[equation 12]}$$

Since the thrusters in the horizontal direction are on the X-axis or Y-axis, the thrust are same for each axis because of the horizontal movement.

$$Ta=Tc$$

$$Tb=Td$$

$$Te=-Tf$$

Vector notation, $$T_a=\begin{bmatrix}T_a\\0\\0\end{bmatrix}\quad T_b=\begin{bmatrix}0\\T_b\\0\end{bmatrix}$$ [equation 13]

The following is obtained by integrating each component.

$$T=\begin{bmatrix}2T_a\\2T_b\\4T_z\end{bmatrix}$$ [equation 14]

If there is attitude control and the z-axis torque is Rz, Rz=2Te·b, where b is the distance from the z axis of the thruster.

Rendezvous Mechanism

The precise position/velocity control is also used to lift the seabed mineral ores collection device 015 (electric power shovel) and the capture ring 037 of the seabed mineral ors collection container 034 by the lifting hook 047 of the cargo compartment of the deep sea crane 001. The rendezvous mechanism of FIG. 24D,E and FIG. 44D,E is specially prepared for this purpose. Passing through the capture ring 037 through the hanging hook 047 and hang it up.

The capture ring is located above the object to lift and has a light-emitting device with four LEDs on the upper part. The imaging device 235 on the upper part of the lifting hook 047 captures the capture ring 037 in the visual field. The deep-sea crane 001 is guided by an optical method to lift the capture ring 037 by the lifting hook 047. The height of the light emitting LEDs is set so that the imaging device 235 can easily capture them.

1. 4 Control Law

The deep sea crane 001 has a specific gravity of around 1.0, a low moving speed of about 1 m/sec. and a low resistance symmetrical shape. However, with respect to movement in the x-axis, y-axis, and z-axis directions, the deep sea crane 001 receives water resistance which is a function of speed, here approximated as linear. R is a water resistance coefficient and the equation of motion can be expressed by Equation 015.

$$T(t)=M\ddot{X}(t)+R\dot{X}(t)$$

$$r(t)=m\ddot{\omega}(t)+s\dot{\omega}(t)$$ [equation 15]

Here, M is the mass of the deep sea crane 001, R is the resistance coefficient, and X (t) is the position of the center of gravity in the reference coordinate system. T (t) is the thrst in the reference coordinate system obtained from the navigation control system and the levitation control system for the deep-sea crane 001. Where, r is the torque around the z-axis, in is the rotation moment, and s is the resistance torque against rotation. (r(t) is considered only when attitude control is performed). A control system is configured for the dynamic characteristics of Equation 015. The control law is to find T(t) that minimizes the following. When performing attitude control, also obtain r(t).

Then minimizing the next equation, $$\int(W(t)-W_T(t))^T{}_A((W(t)-W_T(t)))_{dt}$$

Where, $$W(t)=\begin{bmatrix}X(t) & 0_{3\times3}\\0_{3\times3} & \dot{X}(t)\end{bmatrix}$$

$$W_T(t)=\begin{bmatrix}X_T(t) & 0_{3\times3}\\0_{3\times3} & \dot{X}_T(t)\end{bmatrix}$$

$$\int(r(t)-r_T(t)))^2dt$$

When attitude control is performed, the next equation is minimized.

[equation 16]

A is a 6×6 constant matrix whose diagonal elements are aij>0 i=0.5.

The lower right subscript in WT(t), XT(t), and rT(t) in (Equation 016) indicates the target value, and the upper right subscript indicates the transposed matrix.

VI Supervisory Control System

The equipment that composes the seabed mineral ores collection has been described above. All of these activities are monitored and controlled by the supervisory control system 283 from the surface command ship 010.

Considering that the surface command ship 010 uses a standard ore carrier ship, which is changed to the surface command ship with a PC-based small-sized portable system to facilitate effective operation.

Figure 35:
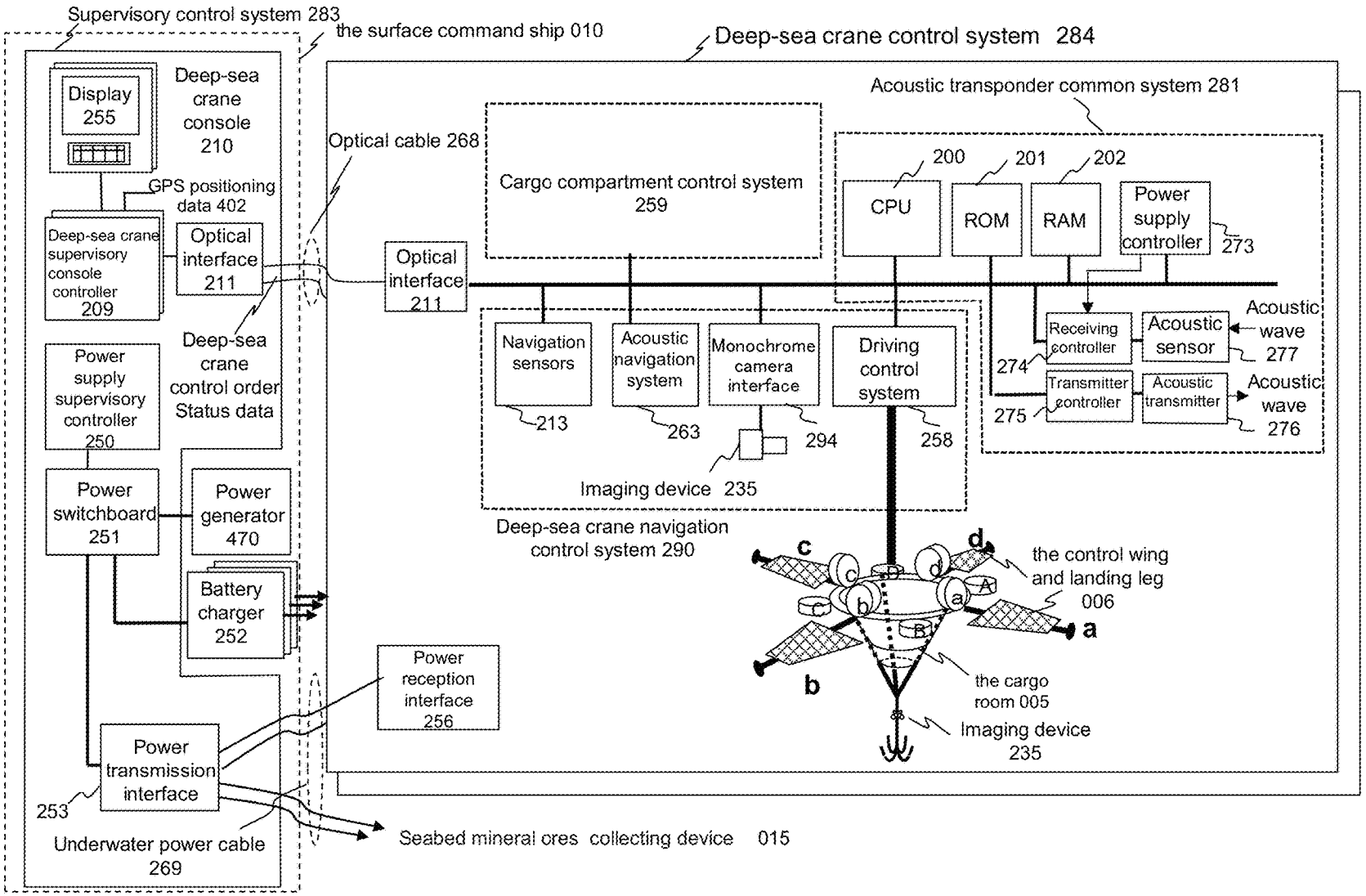
FIG. 35 is a diagram showing a supervisory control device of a deep-sea crane.

(1) Navigation control (2) Controlling the seabed mineral ores collection devices (3) Managing acoustic position markers (4) Power control (5) Controlling the surface command ship The supervisory, control system 283 includes a part relating to the deep-sea crane control system 284 shown in FIG. 35 and a part relating to the seabed mineral ores collecting device (electrical power shovel) 015, shown in FIG. 30.

In the part relating to the deep sea crane control device 284 shown in the monitoring control system of FIG. 35, the deep sea crane console 210 on the surface command ship 010 performs the next monitoring control of the deep sea crane 001 via the optical interface 211.

(1) The state of the deep-sea crane (01 is monitored, the landing to and lifting from the seabed is controlled, the operation management such as ore loading, and the ballast control information are managed and controlled.

(2) The images from the imaging device 235 are monitored when the precise speed position control is active, and manual control is performed if necessary.

In addition to the functions related to the deep sea crane control device 284, the deep sea crane console 210 of the supervisory control system in FIG. 35 performs the following.

(1) Based on the GPS positioning data 402 captured by the supervisory controlled control system 283, a speed and steering command for canceling the influence of ocean current and wind are imposed to the surface command ship 01W in order to maintain a fixed point.

(2) Managing the identification numbers (IDs) of the acoustic position markers set by the position marker ship 070, the latitude and longitude, and the installation time are collectively managed. Every time the acoustic position marker is installed and collected, the information is updated by the acoustic position marker control device (FIG. 38, FIG. 47) of the position marker ship 070 using media. Since the acoustic position marker is driven by a battery, the battery consumption is managed. The position marker ship 070 is provided with the information for floating recovery.

(3) As the submarine equipment management, information such as the identification number (ID), the latitude and longitude, and the installation time of the seabed mineral ores collecting device 015 (electric power shovel) and the seabed mineral ores collecting containers 034 are managed.

(4) Collect and manage geographic information (video information, resource excavation information) on the seabed.

In the part relating to the seabed mineral ores collection device control device 285 shown in the supervisory control device of FIG. 30, the deep sea crane console 210 on the surface command ship 010 performs the next monitoring control of the seabed mineral ores collection device 015 via the optical cable 268.

(1) While watching the image of the ultrasonic high-definition video camera 050 on the display 255, the seabed mineral ores collecting device 015 is operated with the joystick 270. When the seabed visibility is good, the imaging device 235 is also used.

(2) According to the instruction of the deep sea crane console 210, the mineral loading target is selected and performed.

(3) The seabed mineral ores collecting device 015 is remotely controlled by the joystick 270 and the resource collecting device console 441 via the optical cable 268.

The power switchboard 251 controls the power generator 470 by the power supply monitoring system 250 shown in FIG. 35 to perform the following.

(1) Power is supplied to the seabed mineral ores device power mechanism 267 of the mineral collection device 015 through the power transmission interface 253 and the undersea power cable 269.

(2) Power is supplied to the deep-sea crane control system 284 via the power transmission interface 253 and the undersea power cable 269. The attachment for detailed position/speed control has a thruster and requires electric power for driving, but there is also a method of mounting a high-performance secondary battery and omitting the undersea power supply cable 269.

The power supply device monitoring control system 250 controls the charging device 252 via the power supply control panel 251 to charge the acoustic position markers and the secondary battery for the deep sea crane control device 284.

The seabed mineral resource collection system of the present invention can collect and unload mineral ores distributed on the seafloor, but since the components do not contain gas and are composed only of liquid and solid, the internal pressure and seawater pressure of the component device can be equalized at any seafloor depth without having a special pressure resistance mechanism.

Moreover, since it does not include pumping of fluid, there are no mechanical restrictions. Since the buoyancy is used to lift the seafloor mineral resources with being slightly lighter than the specific gravity of the surrounding seawater, the energy required for the lift does not increase with depth.

That is, it can be operated from a depth of less than 1000 to a depth of more than 6500 m in which seafloor mineral resources exist. Since the operation is flexible in this way, it is possible to selectively move and collect sea areas with high-grade minerals, which has a great profitable effect.

The numbers shown in the examples are for feasibility and can be scaled up or down.

What is claimed is:

1. A seabed resource lifting apparatus comprising:

a deep sea crane;

a seabed mineral ores collecting device;

a surface command ship; and acoustic position markers;

wherein the deep-sea crane is characterized by including all or part of the following four items:

a buoyancy tank containing a liquid including n-cyclopentane or gasoline, the liquid is in liquid phase at room temperature and has lower specific gravity than water, wherein the buoyancy tank is hermetically filled, a cargo compartment to collect seabed mineral ores from the seabed, a mechanism for connecting the cargo compartment to buoyancy tank, a control device including control wings and landing legs for landing the cargo compartment on the seabed and controlling the position and attitude in the sea;

wherein the deep sea crane is configured to descend to the sea floor by making the specific gravity of the entire deep sea crane including a ballast mounted in the cargo compartment larger than seawater, then after landing on the seabed, the ballast mounted in the cargo compartment is exchanged for seabed mineral ores, wherein the specific gravity of the deep-sea crane is made smaller than that of surrounding seawater, and the seabed mineral ores are collected when floating on the sea surface; and wherein the deep sea crane is made of solid and liquid to equalize the internal pressure of the deep sea crane with the ambient seawater, thereby avoiding mechanical stress due to high pressure.

2. The seabed resource lifting apparatus according to claim 1 wherein the deep sea crane i further comprises:

a gap in the lower part of the buoyancy tank, the cargo compartment having a structure capable of smoothly dropping the seabed mineral ores from above the cargo compartment by gravity is suspended in water, wherein the seabed mineral ores collecting device is configured to place the seabed mineral ores from the above void space into the cargo compartment, wherein the gravity of the seabed mineral ores is configured to force the ballast loaded in the cargo compartment downward, thereby exchanging the ballast with the seabed mineral ores;

wherein the ballast includes a ballast discharge mechanism including a passage blocking function is provided at a lower end of the cargo compartment, and in order to prevent mixing of ballast brought in from the sea surface and collected mineral ores thrown in from above on the sea floor, providing a membranous or stretchable and movable partition mechanism, which is movable on the upper surface of the ballast when descending from the sea surface, wherein the ballast can be dropped and discharged by the ballast discharge control mechanism at the lower end of the cargo compartment, wherein the control wings includes a weighing scales for measuring the load on the seabed are installed on a part or all of the control wings and landing legs for landing, and the underwater weight of the entire deep-sea crane is constantly monitored from the measured value in order to control the amount of ballast within a range in which the cargo compartment can continue landing on the seabed in accordance with the weight of the seabed mineral ores fed from above the cargo compartment, and wherein after the loading of the collected mineral ores into the cargo compartment is completed, the ballast discharge is controlled to make the deep-sea crane float from the seabed by means of controlling the specific gravity of the deep-sea crane smaller than that of the surrounding seawater.

3. The seabed resource lifting apparatus according to claim 1 wherein the control wings and landing leg of the deep-sea crane are configured by the following features, and the horizontal movement and the ascending/descending speed of the deep-sea crane can be controlled;

wherein the control wings and landing legs are provided on an outer peripheral portion of an upper part of the cargo compartment, wherein the control wings and landing legs are configured to individually control the opening degree in the horizontal direction from the vertical direction toward the outer periphery in the radial direction, wherein the control wings and landing legs are capable of individual rotation around the support pillar of each controlwing and landing leg.

4. The seabed resource lifting apparatus according to claim 1 wherein the deep sea crane includes a route guidance control function for guiding and controlling a movement route between a seabed landing point and the surface command ship, and includes the following features:

when the deep sea crane descends from the sea surface, inertial navigation and acoustic navigation can be switched according to the positional relationship with the seabed landing point, which is a target point when descending, when the deep-sea crane rises from the seabed landing point inertial navigation and acoustic navigation can be switched according to the positional relationship with the surface command ship, which is the target point when rising;

wherein the depth data and inertial navigation data are used in the range where sound waves do not reach due to the temperature distribution in the sea or a propagation straightness is not sufficient to measure a target direction, and the depth data and sound are used in the range where acoustic measurement is sufficient to measure the target direction;

wherein, an acoustic transponder is installed at the seafloor landing point and the surface command ship, and the acoustic transponder generates an echo in response to a acoustic oscillator installed in the deep-sea crane to measure the round-trip time of the acoustic signal;

wherein, when the deep-sea crane is ascending, the distance between the deep-sea crane and the surface command ship is measured, and a direction of existence of the surface command ship is detected from a phase difference between a vibration receiving elements installed at different points at the deep-sea crane; and wherein, when the deep sea crane descends, the distance between the deep sea crane and the seafloor landing point is measured, and the direction of seafloor landing point is based on the phase difference between the vibration receiving elements installed at different points at the deep sea crane.

5. The seabed resource lifting apparatus according to claim 1 wherein the buoyancy tank of the deep-sea crane is divided into three or more equal-volume balls and is made of a lightweight and tough material including carbon fiber resin;

wherein, in order to disperse the suspension stress on each sphere, a net is squeezed from the upper part of each sphere to a side surface to cover a rope, and the cargo compartment is suspended by the rope from each sphere;

wherein, the deep-sea crane is configured to operate as follows;

when collecting the collected mineral ores on board, the cargo compartment is caught by the onboard crane of the surface command ship from a gap in the center of each of the balls while the balls are floating on the sea surface, when descending to the seabed, the ballast is mounted in the cargo compartment and lifted down from the gap at the center of each of the balls floating on the sea surface by the onboard crane of the surface command ship, connected to each of the balls, and descends to the seabed.

6. The seabed resource lifting apparatus according to claim 1 wherein the acoustic position marker is an acoustic position marker installed on the seabed in correspondence with the latitude and longitude, and includes the following three features:

the acoustic position marker is set immediately below a marker ship whose latitude and longitude are measured on the sea surface by GPS; on the surface of the sea, oscillate an acoustic signal from apexes of a polygon that encloses the marker ship with different latitude and longitude surrounding the marker ship, and measuring deviation from the vertical line directly under the marker ship by the principle of triangulation of the acoustic wave or inertial guidance to steer each wing of the acoustic position marker to eliminate the deviation from the vertical line to reach the point directly below a sign ship; after the acoustic position marker has landed on the seabed, the acoustic marker functions as a transponder in response to an interrogation signal from the deep-sea crane.

7. The seabed resource lifting apparatus according to claim 1 wherein the surface command ship includes a supervisory control device which supplies power to the seabed mineral ores collecting device, performs communication by optical fiber, and controls the descending of the deep-sea crane from the surface command ship to the seabed landing point, and controls the ascending of the deep-sea crane from the seabed landing point to the surface command ship;

wherein the power generation device of the surface command ship supplies power to the deep-sea crane by power transmission or charging its rechargeable battery; and, wherein, the supervisory control device of the surface command ship controls transferring the mineral ores collected from the deep-sea crane to the surface command ship.

* * * * *